US005290668A

United States Patent [19]

Ohtani

[11] Patent Number: 5,290,668

[45] Date of Patent: Mar. 1, 1994

[54] SILVER HALIDE COLOR PHOTOGRAPHIC MATERIAL

[75] Inventor: Shigeaki Ohtani, Kanagawa, Japan

[73] Assignee: Fuji Photo Film Co., Ltd., Kanagawa, Japan

[21] Appl. No.: 37,542

[22] Filed: Mar. 24, 1993

Related U.S. Application Data

[63] Continuation of Ser. No. 648,806, Jan. 31, 1991, abandoned.

[30] Foreign Application Priority Data

Feb. 2, 1990 [JP] Japan ..... 2-24234

[51] Int. Cl.[5] ..... G03C 1/46

[52] U.S. Cl. ..... 430/496; 430/505; 430/531; 430/538; 430/551; 430/621; 430/626

[58] Field of Search ..... 430/496, 505, 531, 538, 430/551, 621, 626

[56] References Cited

U.S. PATENT DOCUMENTS

| | | | |
|---|---|---|---|
| 4,826,757 | 5/1989 | Yamada et al. | 430/621 |
| 4,935,298 | 6/1990 | Dethlefs et al. | 430/538 |
| 5,043,256 | 8/1991 | Otani | 430/551 |
| 5,057,404 | 10/1991 | Waki et al. | 430/551 |
| 5,057,405 | 10/1991 | Shiba et al. | 430/538 |
| 5,063,139 | 11/1991 | Hayashi | 430/621 |
| 5,075,205 | 12/1991 | Inagaki et al. | 430/522 |
| 5,093,327 | 3/1992 | Nakazyo et al. | 430/551 |

*Primary Examiner*—Janet C. Baxter

*Attorney, Agent, or Firm*—Sughrue, Mion, Zinn, Macpeak & Seas

[57] ABSTRACT

A silver halide color photographic material is disclosed comprising a support comprising a base material and a water resistant resin layer containing titanium dioxide particles in an amount of at least 14% by weight of the water resistant resin layer, said support having thereon at least one blue-sensitive silver halide emulsion layer, at least one green-sensitive silver halide emulsion layer, at least one red-sensitive silver halide emulsion layer on the same side of the support as the water resistant resin layer, said photographic material having an optical reflection density of at least 0.70 at 680 nm, said photographic material containing at least one compound represented by formula (I) or (II) and at least one compound represented by formula (III), the total layer thickness of the constituent photographic layers provided on the support after immersing in a color developing solution for at least 60 seconds is at least 1.4 times that of the dry thickness before processing, and the total silver coverage of all of the silver halide emulsions contained in the silver halide color photographic material is not more than 0.78 g/m$^2$ in terms of the coating weight of silver:

$$R_{21}\text{—}(A)_n\text{—}X \qquad (I)$$

25 Claims, No Drawings

SILVER HALIDE COLOR PHOTOGRAPHIC MATERIAL

This is a continuation of application Ser. No. 07/648,806 filed Jan. 31, 1991, now abandoned.

FIELD OF THE INVENTION

The present invention relates to a silver halide color photographic material and, more particularly, to a silver halide color photographic material having excellent sharpness and which substantially does not exhibit increased staining in the unexposed areas after processing. Moreover, the present invention relates to a silver halide color photographic material which exhibits less change in sensitivity and gradation when continuously processed.

BACKGROUND OF THE INVENTION

Various silver halide color photographic materials are commercially available, and various image forming methods using these materials are known for use in various applications. The performance required of a photographic material varies depending on the use thereof, but generally, a photographic material must exhibit high sharpness for good high density image recording which is the most advantageous characteristic of silver halide photographic materials. Various practical methods for increasing sharpness have been developed in accordance with the degree of requirements for photographic materials and intended application.

Primary factors which cause a lowering in the sharpness of the photographic material include two factors, namely, halation caused by reflection of incident light mainly at the interface between the emulsion layer and the support or between the support and air, and irradiation caused by light scattering from the silver halide grains themselves.

The coating of a layer containing a white pigment on a support is effective for enhancing sharpness as disclosed, for example, in JP-B-58-43734 (the term "JP-B" as used herein refers to an "examined Japanese patent publication"), JP-A-58-17433 (the term "JP-A" as used herein refers to a "published unexamined Japanese patent application"), JP-A-58-14830 and JP-A-61-259246. However, effects obtained by these methods are insufficient. Other methods described in U.S. Pat. Nos. 2,548,564 and 3,625,694, JP-A-56-12639, JP-A-63-197943, European Patent 0337490A2 and JP-A-1-188850 concerning the coloring of photographic layers in the photographic material by dyes, etc., are proposed for improving sharpness. However, effects obtained by these methods are also insufficient. It has been found that when the content of the dye is increased to improve sharpness, variation in photographic characteristics is disadvantageously increased when the photographic material is continuously processed.

Stain in the unexposed areas of a silver halide color photographic material is undesirable because it influences the white clearance of image and reduces the distinctiveness of the image from the background. In addition thereto, stain has an adverse effect on the color turbidity of dye image and degrades visual sharpness. Particularly, when the support is composed of a reflective material, the reflection density of stain is considered to be enhanced by several times the transmitted density. Accordingly, even slight staining damages image quality, and, therefore, stain is a very important factor. Four main factors contribute to staining. First, stain is caused by heat or humidity prior to processing but after preparation of the photographic material. Second, stain is caused by the developed fog of the silver halide. Third, stain is caused by color staining (e.g., air fogging) of couplers in developing solutions, or bleaching stain wherein developing agents left in emulsion layers are oxidized by the bleaching bath or oxygen and reacted with couplers to form dyes. Fourth, stain is caused by a change with the passage of time caused by light or humidity after development. A problem to be solved in the present invention is concerned with stain caused by the above third or fourth factors, in particular. The problem of stain has been particularly noted in recent years and is associated with the low rate of replenishment of processing solutions including rinsing solutions now employed to conserve resources and reduce pollution. Methods for alleviating the problem of stain are described, for example, in U.S. Pat. Nos. 3,935,016, 3,960,570 and 2,360,290, JP-A-51-9449 and European Patent 0277589. The present inventors have studied the methods described in the above patent publications and have found that the compounds represented by formulae (I) or (II) and (III) according to the present invention, as described in European Patent 0277589, can remarkably prevent the occurrence of stain from being formed, but result in an unacceptable change in sensitivity and gradation when the photographic materials are continuously processed. The present inventors have also found that when the coating weights of dyes are increased to improve sharpness as described above, the change in sensitivity and gradation after continuous processing is much increased. Thus, the above described methods cannot be applied practically to continuous processing. As a result, the present inventors have extensively studied the problem of enhanced sharpness in continuous processing while still providing stable photographic properties.

SUMMARY OF THE INVENTION

An object of the present invention is to provide a silver halide color photographic material having excellent sharpness and which substantially does not exhibit staining upon storage over prolonged periods after processing, and, moreover, which substantially does not result in a change in sensitivity and gradation before and after continuous processing.

Other objects of the present invention will become apparent from the following description.

The above described objects of the present invention have been achieved by providing a silver halide color photographic material comprising a support comprising a base material and a water resistant resin layer containing titanium oxide particles in an amount of at least 14% by weight of the water resistant resin layer, said support having thereon at least one blue-sensitive silver halide emulsion layer, at least one green-sensitive silver halide emulsion layer and at least one red-sensitive silver halide emulsion layer on the same side of the support as the water resistant resin layer, said photographic material having an optical reflection density of at least 0.70 at 680 nm, said photographic material containing at least one compound represented by formula (I) or (II) and at least one compound represented by formula (III), the total layer thickness of the constituent photographic layers provided on the support after immersing in a color developing solution for at least 60 seconds is at least 1.4 times that of the dry thickness before processing, and the total silver coverage of all of the silver halide emulsions contained in the silver halide color photographic material is not more than 0.78 g/m$^2$ in terms of the coating weight of silver:

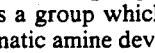

(I)

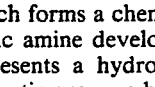

(II)

wherein $R_{21}$ and $R_{22}$ each represents an aliphatic group, an aromatic group or a heterocyclic group; X represents a group which is eliminated by reaction with an aromatic amine developing agent; A represents a group which forms a chemical bond by reaction with an aromatic amine developing agent; n represents 1 or 0; B represents a hydrogen atom, an aliphatic group, an aromatic group, a heterocyclic group, an acyl group or a sulfonyl group; $Y_1$ represents a group which accelerates the addition of an aromatic amine developing agent to the compound of formula (II); and $R_{21}$ and X, or $Y_1$ and $R_{22}$ or B may be combined together to form a ring structure:

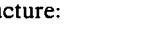

(III)

wherein $R_{30}$ represents an aliphatic group, an aromatic group or a heterocyclic group; and Z represents a nucleophilic group or a group which releases a nucleophilic group upon decomposition in the photographic material.

DETAILED DESCRIPTION OF THE INVENTION

The compounds represented by formulae (I), (II) and (III) are illustrated in detail below.

The compounds of formulae (I) and (II) preferably have a second order reaction constant $k_2$ (80° C.) (in terms of the reaction with p-anisidine) of from 1.0 to $1\times10^{-5}$ liter/mol·sec as measured by the method described in JP-A-63-158545. In the compounds of formula (III), Z preferably is a group derived from a nucleophilic functional group having a Pearson's nucleophilic $^nCH_3I$ value (R. G. Pearson, et al., *J. Am. Chem. Soc.*, 90, 319 (1968)) of 5 or above.

Among the compounds represented by formulae (I), (II) and (III), a compound having the formula (I) or (II) is used together with a compound having the formula (III).

Each group of the compounds represented by formulae (I), (II) and (III) is illustrated in detail below.

The aliphatic group represented by $R_{21}$, $R_{22}$, B and $R_{30}$ is a straight chain, branched or cyclic alkyl, alkenyl or alkynyl group. These groups may be substituted. The aromatic group represented by $R_{21}$, $R_{22}$, B and $R_{30}$ is a carbon ring type aromatic group (e.g., phenyl, naphthyl) or a heterocyclic type aromatic group (e.g., furyl, thienyl, pyrazolyl, pyridyl, indolyl). These groups may be a monocyclic type or a condensed ring type (e.g., benzofuryl, phenanthridinyl). The aromatic ring of these groups may be substituted.

The heterocyclic group represented by $R_{21}$, $R_{22}$, B and $R_{30}$ is preferably a group having a 3-membered to 10-membered ring structure comprising carbon and hydrogen, and at least one member selected from oxygen, nitrogen and sulfur The heterocyclic ring itself may be a saturated ring or an unsaturated ring, or may be substituted (e.g., chromanyl, pyrrolidyl, pyrrolinyl, morpholinyl).

The group X in formula (I) is a group which is eliminated by reaction with an aromatic amine developing agent. X includes a group bonded to A through an oxygen atom, a sulfur atom or a nitrogen atom. Preferable examples of the group X include 2-pyridyloxy, 2-pyrimidyloxy, 4-pyrimidyloxy, 2-(1,2,3-triazine)oxy, 2-benzimidazolyl, 2-imidazolyl, 2-thiazolyl, 2-benzothiazolyl, 2-furyloxy, 2-thiophenyloxy, 4-pyridyloxy, 3-isooxazolyloxy, 3-pyrazolidinyloxy, 3-oxo-2-pyrazolonyl, 2-oxo-1-pyridinyl, 4-oxo-1-pyridinyl, 1-benzimidazolyl, 3-pyrazolyloxy, 3H-1,2,4-oxadiazolin-5-oxy, aryloxy, alkoxy, alkylthio, arylthio or substituted N-oxy group and a halogen atom.

The group A in formula (I) is a group which forms a chemical bond by reaction with an aromatic amine developing agent and contains a group having a low electron density selected from

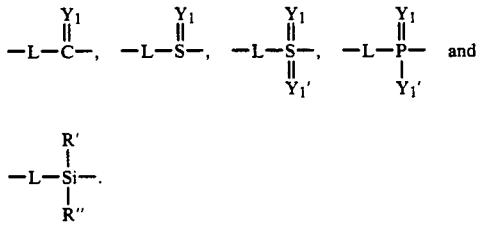

When X is a halogen atom, n is 0. In the above formulae, L represents a single bond, an alkylene group, —O—, —S—,

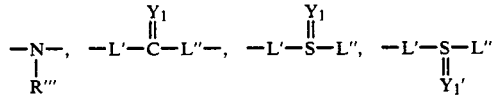

(e.g., a carbonyl group, a sulfonyl group, a sulfinyl group, an oxycarbonyl group, a phosphonyl group, a thiocarbonyl group, an aminocarbonyl group, a silylcarbonyl group, etc.).

$Y_1$ has the same meaning as in formula (II) and $Y_1$, has the same meaning as $Y_1$.

R′ and R″, which may be the same or different, each represents —L‴—$R_{21}$. R‴ represents a hydrogen atom, an aliphatic group (e.g., methyl, isobutyl, t-butyl, vinyl, benzyl, octadecyl, cyclohexyl, etc.), an aromatic group (e.g., phenyl, pyridyl, naphthyl, etc.), a heterocyclic group (e.g., piperidinyl, pyranyl, furanyl, chromanyl, etc.), an acyl group (e.g., acetyl, benzoyl, etc.) or a sulfonyl group (e.g., methanesulfonyl, benzenesulfonyl, etc.).

L′, L″ and L‴are each —O—, —S— or

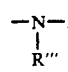

Furthermore, L‴ may be a single bond.

Among the groups represented by A, the bivalent groups represented by

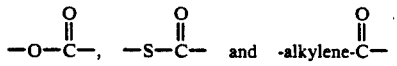

are preferred.

Compounds represented by formula (I) preferably have a second order reaction constant $k_2$ (80 ° C.) (in terms of the reaction with p-anisidine) of from $1\times10^{-1}$ liter/mol·sec to $1\times10^{-5}$ liter/mol·sec, represented by the following formulae (I-a), (I-b), (I-c) and (I-d).

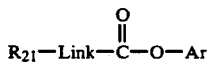

(I-a)

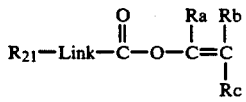

(I-b)

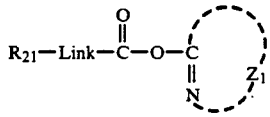

(I-c)

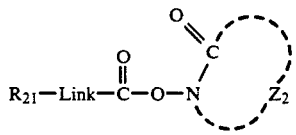

(I-d)

wherein $R_{21}$ has the same meaning as $R_{21}$ in formula (I); Link is a single bond or —O—; Ar is an aromatic group as defined above in the definition of $R_{21}$, $R_{22}$ and B (preferably the group released by reaction with an aromatic amine developing agent does not act as a photographic reducing agent such as hydroquinone derivative, catechol derivative, etc.); Ra, Rb and Rc, which may be the same or different, each represents a hydrogen atom, an aliphatic group, an aromatic group or a heterocyclic group as defined above in the definition of $R_{21}$, $R_{22}$ and B, and in addition thereto, Ra, Rb and Rc each represents an alkoxy group, an aryloxy group, a heterocyclic oxy group, an alkylthio group, an arylthio group, a heterocyclic thio group, an amino group, an alkylamino group, an acyl group, an amido group, a sulfonamide group, a sulfonyl group, an alkoxycarbonyl group, a sulfo group, a carboxyl group, a hydroxy group, an acyloxy group, a ureido group, a urethane group, a carbamoyl group or a sulfamoyl group. Ra and Rb or Rb and Rc may be combined together to form a 5-membered to 7-membered heterocyclic ring. The heterocyclic ring may be substituted, and may form a spiro ring, a bicyclic ring, etc., or may be condensed with an aromatic ring. $Z_1$ and $Z_2$ are each a nonmetallic atomic group required for forming a 5-membered to 7-membered heterocyclic ring. The heterocyclic ring may be substituted, may form a spiro ring, a bicyclic ring, etc., or may be condensed with an aromatic ring.

Among the compounds represented by formulae (I-a) to (I-d), the second order reaction constant $k_2$ (80° C.) (in terms of the reaction with p-anisidine), particularly the compounds having the formula (I-a), can be adjusted by varying the substituent groups to a value of from $1\times10^{-1}$ liter/mol·sec to $1\times10^{-5}$ liter/mol·sec when Ar is a carbon ring type aromatic group. In this case, the sum total of Hammett's $\sigma$ values of the substituent groups is preferably at least 0.2, more preferably at least 0.4, and particularly at least 0.6, although the value varies depending on selection of the group $R_{21}$.

When the compounds represented by formulae (I-a) to (I-d) are added during the course of the preparation of the photographic material, the sum total of the carbon atoms of the compound itself is preferably at least 13.

For the purpose of achieving the objects of the present invention, compounds which are decomposed during development are not preferred.

$Y_1$ in general formula (II) preferably represents an oxygen atom, a sulfur atom, =N—$R_{24}$ or

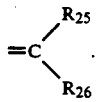

$R_{24}$, $R_{25}$ and $R_{26}$ each represents a hydrogen atom, an aliphatic group (e.g., methyl, isopropyl, t-butyl, vinyl, benzyl, octadecyl, cyclohexyl), an aromatic group (e.g., phenyl, pyridyl, naphthyl), a heterocyclic group (e.g., piperidyl, pyranyl, furanyl, chromanyl), an acyl group (e.g., acetyl, benzoyl) or a sulfonyl group (e.g., methanesulfonyl, benzenesulfonyl). $R_{25}$ and $R_{26}$ may be combined together to form a ring structure.

Among the compounds represented by formulae (I) and (II), the compounds represented by formula (I) are particularly preferred. Among the compounds represented by formula (I), the compounds represented by formula (I-a) or (I-c) are more preferred, and the compounds represented by formula (I-a) are particularly preferred.

The group Z in formula (III) is a nucleophilic group or a group which releases a nucleophilic group by decomposition in the photographic material. Examples of the group Z include nucleophilic groups where an atom chemically bonded directly to the oxidant of an aromatic amine developing agent is an oxygen atom, a sulfur atom or a nitrogen atom. Compounds having a function of Z include amine compounds, azide compounds, hydrazine compounds, mercapto compounds, sulfide compounds, sulfinic compounds, cyano compounds, thiocyano compounds, thiosulfuric acid compounds, seleno compounds, halide compounds, carboxy compounds, hydroxamic acid compounds, active methylene compounds, phenol compounds and nitrogen-containing heterocyclic compounds.

Among the compounds represented by formula (III), compounds represented by formula (III-a) are preferred.

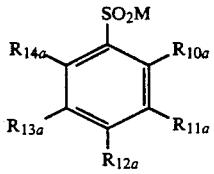

(III-a)

wherein M is an atom which forms an inorganic salt (e.g., Li, Na, K, Ca, Mg, etc.) or an organic salt (e.g., triethylamine, methylamine, ammonia, etc.), an atomic group which forms an inorganic or organic salt,

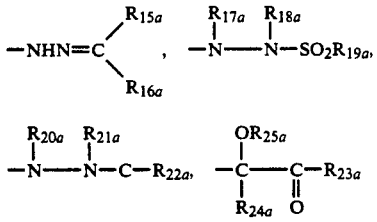

or a hydrogen atom.

$R_{15a}$ and $R_{16a}$, which may be the same or different, each represents a hydrogen atom, an aliphatic group, an aromatic group or a heterocyclic group, or $R_{15a}$ and $R_{16a}$ may be combined together to form a 5-membered to 7-membered ring; $R_{17a}$, $R_{18a}$, $R_{20a}$ and $R_{21a}$, which may be the same or different, each represents a hydrogen atom, an aliphatic group, an aromatic group, a heterocyclic group, an acyl group, an alkoxycarbonyl group, a sulfonyl group, a ureido group or a urethane group with the proviso that at least one of $R_{17a}$ and $R_{18a}$ and at least one of $R_{20a}$ and $R_{21a}$ are a hydrogen atom; and $R_{19a}$ and $R_{20a}$ are each a hydrogen atom, an aliphatic group, an aromatic group or a heterocyclic group. Furthermore, $R_{19a}$ is an alkylamino group, an arylamino group, an alkoxy group, an aryloxy group, an acyl group, an alkoxycarbonyl group or an aryloxycarbonyl group. At least two groups of $R_{17a}$, $R_{18a}$ and $R_{19a}$ may be combined together to form a 5-membered to 7-membered ring. At least two groups of $R_{20a}$, $R_{21a}$ and $R_{22a}$ may be combined together to form a 5-membered to 7-membered ring. $R_{23a}$ is a hydrogen atom, an aliphatic group, an aromatic group or a heterocyclic group; $R_{24a}$ is a hydrogen atom, an aliphatic group, an aromatic group, a halogen atom, an acyloxy group or a sulfonyl group; and $R_{25a}$ is a hydrogen atom or a hydrolyzable group.

$R_{10a}$, $R_{11a}$, $R_{12a}$, $R_{13a}$ and $R_{14a}$, which may be the same or different, each represents a hydrogen atom, an aliphatic group (e.g., methyl, isopropyl, t-butyl, vinyl, benzyl, octadecyl, cyclohexyl), an aromatic group (e.g., phenyl, pyridyl, naphthyl), a heterocyclic group (e.g., piperidyl, pyranyl, furanyl, chromanyl), a halogen atom (e.g., a chlorine atom, a bromine atom), $—SR_{26a}$, $—OR_{26a}$,

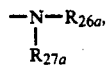

an acyl group (e.g., acetyl, benzoyl), an alkoxycarbonyl group (e.g., methoxycarbonyl, butoxycarbonyl, cyclohexylcarbonyl, octyloxycarbonyl), an aryloxycarbonyl group (e.g., phenyloxycarbonyl, naphthyloxycarbonyl), a sulfonyl group (e.g., methanesulfonyl, benzenesulfonyl), a sulfonamide group (e.g., methanesulfonamide, benzenesulfonamide), a sulfamoyl group, a ureido group, a urethane group, a carbamoyl group, a sulfo group, a carboxyl group, a nitro group, a cyano group, an alkoxyallyl group (e.g., methoxyallyl, isobutoxyallyl, octyloxyallyl, benzoyloxyallyl), an aryloxyallyl group (e.g., phenoxyallyl, naphthoxyallyl), a sulfonyloxy group (e.g., methanesulfonyloxy, benzenesulfonyloxy),

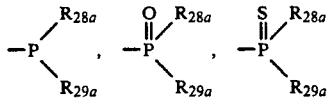

or a formyl group. $R_{26a}$ and $R_{27a}$, which may be the same or different, each represents a hydrogen atom, an aliphatic group, an aromatic group, an acyl group or a sulfonyl group; and $R_{28a}$ and $R_{29a}$, which may be the same or different, each represents a hydrogen atom, an aliphatic group, an aromatic group, an alkoxy group or an aryloxy group.

A total of Hammett's $\sigma$ values of the substituents of the benzene ring to $—SO_2M$ group of 5 or above is preferred for providing the effects of the present invention.

Typical examples of the compounds represented by formulae (I), (II) and (III) include, but are not limited to, the following compounds.

(Ia-1)

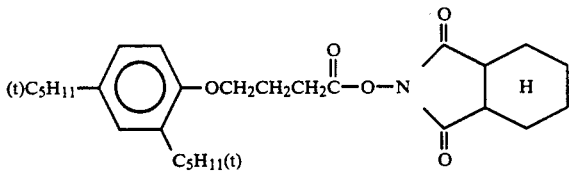

(Ia-2)

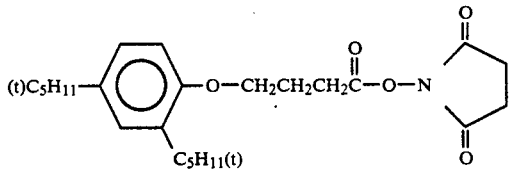

(Ia-3)

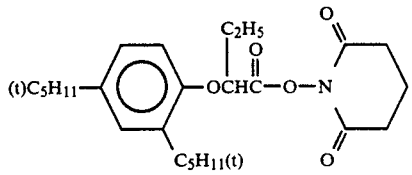

-continued
(Ia-4)
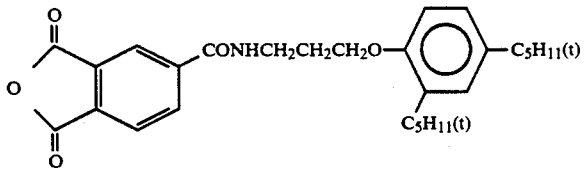
(Ia-5)
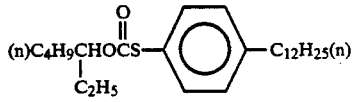
(Ia-6)
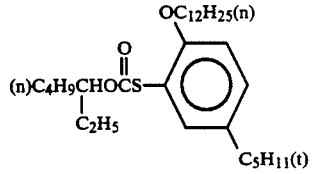
(Ia-7) $(n)C_{18}H_{31}I$
(Ia-8) $(n)C_{18}H_{37}Br$
(Ia-9)
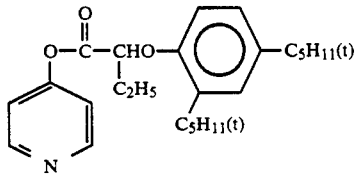
(Ia-10)
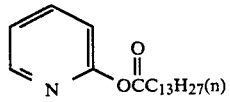
(Ia-11)
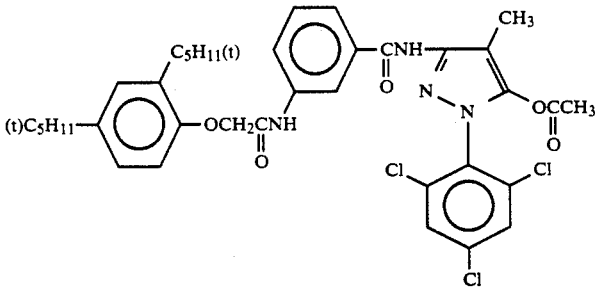
(Ia-12)
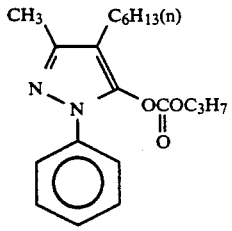
(Ia-13)
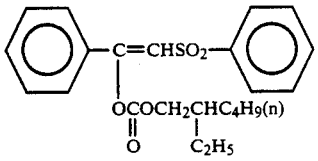

-continued
(Ia-14)
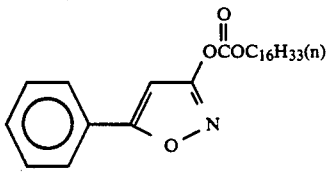
(Ia-15)
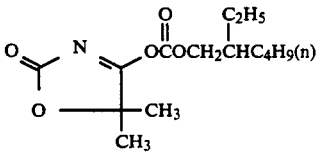
(Ia-16)
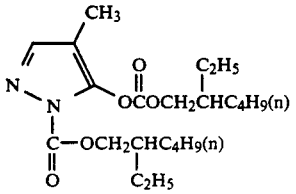
(Ia-17)
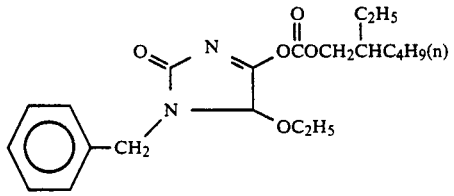
(Ia-18)
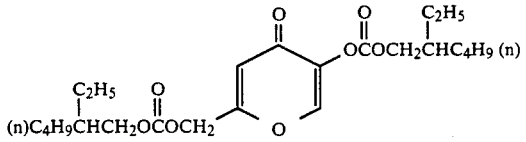
(Ia-19)
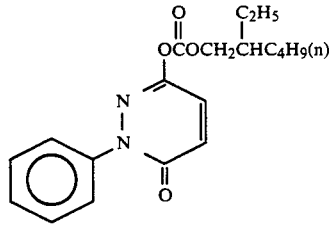
(Ia-20)
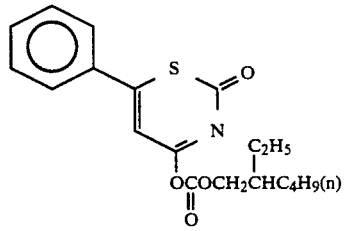
(Ia-21)
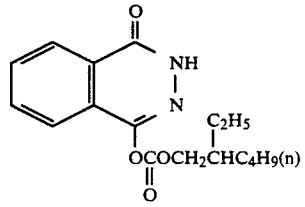

-continued
(Ia-22)
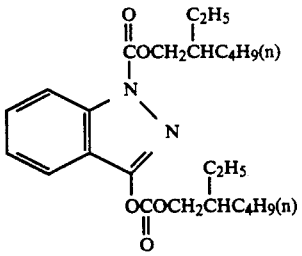
(Ia-23)
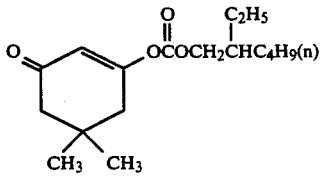
(Ia-24)
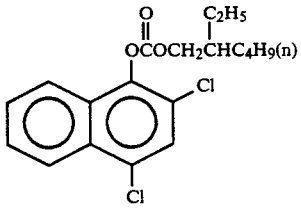
(Ia-25)
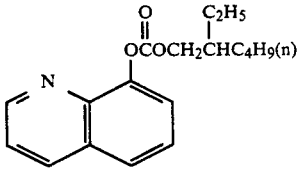
(Ia-26)
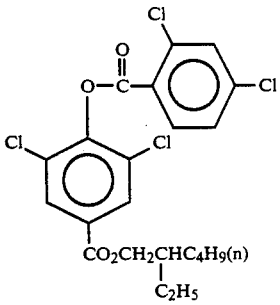
(Ia-27)
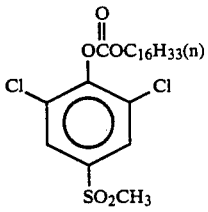
(Ia-28)
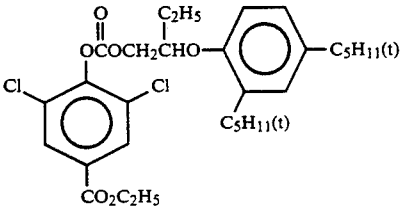

-continued
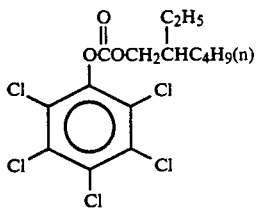
(Ia-29)
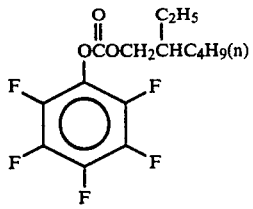
(Ia-30)
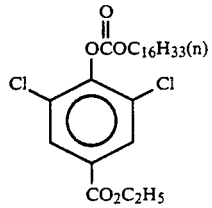
(Ia-31)
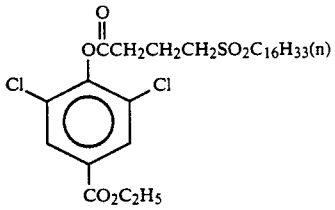
(Ia-32)
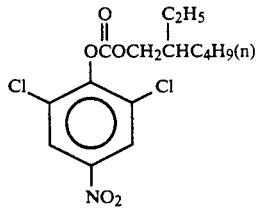
(Ia-33)
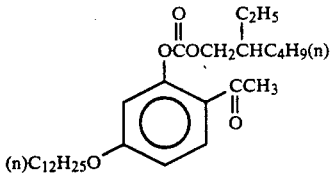
(Ia-34)
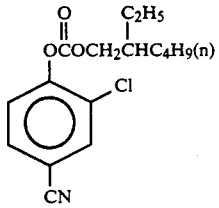
(Ia-35)

-continued
(Ia-36)
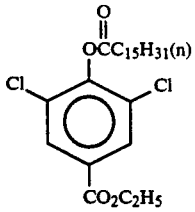
(Ia-37)
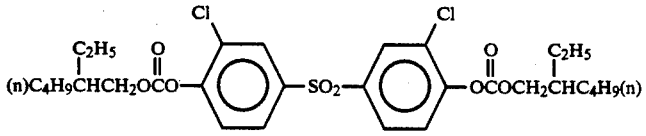
(Ia-38)
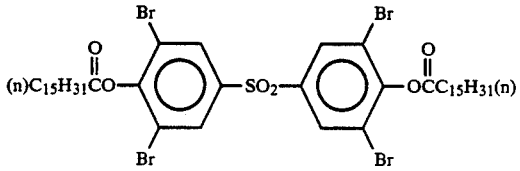
(Ia-39)
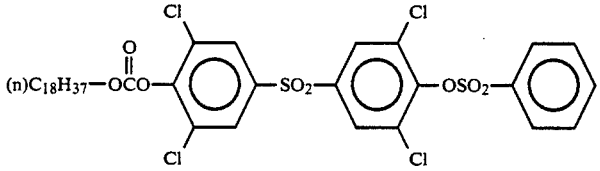
(Ia-40)
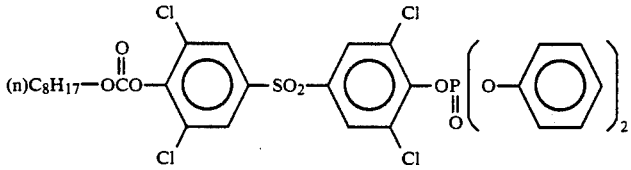
(Ia-41)
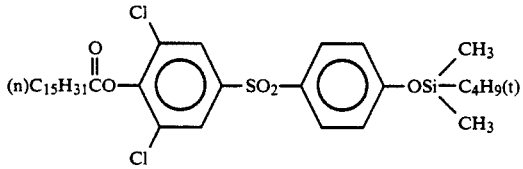
(Ia-42)
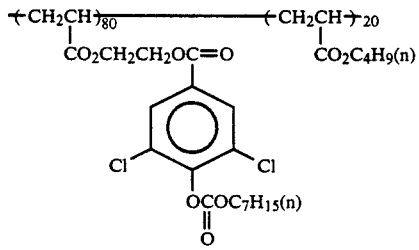
(Ia-43)
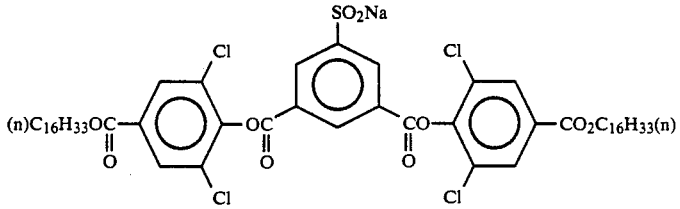

-continued
(Ia-44)
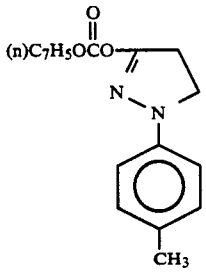
(Ia-45)
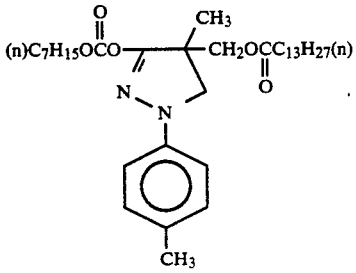
(Ia-46)
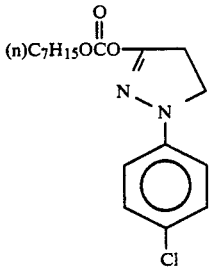
(Ia-47)
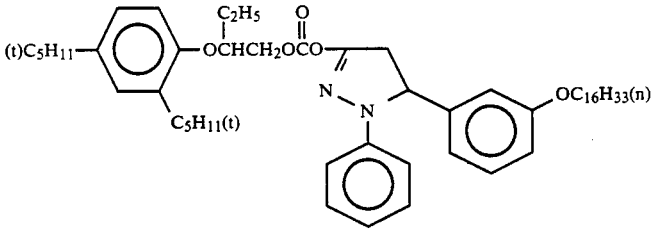
(Ia-48)
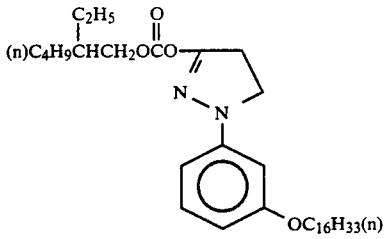
(Ia-49)
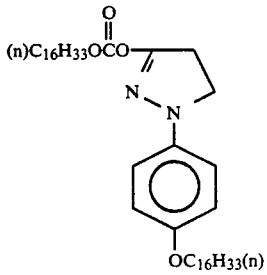

-continued
(Ia-50)
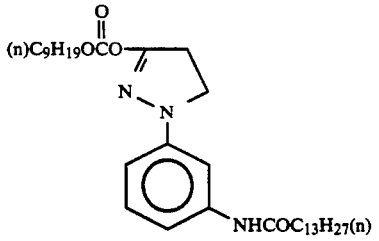
(Ia-51)
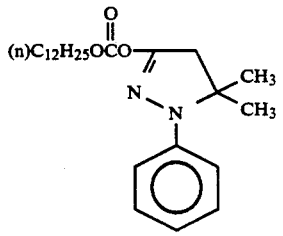
(IIa-1)
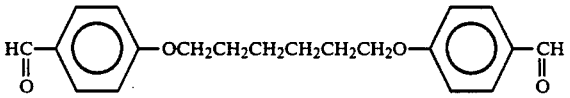
(IIa-2)
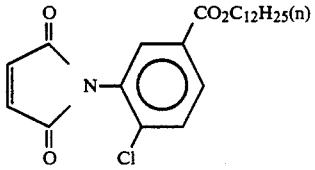
(IIa-3)
$CH_2{=}CH{-}SO_2{-}C_{18}H_{37}(n)$
(IIa-4)
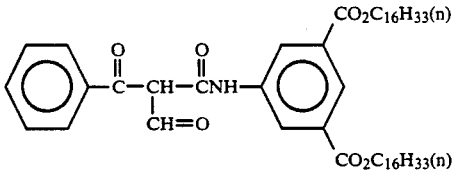
(IIa-5)
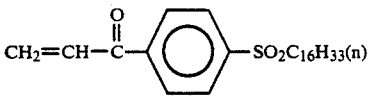
(IIIa-1)
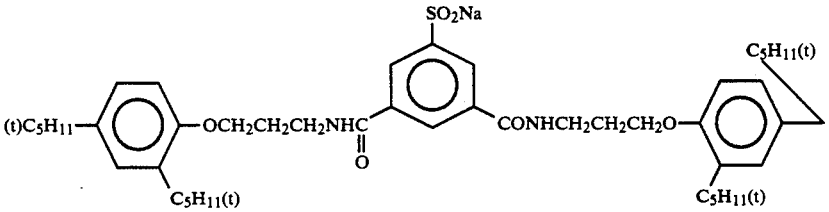
(IIIa-2)
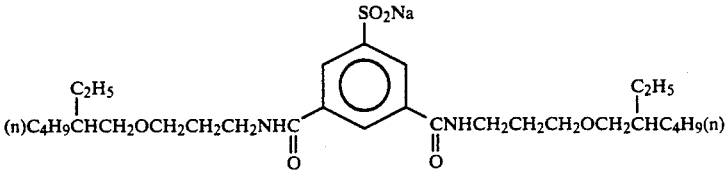

-continued
(IIIa-3)
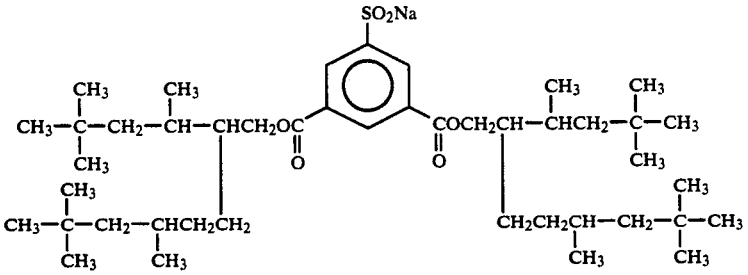
(IIIa-4)
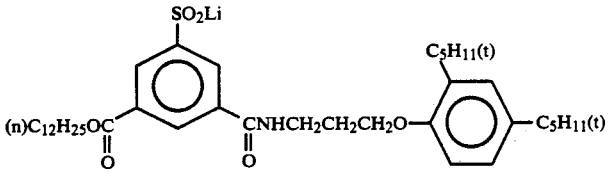
(IIIa-5)
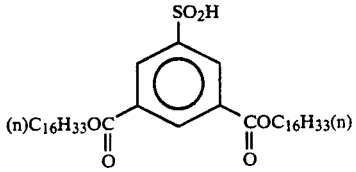
(IIIa-6)
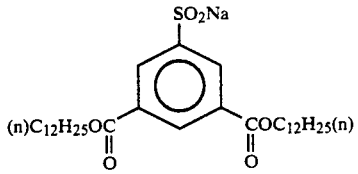
(IIIa-7)
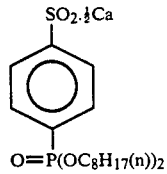
(IIIa-8)
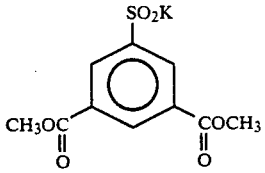
(IIIa-9)
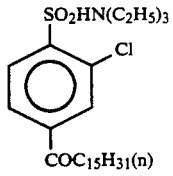
(IIIa-10)
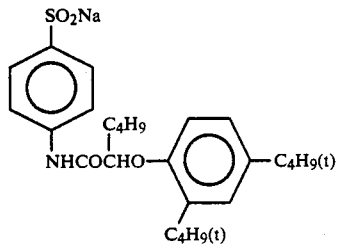

-continued
(IIIa-11)
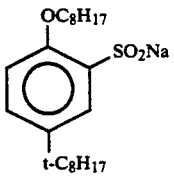
(IIIa-12)
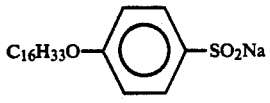
(IIIa-13)
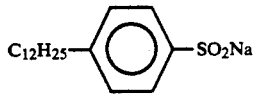
(IIIa-14)
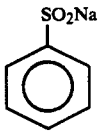
(IIIa-15)
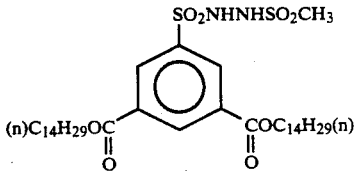
(IIIa-16)
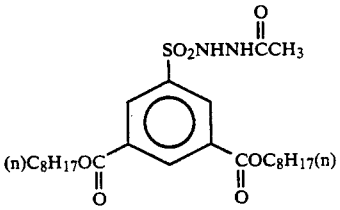
(IIIa-17)
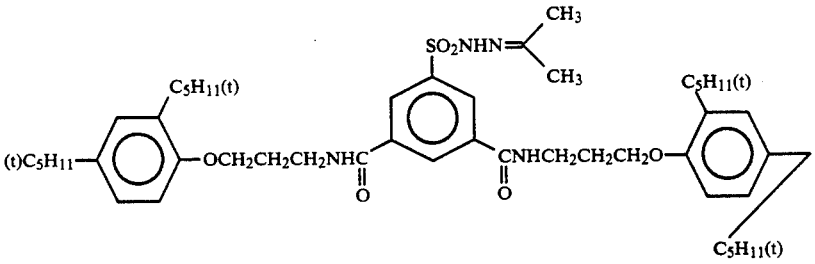
(IIIa-18)
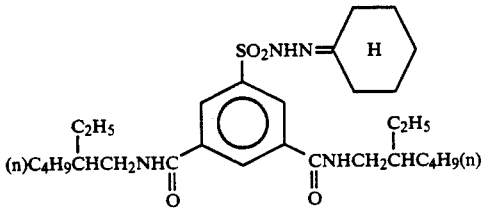
(IIIa-19)
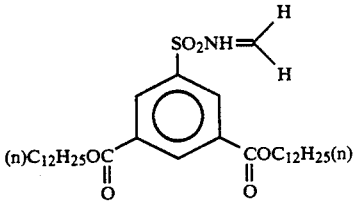

-continued
(IIIa-20)
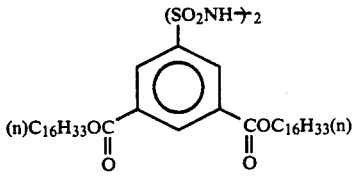
(IIIa-21)
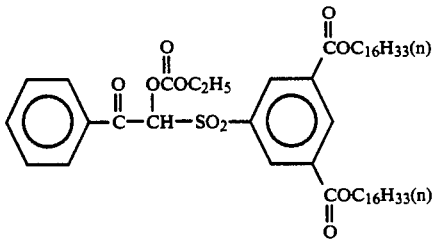
(IIIa-22)
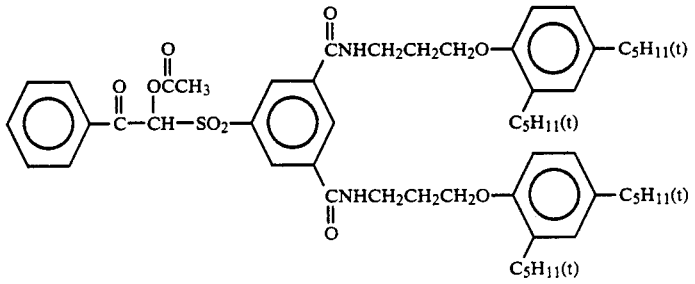
(IIIa-23)
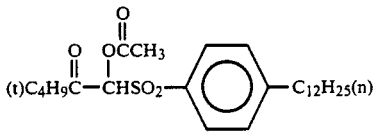
(IIIa-24)
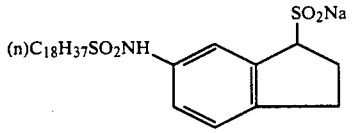
(IIIa-25)
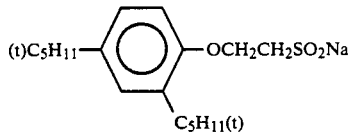
(IIIa-26)
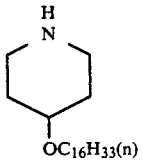
(IIIa-27)
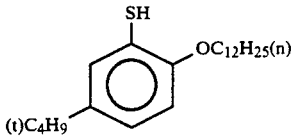
(IIIa-28)
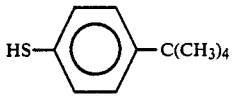

-continued
(IIIa-29)
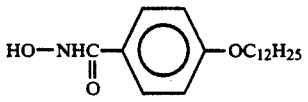
$NaN_3$ (IIIa-30)
(IIIa-31)
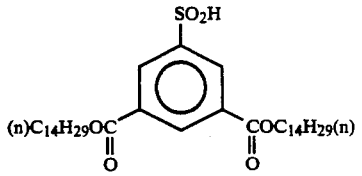
(IIIa-32)
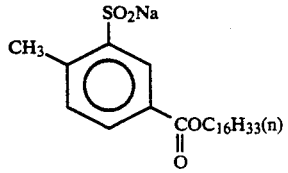
(IIIa-33)
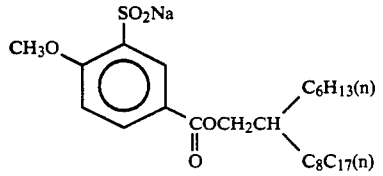
(IIIa-34)
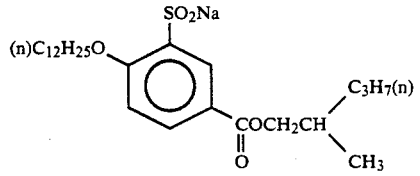
(IIIa-35)
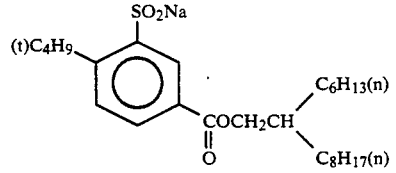
(IIIa-36)
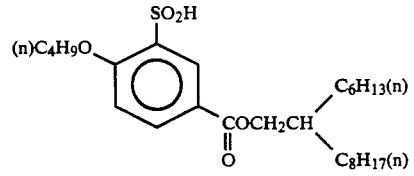
(IIIa-37)
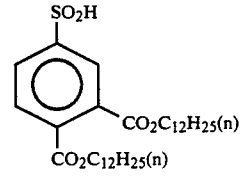
(IIIa-38)
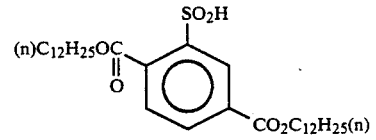

-continued

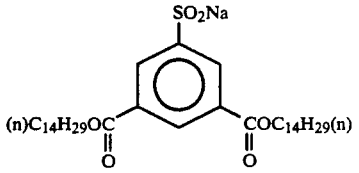

(IIIa-39)

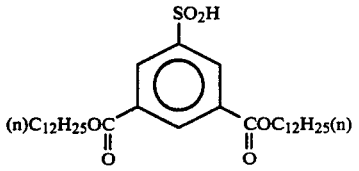

(IIIa-40)

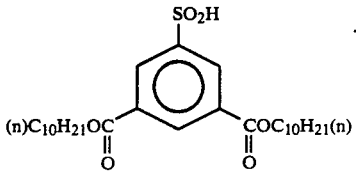

(IIIa-41)

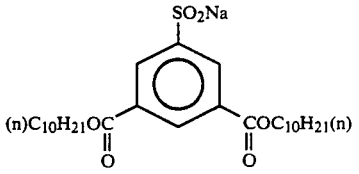

(IIIa-42)

The compounds represented by formulae (I), (II) and (III) can be synthesized according to the methods described in JP-A-62-143048, JP-A-63-115855, JP-A-63-115866, JP-A-63-158545 and European Patent Laid Open No. 255722.

Preferred examples of the compounds of the present invention include those exemplified in the above described patent publications and the specifications of JP-A-62-2833385 and JP-A-62-229145.

Among the compounds represented by formulae (I), (II) and (III), those compounds which have a low molecular weight and are easily soluble in water may be added to a processing solution and incorporated into the photographic material during the development stage. It is preferred that the compounds represented by formulae (I), (II) and (III) are added to hydrophilic colloid layers at a stage during the preparation of the photographic material. It is more preferred that the compounds represented by formulae (I), (II) and (III) are added to a layer containing a magenta coupler at a stage during the preparation of the photographic material.

The compounds represented by formulae (I), (II) and (III}, which are soluble in high boiling organic solvents, are preferred. The compounds are each contained in the photographic material in an amount of from $1\times10^{-2}$ to 10 mol, preferably from $3\times10^{-2}$ to 5 mol, per mol of magenta coupler. Preferably, the compounds represented by formulae (I), (II) and (III) are coemulsified together with magenta couplers. More particularly, the compound represented by formula (I) or formula (II) and the compound represented by formula (III) are contained in oil droplets containing a magenta coupler.

The term "optical reflection density" of the photographic material as used herein refers to a density measured by a reflection densitometer which is conventionally used by those skilled in the art. The optical reflection density is defined by the following formula. A standard reflecting plate is provided on the back side of the sample during the measurement to prevent errors in measurement caused by light transmitted through the sample.

$$\text{Optical reflection density} = \log_{10}(F_0/F)$$

$F_0$: Reflected light flux of standard white plate

F: Reflected light flux of sample

The optical reflection density of the support of the present invention is at least 0.70, but not greater than 2.0, more preferably at least 0.8, but not greater than 1.9, and most preferably at least 1.0, but not greater than 1.8, at a measuring wavelength of 680 nm. The ratio of the optical reflection density at 550 nm to that at 680 nm is preferably at least 0.2, but not greater than 1, more preferably not greater than 0.8, still more preferably not greater than 0.6, and most preferably not greater than 0.5. The optical reflection density at 470 nm is preferably at least 0.2, but not greater than 1.5, more preferably at least 0.3.

The desired optical reflection density of the present invention can be obtained by adjusting the constituent amounts described below contained in the photographic material of the present invention. These dyes may be used either alone or in a combination of two or more. There is no particular limitation with regard to the layers to which the dyes are added. For example, the dyes may be added to a layer between the lowermost light-sensitive layer and the support, to the light-sensitive layers, interlayers, protective layers, or a layer between the protective layer and the uppermost light-sensitive layer.

For this purpose, dyes are selected from among dyes which exhibit substantially no spectral sensitization activity on silver halide.

These dyes can be added to the photographic material by conventional methods, for example, by dissolving the dyes in water or an alcohol such as methanol.

The dyes are used in the following amounts in terms of coating weight.

Cyan dyes:

20 to 100 mg/m$^2$ (most preferred amount)

Magenta dyes:

0 to 50 mg/m$^2$ (preferred amount)

0 to 10 mg/m$^2$ (most preferred amount)

Yellow dyes:

0 to 30 mg/m$^2$ (preferred amount)

5 to 20 mg/m$^2$ (most preferred amount)

A method using, as the dye to be added to the photographic material, a diffusing dye which diffuses in all layers during the period of from coating to drying is preferred in comparison with a method using a non-diffusing dye which is fixed to a specific layer. The former provides pronounced effects and is also preferred from the viewpoint of manufacturing cost in that a specific layer for the dyes is not required.

Examples of such dyes include oxonol dyes having a pyrazolone nucleus or a barbituric acid nucleus as described in British Patents 506,385, 1,177,429, 1,311,884, 1,338,799, 1,385,371, 1,467,214, 1,433,102 and 1,553,516, JP-A-48-85130, JP-A-49-114420, JP-A-52-117123, JP-A-55-161233, JP-A-59-11640, JP-B-39-22069, JP-B-43-13168, JP-B-62-273527, and U.S. Pat. Nos. 3,247,127, 3,469,985 and 4,078,933; other oxonol dyes described in U.S. Pat. Nos. 2,533,472 and 3,379,533, and British Patents 1,278,621; azo dyes described in British Patents 575,691, 680,631, 599,623, 786,907, 907,125 and 1,045,609, U.S. Pat. No. 4,255,326, and JP-A-59-211043; azomethine dyes described in JP-A-50-100116, JP-A-54-118247, and British Patents 2,014,598 and 750,031; anthraquinone dyes described in U.S. Pat. No. 2,865,752; allylidene dyes described in U.S. Pat. Nos. 2,538,009, 2,688,541 and 2,538,008, British Patents 584,609 and 1,210,252, JP-A-50-40625, JP-A-51-3623, JP-A-51-10927, JP-A-54-118247, JP-B-48-3286, and JP-B-59-37303; styryl dyes described in JP-B-28-3082, JP-B-44-16594 and JP-B-59-28898; triarylmethane dyes described in British Patents 446,581 and 1,335,422, and JP-A-59-228250; merocyanine dyes described in British Patents 1,075,653, 1,153,341, 1,284,730, 1,475,228 and 1,542,807; and cyanine dyes described in U.S. Pat. Nos. 2,843,486 and 3,294,539.

Of the above described dyes, those dyes represented by the following formulae (III'), (IV), (V), (VI), (VII) and (VIII) are preferred.

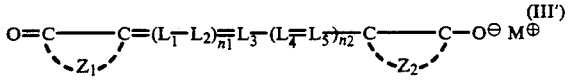

(III')

wherein $Z_1$ and $Z_2$, which may be the same or different, each represents a nonmetallic atomic group required for forming a hetero ring; $L_1$, $L_2$, $L_3$, $L_4$ and $L_5$ each represents a methine group; $n_1$ and $n_2$ each represents 0 or 1; and $M\oplus$ represents hydrogen or another monovalent cation.

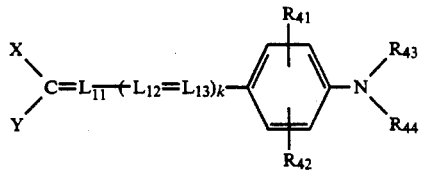

(IV)

wherein X and Y, which may be the same or different, each represents an electron attracting group and X and Y may be combined together to form a ring $R_{41}$ and $R_{42}$, which may be the same or different, each represents a hydrogen atom, a halogen atom, an alkyl group, an alkoxy group, a hydroxyl group, a carboxyl group, a substituted amino group, a carbamoyl group, a sulfamoyl group, an alkoxycarbonyl group, or a sulfo group; $R_{43}$ and $R_{44}$, which may be the same or different, each represents a hydrogen atom, an alkyl group, an alkenyl group, an aryl group, an acyl group or a sulfonyl group, or R and $R_{44}$ may be combined together to form a 5- or 6-membered ring; $R_{41}$ and $R_{43}$, or $R_{42}$ and $R_{44}$ may be combined together to form a 5- or 6-membered ring; at least one of X, Y $R_{41}$, $R_{42}$, $R_{43}$ and $R_{44}$ is a group having a sulfo group or a carboxyl group as a substituent group; $L_{11}$, $L_{12}$ and $L_{13}$ each represents a methine group; and k represents 0 or 1.

$$Ar_1—N=N—Ar_2 \quad (V)$$

wherein $Ar_1$ and $Ar_2$, which may be the same or different, each represents an aryl group or a heterocyclic group.

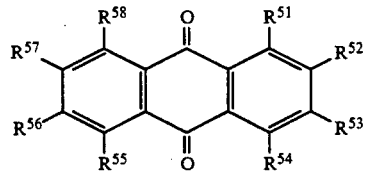

(VI)

wherein $R^{51}$, $R^{54}$, $R^{55}$ and $R^{58}$, which may be the same or different, each represents a hydrogen atom, a hydroxyl group, an alkoxy group, an aryloxy group, a carbamoyl group, or an amino group

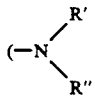

wherein R' and R'', which may be the same or different, each represents a hydrogen atom, an alkyl group having at least one sulfo group or carboxyl group or an aryl group having at least one sulfo group or carboxyl group); and $R^{52}$, $R^{53}$, and $R^{57}$, which may be the same or different, each represents a hydrogen atom, a sulfo group, a carboxyl group, an alkyl group having at least one sulfo group or carboxyl group or an aryl group having at least one sulfo group or carboxyl group.

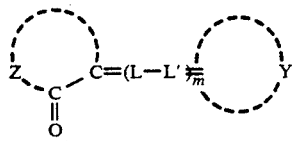

(VII)

wherein L and L' each represents a substituted or unsubstituted methine group, or a nitrogen atom; m represents 0, 1, 2 or 3; Z represents a nonmetallic atomic group for forming a pyrazolone nucleus, a hydroxypyridone nucleus, a barbituric acid nucleus, a thiobarbituric acid nucleus, a dimedone nucleus, an indane-1,3-dione nucleus, a rhodanine nucleus, a thiohydantoin nucleus, an oxazolidine-4-one-2-thione nucleus, a homophthalimide nucleus, a pyrimidine-2,4-dione nucleus, or a 1,2,3,4-tetrahydroquinoline-2,4-dione nucleus; Y represents a nonmetallic atomic group for forming an oxazole nucleus, a benzoxazole nucleus, a naphthoxazole nucleus, a thiazole nucleus, a benzothiazole nucleus, a naphthothiazole nucleus, a benzoselenazole nucleus, a pyridine nucleus, a quinoline nucleus, a benzimidazole nucleus, a naphthoimidazole nucleus, an imidazoquinoxaline nucleus, an indolenine nucleus, an isoxazole nucleus, a benzisoxazole nucleus, a naphthoisoxazole nucleus, or an acrizine nucleus; and Z and Y may be substituted.

(VIII-A)

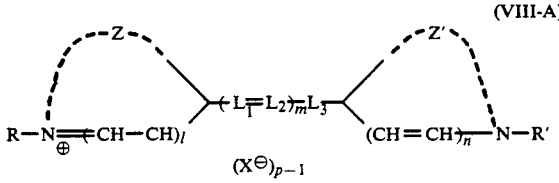

or (VIII-B)

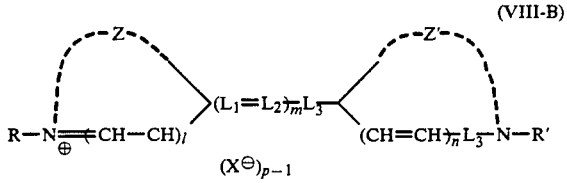

wherein R and R', which may be the same or different, each represents a substituted or unsubstituted alkyl group; $L_1$, $L_2$ and $L_3$, which may be the same or different, each represents a substituted or unsubstituted methine group; m represents 0, 1, 2 or 3; Z and Z', which may be the same or different, each represents a nonmetallic atomic group required for forming a substituted or unsubstituted 5- or 6-membered hetero ring; l and n each represents 0 or 1; $X^{\ominus}$ represents an anion; p represents 1 or 2, but p is 1 when the compound forms an inner salt.

Each dye is illustrated in greater detail below.

In formula (III'), the heterocyclic ring formed by a nonmetallic atomic group represented by $Z_1$ and $Z_2$ is preferably a 5-membered or 6-membered ring which may be a monocyclic ring or a condensed ring. Examples of the heterocyclic rings include 5-pyrazolone, 6-hydroxypyridone, pyrazolo[3,4-b]pyridine-3,6-dione, barbituric acid, pyrazolidinedione, thiobarbituric acid, rhodanine, imidazopyridine, pyrazolopyrimidine, pyrrolidone, and pyrazoloimidazole.

The methine group represented by $L_1$, $L_2$, $L_3$, $L_4$ and $L_5$ may have one or more substituent groups (e.g., methyl, ethyl, phenyl, chlorine, sulfoethyl, carboxyethyl, dimethylamino, cyano), and the substituent groups may be combined together to form a 5- or 6-membered ring (e.g., cyclohexene, cyclopentene, 5,5-dimethylcyclohexene).

Examples of the monovalent cation represented by $M^{\oplus}$ other than hydrogen include $Na^{\oplus}$, $K^{\oplus}$, $HN^{\oplus}(C_2H_5)_3$,

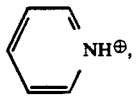

Li, etc.

Of the dyes represented by formula (III'), those represented by the following formulae (III'-a), (III'-b), (III'-c), (III'-d) and (III'-e) are preferred.

(III'-a)

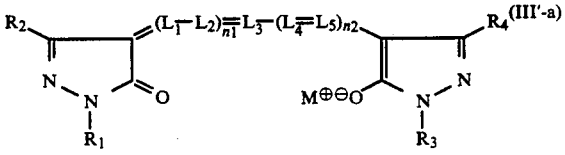

wherein $R_1$ and $R_3$ each represents an aliphatic group, an aromatic group or a heterocyclic group; $R_2$ and $R_4$ each represents an aliphatic group, an aromatic group, $-OR^5$, $-COOR^5$, $-NR^5R_6$, $-CONR_5R_6$, $-NR_5CONR_5R_6$, $-SO_2R_7$, $-COR_7$, $-NR_6COR_7$, $-NR_6SO_2R_7$, or a cyano group (wherein $R_5$ and $R_6$ each represents a hydrogen atom, an aliphatic group or an aromatic group; $R_7$ represents an aliphatic group or an aromatic group; and $R_5$ and $R_6$, or $R_6$ and $R_7$ may be combined together to form a 5-membered or 6-membered ring); and $L_1$, $L_2$, $L_3$, $L_4$, $L_5$, $n_1$, $n_2$ and $M^{\oplus}$ have the same meaning as in formula (III').

(III'-b)

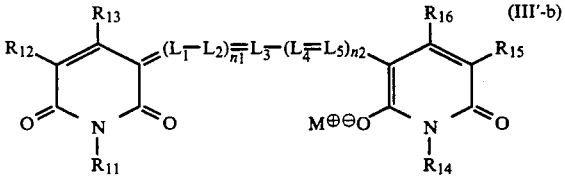

wherein $R_{11}$ and $R_{14}$ each represents a hydrogen atom, an aliphatic group, an aromatic group, a heterocyclic group, $-NR_{17}R_{18}$, $-NR_{17}CONR_{17}R_{18}$, $-NR_{18}COR_{19}$, or $-NR_{18}SO_2R_{19}$; $R_{12}$ and $R_{15}$ each represents a hydrogen atom, an aliphatic group, an aromatic group, a heterocyclic group, a cyano group, a sulfo group, $-NR_{17}R_{18}$, $-NR_{18}COR_{19}$, $-NR_{18}SO_2R_{19}$, $-NR_{17}CONR_{17}R_{18}$, $-COOR_{17}$, $-CONR_{17}R_{18}$, $-COR_{19}$, $-SO_2R_{19}$ or $-SO_2NR_{17}R_{18}$; $R_{13}$ and $R_{16}$ each represents a hydrogen atom, an aliphatic group, an aromatic group, a heterocyclic group, $-OR_{17}$, $-COOR_{17}$, $-COR_{19}$, $-CONR_{17}R_{18}$, $-NR_{17}R_{18}$, $-NR_{18}COR_{19}$, $-NR_{18}SO_2R_{19}$, $-NR_{17}CONR_{17}R_{18}$, $-SO_2R_{19}$, $-SO_2NR_{17}R_{18}$, $-OR_7$, or a cyano group (wherein $R_{17}$ and $R_{18}$ each represents a hydrogen atom, an aliphatic group, or an aromatic group; $R_{19}$ represents an aliphatic group or an aromatic group; and $R_{17}$ and $R_{18}$, or $R_{18}$ and $R_{19}$ may be combined together to form a 5-membered or 6-membered ring); and $L_1$, $L_2$, $L_3$, $L_4$, $L_5$, $n_1$, $n_2$ and $M^{\oplus}$ have the same meaning as in formula (III').

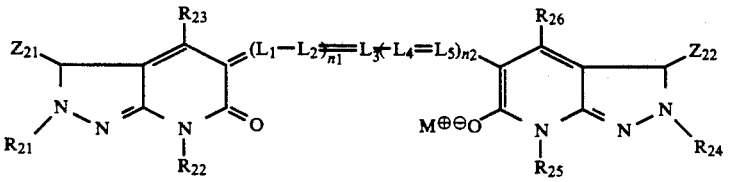

(III'-c)

wherein $R_{21}$ and $R_{24}$ each represents an aliphatic group, an aromatic group or a heterocyclic group; $R_{22}$ and $R_{25}$ each represents a hydrogen atom, an aliphatic group, an aromatic group, a heterocyclic group, $—COR_{29}$, or $—SO_2R_{29}$; $R_{23}$ and $R_{26}$ each represents a hydrogen atom, a cyano group, an alkyl group, an aryl group, $—COOR_{27}$, $—OR_{27}$, $—NR_{27}R_{28}$, $—N(R_{28})COR_{29}$, $—N(R_{28})SO_2R_{29}$, $—CONR_{27}R_{28}$ or $—N(R_{27})CONR_{27}R_{28}$ (where $R_{29}$ represents an aliphatic group or aromatic group; and $R_{27}$ and $R_{28}$ each represents a hydrogen atom, an aliphatic group or an aromatic group); $Z_{21}$ represents an oxygen atom or $—NR_{30}$, $Z_{22}$ represents an oxygen atom, or $—NR_{31}$ (where $R_{30}$ and $R_{31}$ each represents a nonmetallic atomic group for forming a 5-membered ring when combined together with $R_{21}$ and $R_{24}$, respectively); $L_1$, $L_2$, $L_3$, $L_4$, $L_5$, $n_1$, $n_2$ and $M\oplus$ have the same meaning as in formula (III'); and at least one of $R_{21}$, $R_{22}$, $R_{23}$, $R_{24}$, $R_{25}$, $R_{26}$, $L_1$, $L_2$, $L_3$, $L_4$ and $L_5$ is a group having at least one carboxyl group or sulfo group.

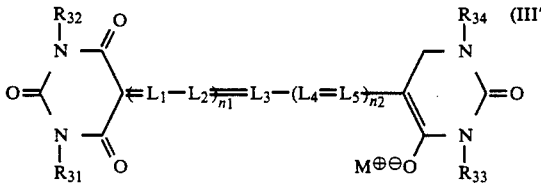

(III'-d)

wherein $R_{31}$, $R_{32}$, $R_{33}$ and $R_{34}$ each represents a hydrogen atom, an aliphatic group, an aromatic group, or a heterocyclic group; and $L_1$, $L_2$, $L_3$, $L_4$, $L_5$, $n_1$, $n_2$ and $M\oplus$ have the same meaning as in formula (III').

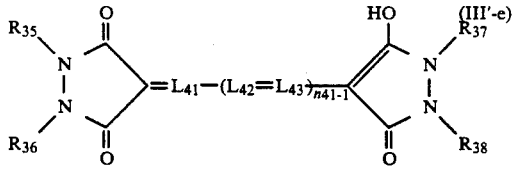

(III'-e)

In the above formula, $R_{35}$, $R_{36}$, $R_{37}$ and $R_{38}$ each represents an aliphatic group, an aromatic group or a heterocyclic group; $L_{41}$, $L_{42}$ and $L_{43}$ each represents a methine group; $n_{41}$ represents 1, 2 or 3; and at least one of $R_{35}$, $R_{36}$, $R_{37}$ and $R_{38}$ is a group having a carboxyl group or a sulfo group, and the total number of carboxyl groups and/or sulfo groups is at least 2.

The groups of formula (III'-a) are illustrated in further detail below. In reference to the Table below, the aliphatic groups represented by $R_1$, $R_2$, $R_3$, $R_4$, $R_5$, $R_6$ and $R_7$ include a straight chain, branched or cyclic alkyl, aralkyl, or alkenyl group. Examples thereof include methyl, ethyl, n-butyl, benzyl, 2-sulfoethyl, 4-sulfobutyl, 2-sulfobenzyl, 2-carboxyethyl, carboxymethyl, trifluoromethyl, dimethylaminoethyl, and 2-hydroxyethyl.

Examples of the aromatic group represented by $R_1$, $R_2$, $R_3$, $R_4$, $R_5$, $R_6$ and $R_7$ include phenyl, naphthyl, 4-sulfophenyl, 3-sulfophenyl, 2,5-disulfophenyl, 4-carboxyphenyl, and 5,7-disulfo-3-naphthyl.

Among them, there are preferred compounds where $R_1$ and $R_2$ are each a phenyl group having 2 or more sulfo groups when $n_1$ is 1 or 2, and $n_2$ is 0.

The heterocyclic group represented by $R_1$ and $R_3$ is a 5-membered or 6-membered nitrogen-containing heterocyclic group (including a condensed ring). Examples thereof include 5-sulfopyridine-2-yl and 5-sulfobenzothiazole-2-yl.

Examples of the 5-membered or 6-membered ring formed by $R_5$ and $R_6$ or $R_6$ and $R_7$ when combined together include a pyrrolidine ring, a piperidine ring, a pyrrolidone ring, and a morpholine ring.

Examples of the dyes represented by formula (III'-a) include, but are not limited to, the following compounds.

| No. | $R_1$, $R_3$ | $R_2$, $R_4$ | $=(L_1—L_2)_{n1}=L_3—(L_4=L_5)_{n2}$ | $M\oplus$ |
|---|---|---|---|---|
| a-1 | 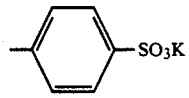 | $—CH_3$ | $=CH—$ | H |
| a-2 | 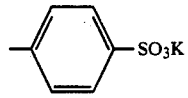 | $—CONHC_3H_7(n)$ | $=CH—$ | H |

-continued

| No. | $R_1$, $R_3$ | $R_2$, $R_4$ | $=(L_1-L_2)_{n1}=L_3-(L_4=L_5)_{n2}$ | $M^{\oplus}$ |
|---|---|---|---|---|
| a-3 | 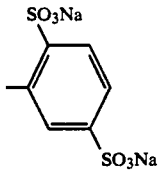 | $-OH$ | $=CH-CH=CH-$ | Na |
| a-4 | 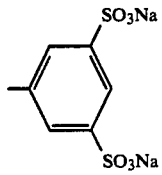 | $-OC_2H_5$ | $=CH-(CH=CH)_2-$ | Na |
| a-5 | $-CH_2CH_2SO_3K$ | $-COOC_2H_5$ | $=CH-CH=CH-$ | H |
| a-6 | 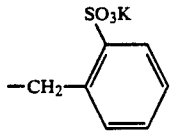 | $-CONHC_4H_9(n)$ | $=CH-CH=CH-$ | H |
| a-7 | $-CH_2CH_2SO_3K$ | $-COOK$ | $=CH-(CH=CH)_2-$ | H |
| a-8 | 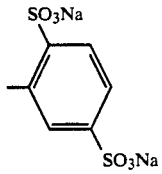 | $-COCH_3$ | $=CH-(CH=CH)_2-$ | Na |
| a-9 | 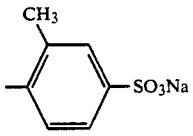 | $-CF_3$ | $=(CH-(CH=CH)_2-$ | H |
| a-10 | 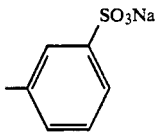 | $-NHCOCH_3$ | $=CH-CH=CH-$ | H |
| a-11 | 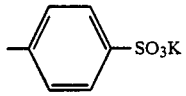 | $-COOC_2H_5$ | $=CH-(CH=CH)_2-$ | H |
| a-12 | 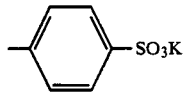 | $-COOK$ | $=CH-CH=CH-$ | H |
| a-13 | 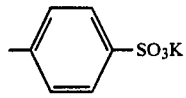 | $-NHCONHCH_3$ | $=CH-CH=CH-$ | H |
| a-14 | $-(CH_2)_4SO_3K$ | $-OH$ | $=CH-$ | H |
| a-15 | 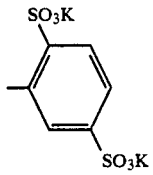 | $-COOK$ | $=CH-CH=CH-$ | K |

-continued

| No. | $R_1$, $R_3$ | $R_2$, $R_4$ | $=(L_1-L_2)_{n1}=L_3-(L_4=L_5)_{n2}$ | $M^{\oplus}$ |
|---|---|---|---|---|
| a-16 | 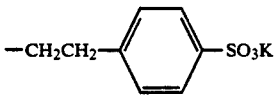 | $-C_6H_5$ | $=CH-CH=CH-$ | H |
| a-17 | 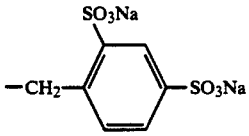 | $-COOC_2H_5$ | $=CH-(CH=CH)_2$ | Na |
| a-18 | 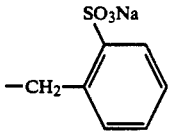 | $-CONHCH_2CH_2OH$ | $=CH-(CH=CH)_2$ | H |
| a-19 | 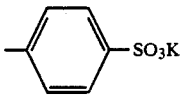 | $-CONHCH_2CH_2SO_2K$ | $=CH-(CH=CH)_2$ | H |
| a-20 | $-(CH_2)_3SO_3K$ | $-CONHC_7H_{15}(n)$ | $=CH-CH=CH-$ | H |
| a-21 | $-CH_2COOK$ | $-COOK$ | $=CH-CH=CH-$ | K |
| a-22 | $-CH_2CH_2SO_3K$ | $-N(CH_3)_2$ | $=CH-(CH=CH)_2$ | H |
| a-23 | $-(CH_2)_3SO_3K$ | $-CN$ | $=CH-(CH=CH)_2$ | H |
| a-24 | 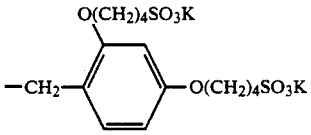 | $-CH_2Cl$ | $=CH-(CH=CH)_2$ | H |
| a-25 | $-(CH_2)_2SO_3Na$ | $-OH$ | $=CH-(CH=CH)_2$ | H |
| a-26 | 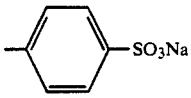 | $-CH_3$ | $=CH-\overset{CH_3}{\overset{\vert}{C}}=CH-$ | Na |
| a-27 | 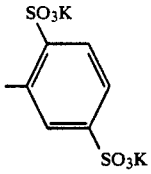 | $-COOC_2H_5$ | $=CH-(CH=CH)_2$ | H |
| a-28 | 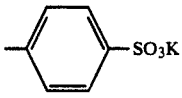 | $-CONHC_2H_5$ | $=CH-CH=CH-$ | H |
| a-29 | 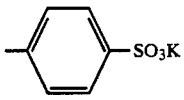 | $-NHCOC_3H_7(i)$ | $=CH-CH=CH-$ | H |
| a-30 | $-CH_2CH_2SO_3K$ | 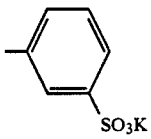 | $=CH-CH=CH-$ | H |

-continued
| No. | $R_1$, $R_3$ | $R_2$, $R_4$ | $=(L_1-L_2)_{n1}=L_3-(L_4=L_5)_{n2}$ | $M^{\oplus}$ |
|---|---|---|---|---|
| a-31 | 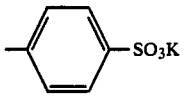 | $-CH_3$ | $=C(CH_3)-CH=CH-$ | H |
| a-32 | 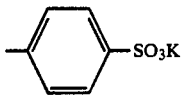 | $-C_4H_9(t)$ | $=CH-CH=CH-$ | H |
| a-33 | 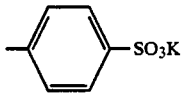 | $-CN$ | $=CH-(CH=CH)_2$ | H |
| a-34 | 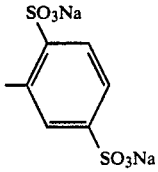 | $-COCH_3$ | $=CH-CH=C(CH_3)-CH=CH-$ | Na |
| a-35 | 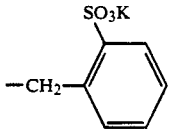 | $-COOK$ | $=CH-(CH=CH)_2$ | H |
| a-36 | 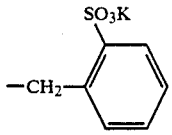 | $-COOK$ | $=CH-CH=CH-$ | H |
| a-37 | 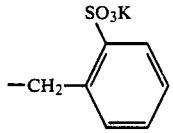 | $-CONHC_4H_9(i)$ | $=CH(CH=CH)_2$ | H |
| a-38 | 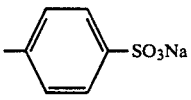 | $-NHSO_2CH_3$ | $=CH(CH=CH)_2$ | H |
| a-39 | 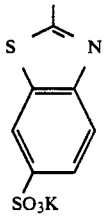 | $-CN$ | $=CH(CH=CH)_2$ | H |
| a-40 | 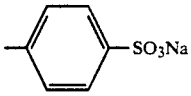 | $-OC_2H_5$ | $=CH(CH=CH)_2$ | H |

-continued

| No. | $R_1$, $R_3$ | $R_2$, $R_4$ | $=(L_1-L_2)_{n1}=L_3-(L_4=L_5)_{n2}$ | $M^{\oplus}$ |
|---|---|---|---|---|
| a-41 | 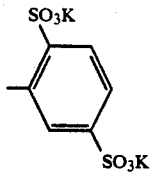 | —CN | $=CH(CH=CH)_2$ | H |

The dyes represented by formula (III'-a) can be synthesized according to the methods disclosed in British Patents 506,385, 1,177,429, 1,338,799, 1,385,371, 1,467,214, 1,433,102 and 1,553,516, JP-A-48-85130, JP-A-55-161233, JP-A-52-20330, JP-A-59-111640, and JP-A-62-273527.

The dyes represented by formula (III'-b) are illustrated in greater detail below.

Specific examples of the aliphatic group represented by $R_{11}$, $R_{12}$, $R_{13}$, $R_{14}$, $R_{15}$, $R_{16}$, $R_{17}$, $R_{18}$ or $R_{19}$ include methyl, ethyl, isopropyl, 2-chloroethyl, trifluoromethyl, benzyl, 2-sulfobenzyl, 4-sulfophenethyl, carboxymethyl, 2-carboxyethyl, 2-sulfoethyl, 2-hydroxyethyl, dimethylaminoethyl, and cyclopentyl.

Specific examples of the aromatic group represented by $R_{11}$, $R_{12}$, $R_{13}$, $R_{14}$, $R_{15}$, $R_{16}$, $R_{17}$, $R_{18}$ or $R_{19}$ include phenyl, naphthyl, 3-sulfophenyl, 4-sulfophenyl, 2,5-disulfophenyl, 4-(3-sulfopropyloxy)phenyl, 3-carboxyphenyl, and 2-carboxyphenyl.

Specific examples of the heterocyclic group represented by $R_{11}$, $R_{12}$, $R_{13}$, $R_{14}$, $R_{15}$ or $R_{16}$ include 2-pyridyl, morpholino, and 5-sulfobenzimidazole-2-yl.

Specific examples of the 5-membered or 6-membered ring formed by $R_{17}$ and $R_{18}$, or $R_{18}$ and $R_{19}$ when combined together include a piperidine ring, a pyrrolidine ring, a morpholine ring, and a pyrrolidone ring.

Specific examples of the dyes represented by formula (III'-b) include, but are not limited to, the following compounds illustrated below. However, the present invention is not to be construed as being limited thereto.

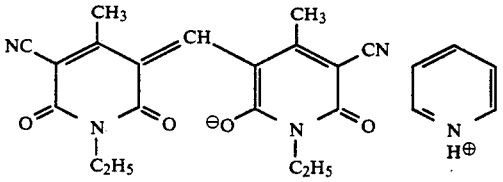

(b-1)

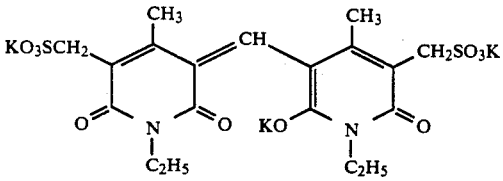

(b-2)

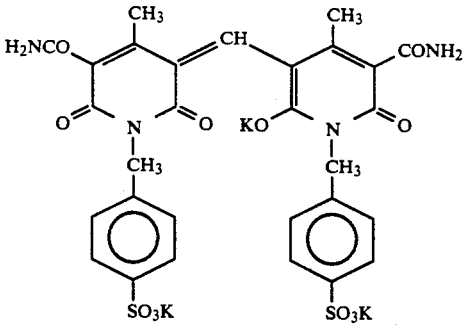

(b-3)

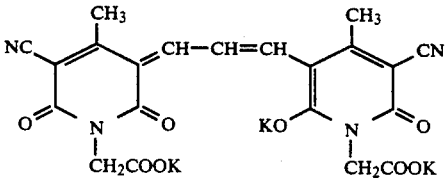

(b-4)

-continued
(b-5)
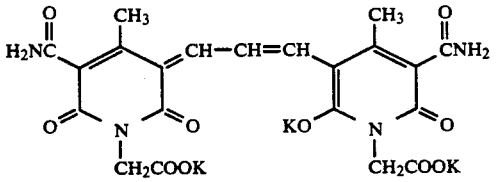
(b-6)
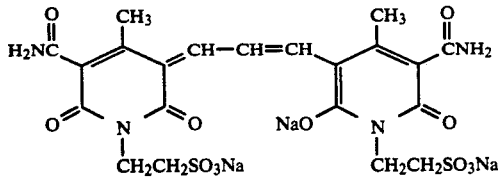
(b-7)
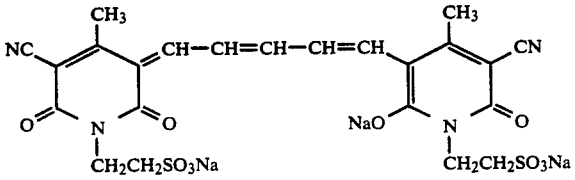
(b-8)
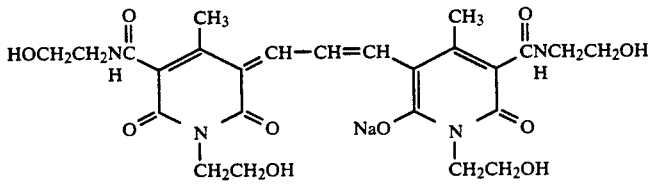
(b-9)
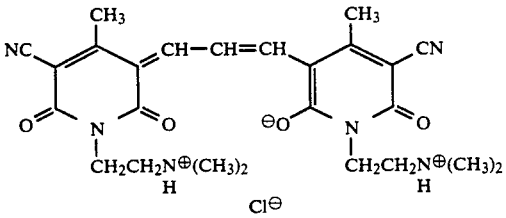
(b-10)
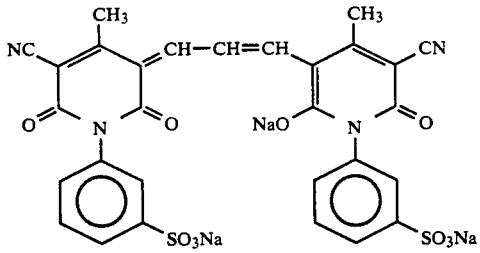
(b-11)
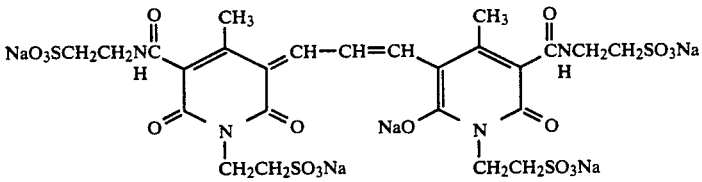
(b-12)
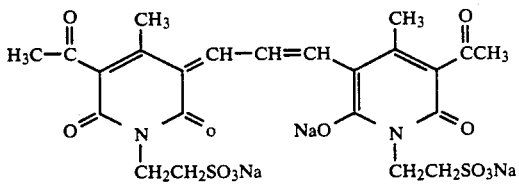

-continued
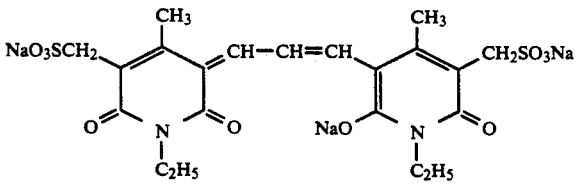
(b-13)
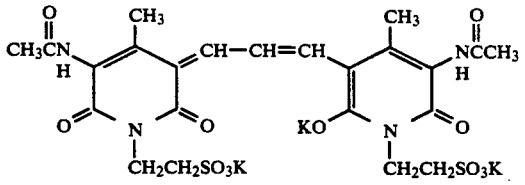
(b-14)
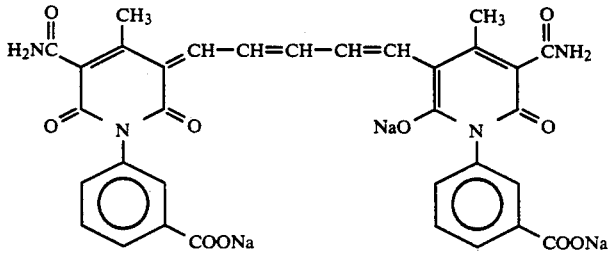
(b-15)
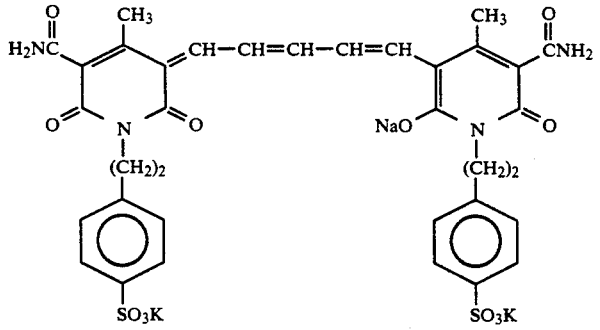
(b-16)
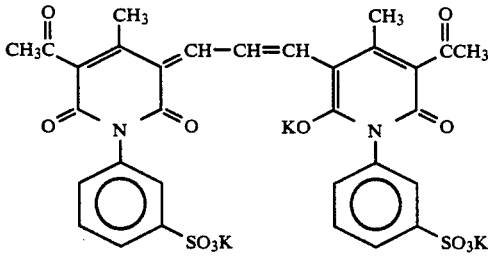
(b-17)
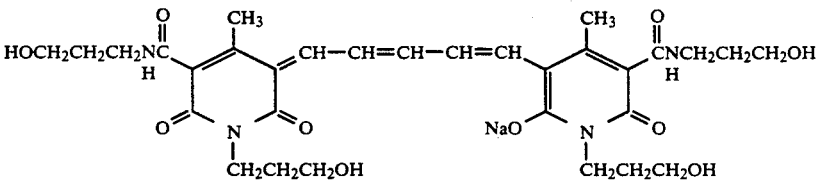
(b-18)

-continued

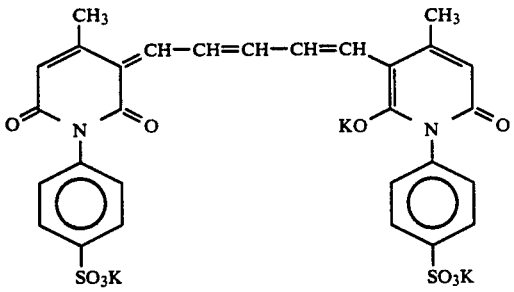

(b-19)

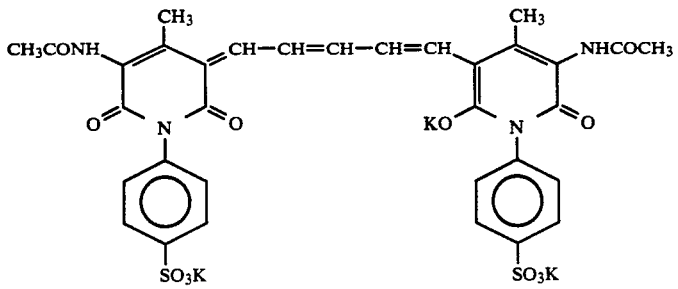

(b-20)

The dyes represented by formula (III'-b) can be synthesized according to the methods disclosed in British Patents 1,278,621, 1,512,863 and 1,579,899.

The dyes represented by formula (III'-c) are illustrated in greater detail below.

The aliphatic group represented by $R_{21}$, $R_{22}$, $R_{23}$, $R_{24}$, $R_{25}$, $R_{26}$, $R_{27}$, $R_{28}$ and $R_{29}$ is a straight chain, branched, or cyclic alkyl, aralkyl or alkenyl group. Specific examples thereof include methyl, ethyl, n-butyl, benzyl, 2-sulfoethyl, 4-sulfobutyl, 2-sulfobenzyl, 2,4-disulfobenzyl, 2-carboxyethyl, carboxymethyl, 2-hydroxyethyl, dimethylaminoethyl, and trifluoromethyl.

Specific examples of the aromatic group represented by $R_{21}$, $R_{22}$, $R_{23}$, $R_{24}$, $R_{25}$, $R_{26}$, $R_{27}$, $R_{28}$ and $R_{29}$ include phenyl, naphthyl, 4-sulfophenyl, 2,5-disulfophenyl, 4-carboxyphenyl, 5,7-disulfo-3-naphthyl, 4-methoxyphenyl, and p-tolyl.

The heterocyclic group represented by $R_{21}$, $R_{22}$, $R_{24}$ and $R_{25}$ is a 5-membered or 6-membered nitrogen-containing heterocyclic group (including a condensed ring). Examples thereof include 5-sulfopyridine-2-yl and 5-sulfobenzothiazole-2-yl.

Examples of the 5-membered ring formed b $R_{30}$ and $R_{21}$, or $R_{31}$ and $R_{24}$ when combined together in the case where $Z_{21}$ is —$NR_{30}$ and $Z_{22}$ is —$NR_{31}$ include an imidazole ring, a benzimidazole ring, and a triazole ring. The 5-membered ring may be substituted. Examples of substituent groups include a carboxyl group, a sulfo group, a hydroxyl group, a halogen atom (e.g., F, Cl, Br, etc.), an alkyl group (e.g., methyl, ethyl), and an alkoxy group (e.g., methoxy, 4-sulfobutoxy).

Specific examples of the dyes represented by formula (III'-c) for use in the present invention include, but are not limited to, the following compounds.

| Compound | $R_{21}$, $R_{24}$ | $R_{22}$, $R_{25}$ | $R_{23}$, $R_{26}$ | $=(L_1=L_2)_{n1}=L_3-(L_n=L_5)_{n2}-$ | $Z_{21}$, $Z_{22}$ | $M^{\oplus}$ |
|---|---|---|---|---|---|---|
| c-1 | 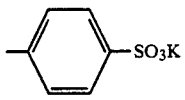  | —$CH_3$ | —$CH_3$ | =CH— | O | H |
| c-2 | 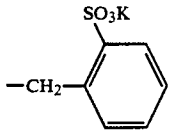  | 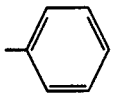 | —COOK | =CH— | O | K |
| c-3 | 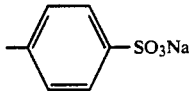  | —H | —$OC_2H_5$ | =CH— | O | H |
| c-4 | —$(CH_2)_3SO_3H$ | —$CH_2CH_2OH$ | 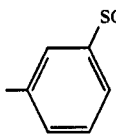  | =CH—CH=CH— | O | H |

-continued

| Compound | $R_{21}$, $R_{24}$ | $R_{22}$, $R_{25}$ | $R_{23}$, $R_{26}$ | $=(L_1-L_2)_{n1}=L_3-(L_4=L_5)_{n2}$ | $Z_{21}$, $Z_{22}$ | $M^{\oplus}$ |
|---|---|---|---|---|---|---|
| c-5 | $-(CH_2)_2SO_3K$ | $-COCH_3$ | $-COOK$ | $=CH-CH=CH-$ | O | H |
| c-6 | 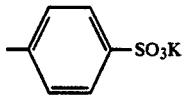 | $-CH_3$ | $-COOC_2H_5$ | $=CH-$ | O | K |
| c-7 | 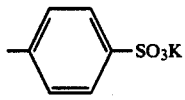 | $-CH_3$ | $-CH_3$ | $=CH-CH=CH-$ | O | H |
| c-8 | 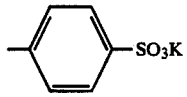 | $-H$ | $-COOK$ | $=CH-CH=CH-$ | O | H |
| c-9 | 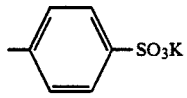 | $-CH_3$ | $-CH_3$ | $=CH(CH=CH)_2-$ | O | H |
| c-10 | $-CH_2CH_2COOH$ | $-CH_2CH_2OH$ | $-COOH$ | $=CH-CH=CH-$ | O | H |
| c-11 | $-CH_2CH_2SO_3K$ | 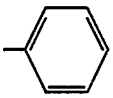 | $-CH_3$ | $=CH-CH=CH-$ | O | H |
| c-12 | 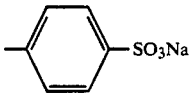 | 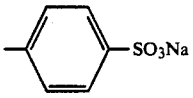 | $-CH_3$ | $=CH-CH=CH-$ | O | H |
| c-13 | 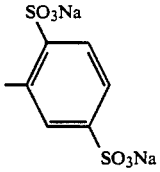 | $-CH_3$ | $-COONa$ | $=CH-CH=CH-$ | O | Na |
| c-14 | 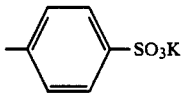 | $-CH_3$ | $-COOK$ | $=CH-CH=CH-$ | O | K |
| c-15 | 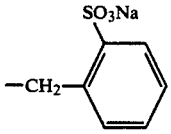 | $-(CH_2)_2SO_3Na$ | $-COONa$ | $=CH-CH=CH-$ | O | H |
| c-16 | $-CH_2CH_2SO_3K$ | $-COCH_3$ | $-COOK$ | $=CH-CH=CH-$ | O | H |
| c-17 | 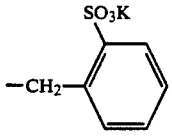 | 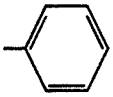 | $-CH_3$ | $=CH-CH=CH-$ | O | K |
| c-18 | 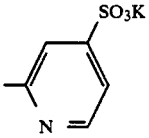 | $-H$ | $-CH_3$ | $=CH-CH=CH-$ | O | H |

-continued

| Compound | $R_{21}$, $R_{24}$ | $R_{22}$, $R_{25}$ | $R_{23}$, $R_{26}$ | $=(L_1=L_2)_{n1}=L_3=(L_4=L_5)_{n2}$ | $Z_{21}$, $Z_{22}$ | $M^{\oplus}$ |
|---|---|---|---|---|---|---|
| c-19 | 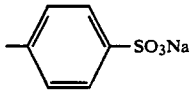 | $-CH_2CH_2OH$ | $-COONa$ | $=CH-CH=CH-$ | O | Na |
| c-20 | 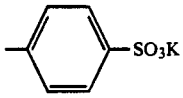 | $-CH_3$ | $-CONHCH_2CH_2OH$ | $=CH-CH=CH-$ | O | K |
| c-21 | $-(CH_2)_3SO_3K$ | $-CH_2CH_2COOK$ | 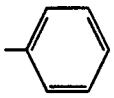 | $=CH-CH=CH-$ | O | H |
| c-22 | 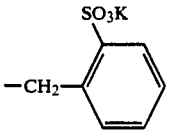 | $-CH_3$ | $-COOK$ | $=CH-CH=CH-$ | O | K |
| c-23 | $-CH_2CH_2SO_3K$ | $-CH_3$ | $-COOK$ | $=CH-CH=CH-$ | O | H |
| c-24 | 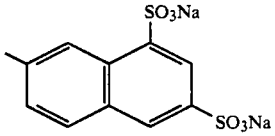 | $-CH_3$ | $-COONa$ | $=CH-CH=CH-$ | O | H |
| c-25 | 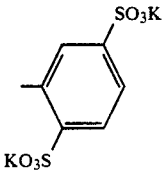 | $-CH_2CH_2OH$ | $-CH_3$ | $=CH-CH=CH-$ | O | H |
| c-26 | 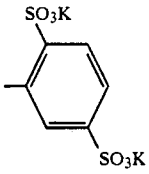 | $-CH_3$ | $-CH_3$ | $=CH-(CH=CH)_2-$ | O | K |
| c-27 | 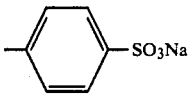 | $-CH_3$ | $-CN$ | $=CH-CH=CH-$ | O | Na |
| c-28 | 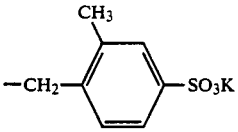 | 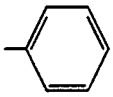 | $-CF_3$ | $=CH-CH=CH-$ | O | K |
| c-29 | 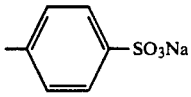 | $-(CH_2)_4SO_3Na$ | $-CH_3$ | $=CH-CH=CH-$ | O | Na |
| c-30 | 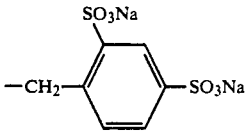 | $-CH_3$ | $-C_4H_9(t)$ | $=CH-CH=CH-$ | O | Na |

The dyes represented by formula (III'-c) can be synthesized using the methods as described in JP-B-39-22069, JP-B-43-3504, JP-B-52-38056, JP-B-54-38129, JP-B-55-10059, JP-A-99620, JP-A-59-16834, or U.S. Pat. No. 4,181,225.

The compounds represented by formula (III'-d) are illustrated in greater detail below.

The aliphatic group represented by $R_{31}$, $R_{32}$, $R_{33}$ and $R_{34}$ has the same meaning as the aliphatic group represented by $R_1$, $R_2$, $R_3$ and $R_4$ in formula (III'-a).

The aromatic group represented by $R_{31}$, $R_{32}$, $R_{33}$ and $R_{34}$ has the same meaning as the aromatic group represented by $R_1$, $R_2$, $R_3$ and $R_4$ in formula (III'-a).

The heterocyclic group represented by $R_{31}$, $R_{32}$, $R_{33}$ and $R_{34}$ has the same meaning as the heterocyclic group represented by $R_1$, $R_2$, $R_3$ and $R_4$ in formula (III'-a).

Specific examples of the dyes represented by formula (III'-d) include, but are not limited to, the following compounds.

| No. | $R_{31}$, $R_{33}$ | $R_{32}$, $R_{34}$ | $=(L_1-L_2)_{n1}=L_3-(L_4=L_5)_{n2}$ | $M^{\oplus}$ |
|---|---|---|---|---|
| d-1 | $-C_4H_9(n)$ | $-CH_2COOK$ | $=CH-$ | K |
| d-2 | $-CH_2CH_2OH$ | $-C_4H_9(n)$ | $=CH-CH=CH-$ | H |
| d-3 | $-CH_2CH_2SO_3K$ | $-C_2H_5$ | $=CH-CH=CH-$ | H |
| d-4 | $-CH_2CH_2COOK$ | $-CH_2CH_2COOK$ | $=CH-CH=CH-$ | H |
| d-5 | $-CH_3$ | $-CH_3$ | $=CH+CH=CH)_2$ | H |
| d-6 | $-C_4H_5(n)$ | $-CH_2COOK$ | $=CH+CH=CH)_2$ | H |
| d-7 | $-C_6H_5$ | $-CH_2COOK$ | $=CH+CH=CH)_2$ | H |
| d-8 | $-CH_2CH_2SO_3K$ | $-C_4H_9(n)$ | $=CH-$ | H |
| d-9 | 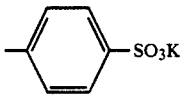 | $-H$ | $=CH-CH=CH-$ | H |
| d-10 | $-(CH_2)_3SO_3Na$ | $-H$ | $=CH-CH=CH-$ | H |
| d-11 | $-C_6H_5$ | $-(CH_2)_2SO_3K$ | $=CH-$ | H |
| d-12 | $-C_6H_5$ | $-(CH_2)_2SO_3K$ | $=CH-CH=CH-$ | H |
| d-13 | $-C_6H_5$ | $-(CH_2)_2SO_3K$ | $=CH+CH=CH)_2$ | H |
| d-14 | $-CH_2COOC_2H_5$ | $-C_4H_9(n)$ | $=CH-CH=CH-$ | H |
| d-15 | 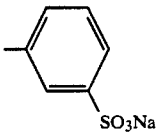 | $-(CH_2)_2SO_3Na$ | $=CH-CH=CH-$ | H |
| d-16 | $-CH_3$ | $-(CH_2)_2SO_3K$ | $=CH-$ | H |
| d-17 | 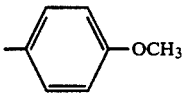 | $-(CH_2)_2SO_3K$ | $=CH-CH=CH-$ | H |
| d-18 | 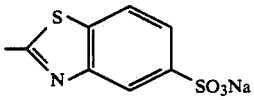 | $-C_2H_5$ | $=CH-CH=CH-$ | H |
| d-19 | $-C_6H_{13}(n)$ | $-(CH_2)_2SO_3K$ | $=CH-$ | H |
| d-20 | $-(CH_2)_3SO_3Na$ | $-H$ | $=CH-$ | H |

These dyes represented by formula (III'-d) can be synthesized according to the methods described in U.S. Pat. Nos. 3,247,127, 3,469,985, 3,653,905 and 4,078,933.

The compounds represented by formula (III'-e) are illustrated in greater detail below.

The groups $R_{35}$, $R_{36}$, $R_{37}$ and $R_{38}$ of the dye represented by formula (III'-e) each represents an alkyl group (e.g., methyl, ethyl, carboxymethyl, 2-carboxyethyl, 2-hydroxyethyl, methoxyethyl, 2-chloroethyl, benzyl, 2-sulfobenzyl, 4-sulfophenethyl), an aryl group (e.g., phenyl, 4-sulfophenyl, 3-sulfophenyl, 2-sulfophenyl, 4-carboxyphenyl, 3-carboxyphenyl, 4-hydroxyphenyl), or a residue of a heterocyclic ring (e.g., 2-pyridyl, 2-imidazolyl).

$L_{41}$, $L_{42}$ and $L_{43}$ each represents a methine group, and these methine groups may be independently substituted by methyl, ethyl, phenyl, a chlorine atom, sulfoethyl, or carboxyethyl, and $n_{41}$ represents 1, 2 or 3.

At least one of $R_{35}$, $R_{36}$, $R_{37}$ and $R_{38}$ is a group having at least one carboxyl group or sulfo group, and the total number of carboxyl groups and/or sulfo groups is at least two. These carboxyl and sulfo groups may be in the free form or in the form of a salt (e.g., Na salt, K salt, or ammonium salt).

Specific examples of the dyes represented by formula (III'-e) for use in the present invention include, but are not limited to, the following compounds.

(e-1)
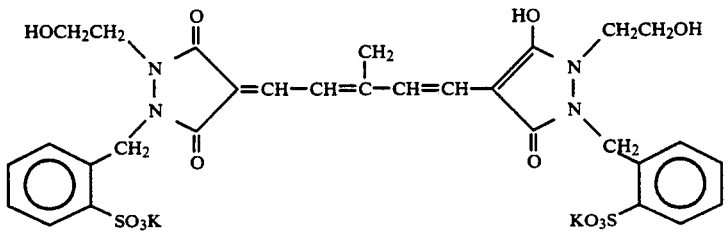
(e-2)
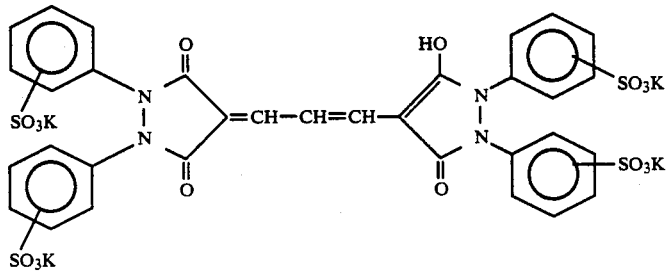
(e-3)
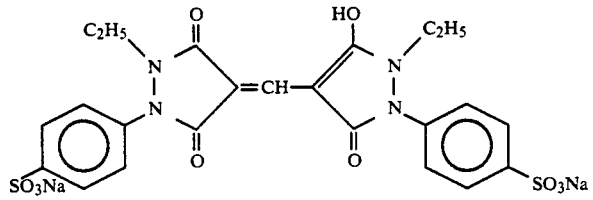
(e-4)
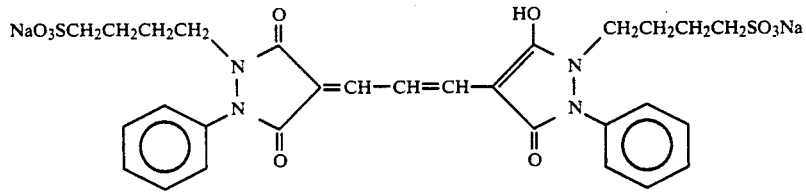
(e-5)
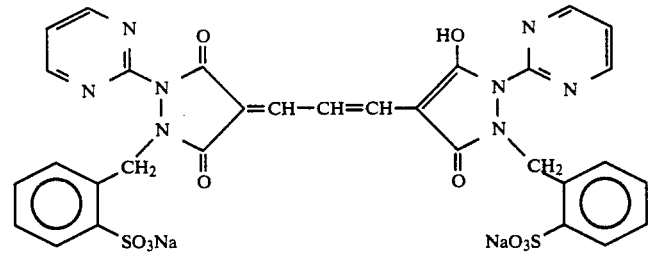
(e-6)
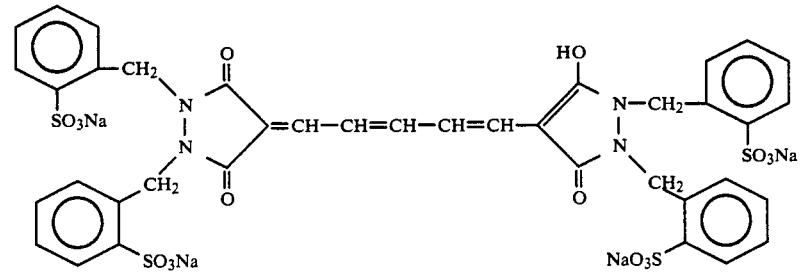

-continued (e-7)

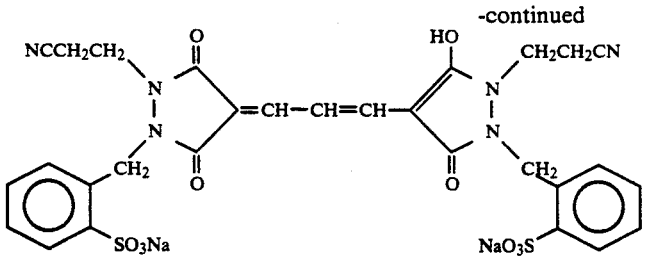

(e-8)

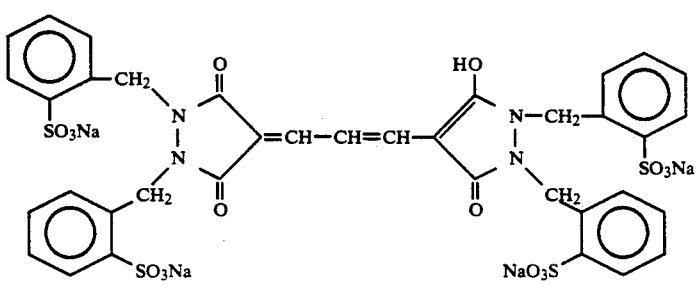

(e-9)

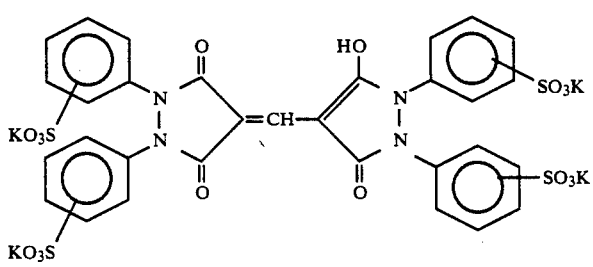

(e-10)

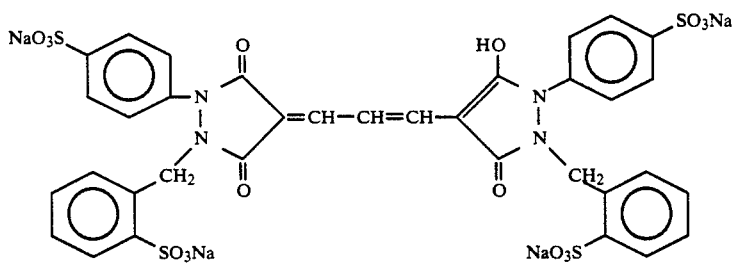

(e-11)

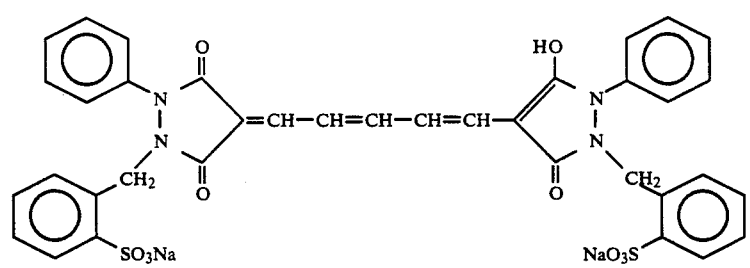

The dyes represented by formula (IV) are illustrated in greater detail below.

Suitable examples of electron attracting groups represented by X and Y include a cyano group, a carboxyl group, an alkylcarbonyl group (preferably having not more than 7 carbon atoms, such as acetyl and propionyl (said group may be substituted by a halogen atom such as chlorine)), an arylcarbonyl group (preferred examples of the aryl group include a phenyl group and a naphthyl group, the aryl group may have one or more substituent groups and examples of substituent groups include a sulfo group, a carboxyl group, a hydroxyl group, a halogen atom (e.g., chlorine, bromine), a cyano group, an alkyl group (e.g., methyl, ethyl), an alkoxy group (e.g., methoxy, ethoxy), a carbamoyl group (e.g., methylcarbamoyl), a sulfamoyl group (e.g., ethylsulfamoyl), a nitro group, an alkylsulfonyl group (e.g., methanesulfonyl), an arylsulfonyl group (e.g., benzenesulfonyl), an amino group (e.g., dimethylamino), an acylamino group (e.g., acetylamino, trichloroacetylamino), and a sulfonamido group (e.g., methanesulfonamido)), an alkoxycarbonyl group (preferably having not more than 7 carbon atoms, including a substituted alkoxycarbonyl group, such as ethoxycarbonyl, methoxyethoxycarbonyl), an aryloxycarbonyl group (preferred examples of the aryl group include a phenyl group and a naphthyl group, and the aryl group may be substituted by those described above in the definition of the arylcarbonyl group), a carbamoyl group (preferably having not more than 7 carbon atoms, including a substituted carbamoyl group, such as methylcarbamoyl, phenylcarbamoyl, 3-sulfophenylcarbamoyl), an alkylsulfonyl group (including a substituted alkylsulfonyl group, such as methanesulfonyl), an arylsulfonyl group (including a substituted arylsulfonyl group, such as phenylsulfonyl), and a sulfamoyl group (including a substituted sulfamoyl group, such as methylsulfamoyl, 4-chlorophenylsulfamoyl).

X and Y may be combined together to form a ring (e.g., a pyrazolone ring, a pyrazolotriazole ring, an oxyindole ring, an isoxazolone ring, a barbituric acid ring, a thiobarbituric acid ring, an indanedione ring, a pyridone ring). Of these rings, a pyrazolone ring is preferred.

$R_{41}$ and $R_{42}$ each represents a hydrogen atom, a halogen atom (e.g., chlorine, bromine), an alkyl group (preferably having not more than 5 carbon atoms, including a substituted alkyl group, such as methyl, ethyl), an alkoxy group (having preferably not more than 5 carbon atoms, including a substituted alkoxy group, such as methoxy, ethoxy, 2-chloroethoxy), a hydroxyl group, a carboxyl group, a substituted amino group (e.g., acetylamino, methylamino, diethylamino, methanesulfonylamino), a carbamoyl group (including a substituted carbamoyl group, such as methylcarbamoyl), a sulfamoyl group (including a substituted sulfamoyl group, such as ethylsulfamoyl), an alkoxycarbonyl group (e.g., methoxycarbonyl), or a sulfo group.

$R_{43}$ and $R_{44}$ each represents a hydrogen atom, an alkyl group (preferably having not more than 8 carbon atoms, including a substituted alkyl group, such as methyl, ethyl, propyl, and butyl, and examples of substituent groups include a sulfo group, a carboxyl group, a halogen atom, a hydroxyl group, a cyano group, an alkoxy group, an alkylcarbonyl group, an arylcarbonyl group, an acyloxy group, an acylamino group, a carbamoyl group, a sulfamoyl group, an alkylamino group, a dialkylamino group, an alkoxycarbonyl group, an aryloxycarbonyl group, an alkylsulfonyl group, an arylsulfonyl group, a sulfonylamino group, a ureido group, and an aryl group), an alkenyl group (including a substituted alkenyl group, such as 3-hexenyl), an aryl group (preferably a phenyl group, which may be substituted by those described above in the arylcarbonyl group of X and Y), an acyl group (e.g., acetyl, benzoyl), or a sulfonyl group (e.g., methanesulfonyl, phenylsulfonyl).

$R_{43}$ and $R_{44}$ may be combined together to form a 5-membered or 6-membered heterocyclic ring (e.g., a piperidine ring, a morpholine ring).

$R_{41}$ and $R_{43}$ or $R_{42}$ and $R_{44}$ may be combined together to form a 5-membered or 6-membered heterocyclic ring.

At least one of X, Y, $R_{41}$, $R_{42}$, $R_{43}$ and $R_{44}$ is a group having at least one sulfo group or carboxyl group. The sulfo group and/or carboxyl group may be in the free form or in the form of a salt (e.g., Na salt, K salt, $(C_2H_5)_3NH$ salt, pyridinium salt, ammonium salt).

The methine group represented by $L_{11}$, $L_{12}$ and $L_{13}$ may be substituted, for example, by methyl, ethyl, cyano, phenyl, chlorine, sulfoethyl, and k represents 0 or 1.

Specific nonlimiting examples of the dyes represented by formula (IV) for use in the present invention include the following compounds.

IV-1

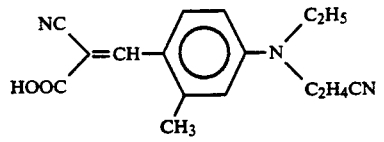

IV-2

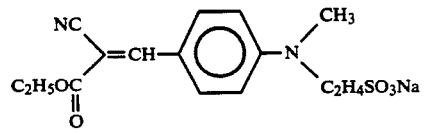

IV-3

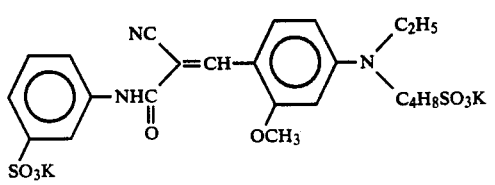

IV-4

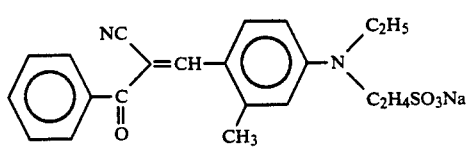

IV-5

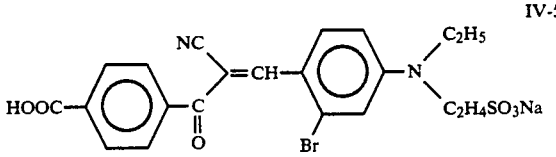

IV-6

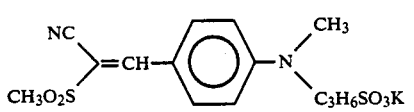

IV-7

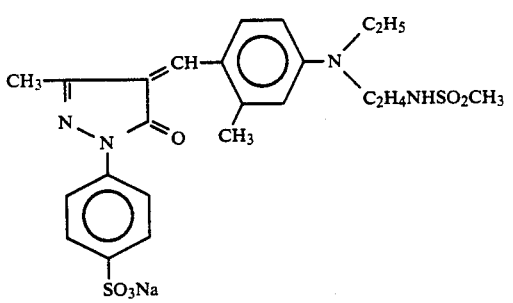

IV-8

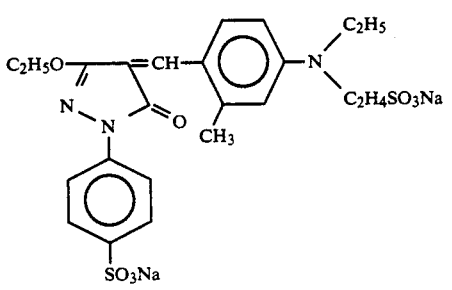

-continued
IV-9
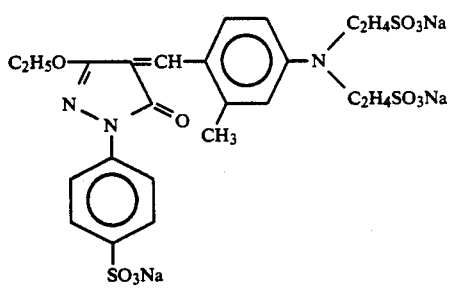
IV-10
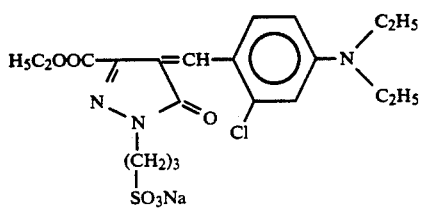
IV-11
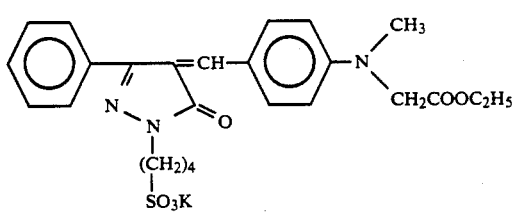
IV-12
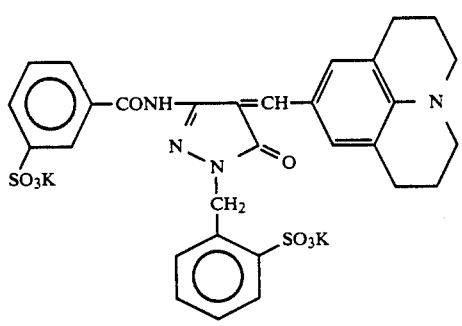
IV-13
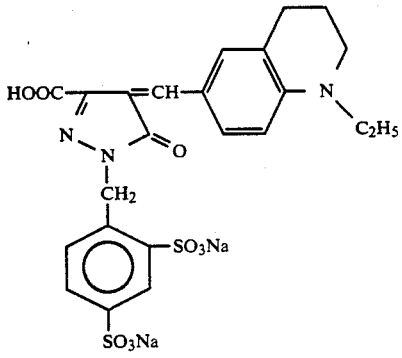
-continued
IV-14
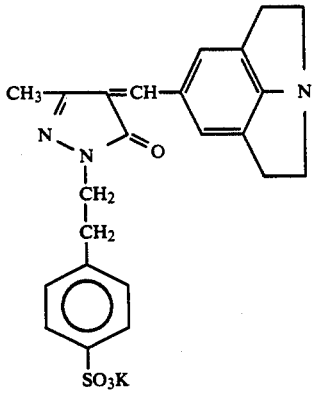
IV-15
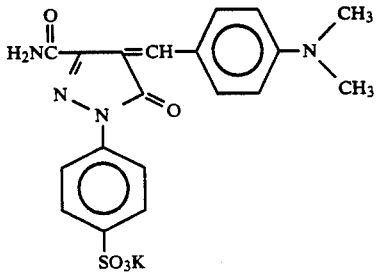
IV-16
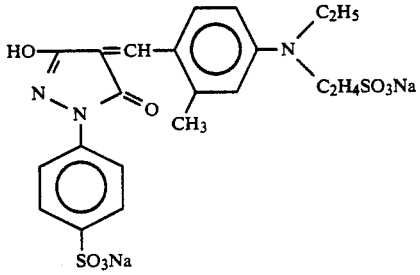
IV-17
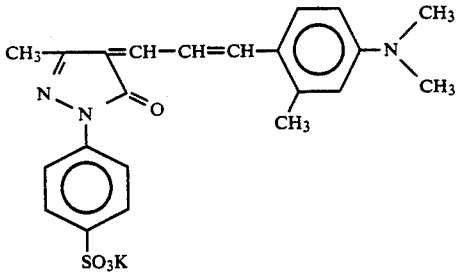
IV-18
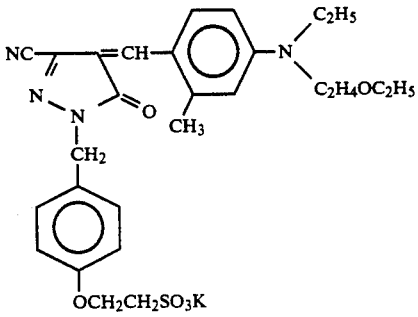

-continued

IV-19

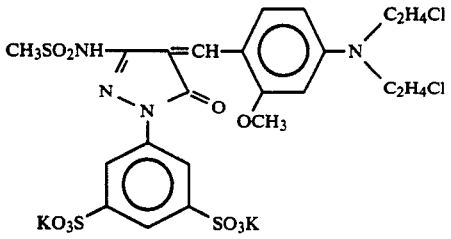

IV-23

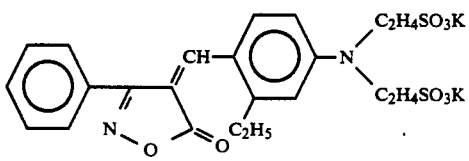

IV-24

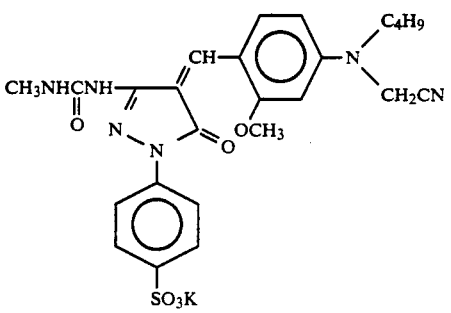

IV-25

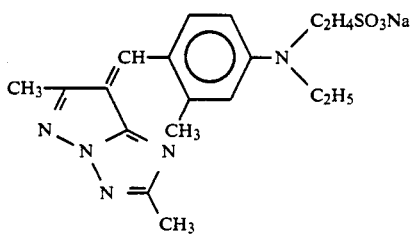

-continued

IV-26

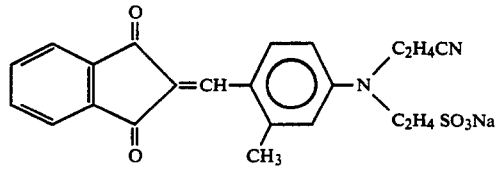

IV-27

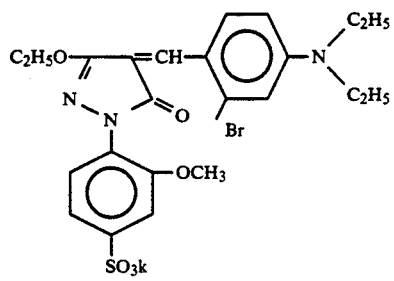

The dyes represented by formula (IV) can be readily synthesized according to the methods as disclosed in JP-A-51-3623, etc.

The dyes represented by formula (V) are illustrated in greater detail below.

Preferred examples of the aryl groups represented by $Ar_1$ and $Ar_2$ include a phenyl group and a naphthyl group. The aryl group may be substituted. Examples of substituent groups include a sulfo group, a carboxylic group, a hydroxyl group, an alkyl group having 1 to 6 carbon atoms (e.g., methyl, ethyl, n-propyl, isopropyl), an alkoxy group having 1 to 6 carbon atoms (e.g., methoxy, ethoxy, butoxy), a carbamoyl group, a sulfamoyl group, a halogen atom (e.g., F, Cl, Br), a cyano group, and a nitro group.

Preferred examples of the heterocyclic groups represented by $Ar_1$ and $Ar_2$ include 5-membered or 6-membered nitrogen-containing heterocyclic rings such as 1-(4-sulfophenyl)-3-carboxy-5-hydroxy-4-pyrazolyl, 1-(4-sulfophenyl)-3-methyl-5-hydroxy-4-pyrazolyl, 1-(2,5-disulfophenyl)-3-carboxy-5-hydroxy-4-pyrazolyl, 1-carboxymethyl-3-carbamoyl-1,2-dihydro-6-hydroxy-4-methyl-2-oxopyridyl, and 1-(2-sulfoethyl)-3-cyano-1,2-dihydro-6-hydroxy-4-methyl-2-oxopyridyl.

Specific nonlimiting examples of the dyes represented by formula (V) include the following compounds.

V-1

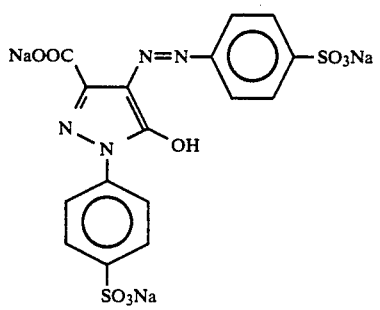

V-2

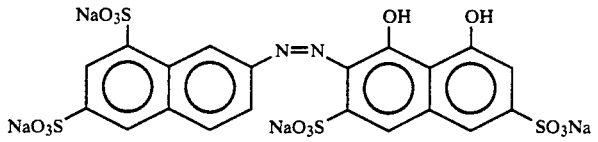

-continued
V-3
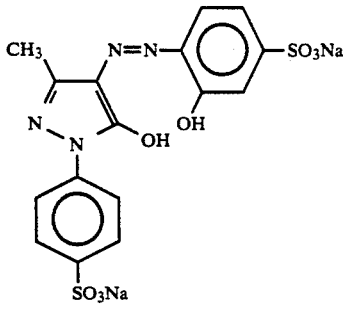
V-4
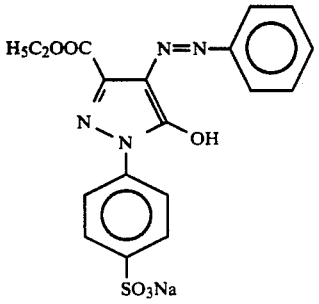
V-5
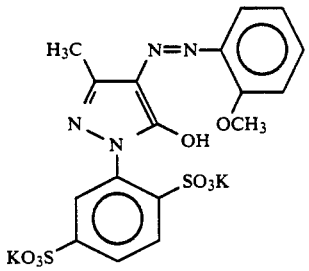
V-6
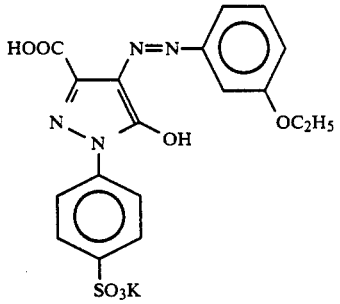
V-7
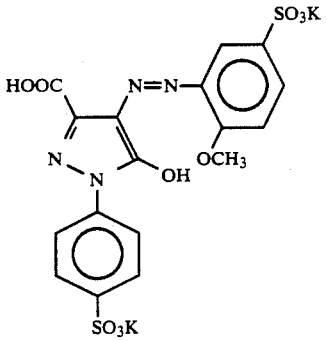

-continued
V-8
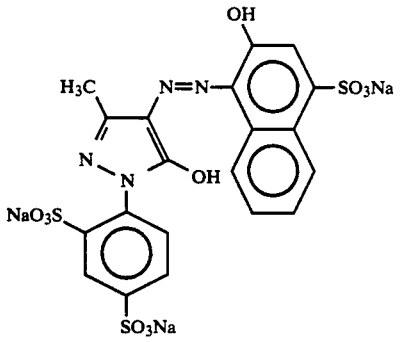
V-9
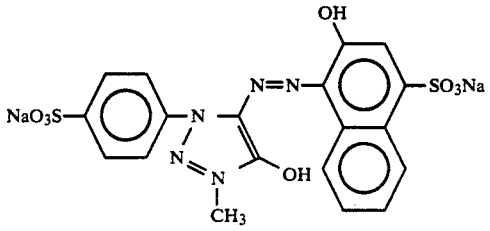
V-10
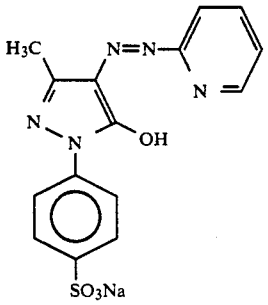
V-11
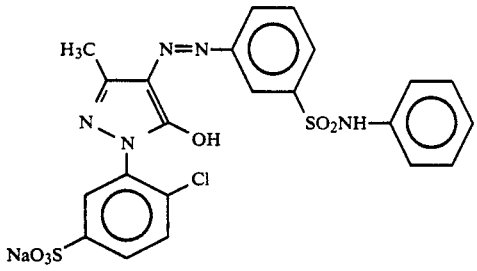
V-12
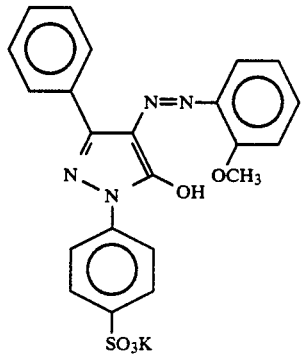

-continued
V-13
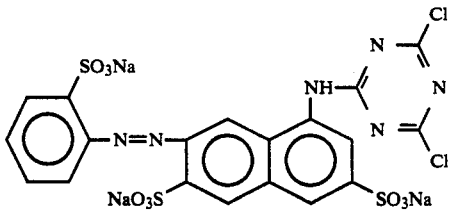
V-14
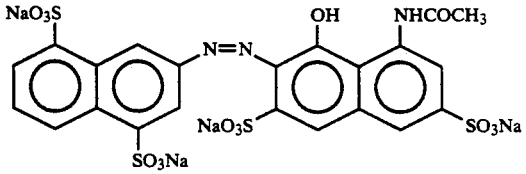
V-15
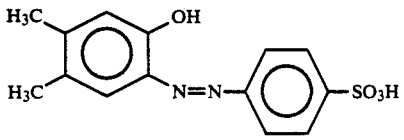
V-16
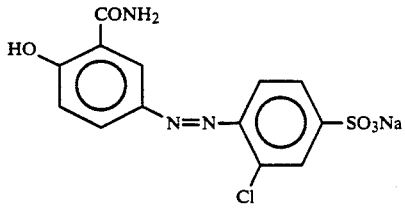
V-17
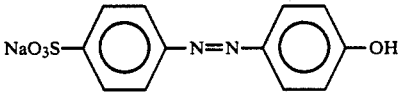
V-18
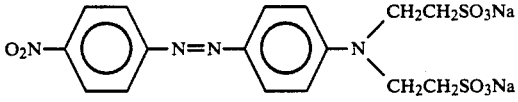
V-19
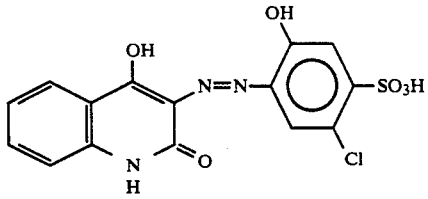
V-20
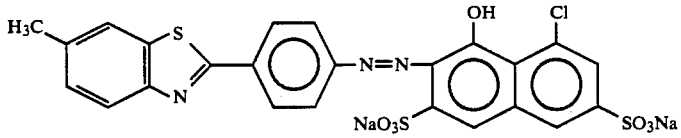
V-21
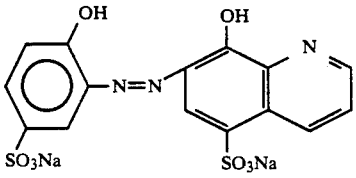

-continued
V-22
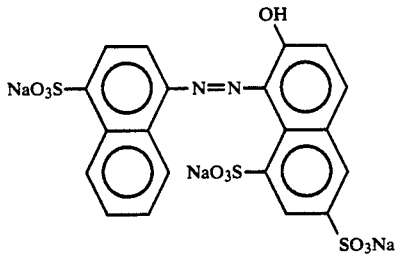
V-23
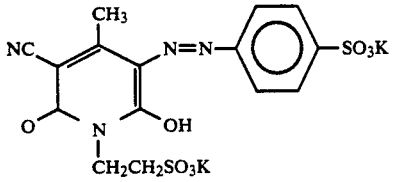
V-24
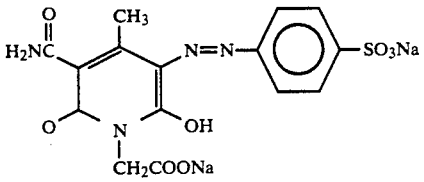
V-25
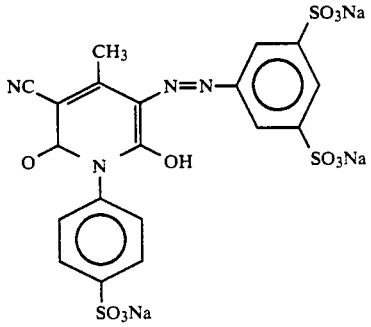
The dyes represented by formula (V) can be synthesized according to the methods disclosed in British Patents 575,691, 907,125 and 1,353,525.
Specific nonlimiting examples of the dyes represented by formula (VI) including the following compounds.
VI-1
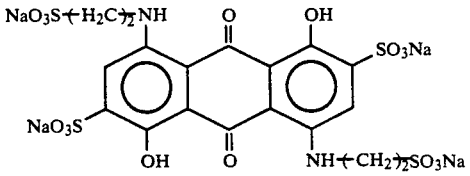
VI-2
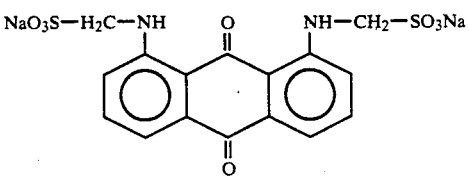
-continued
VI-3
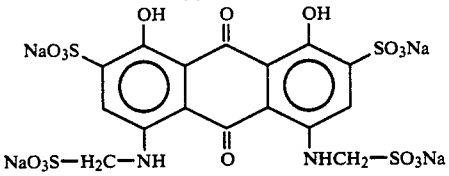
VI-4
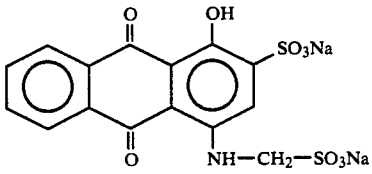
VI-5
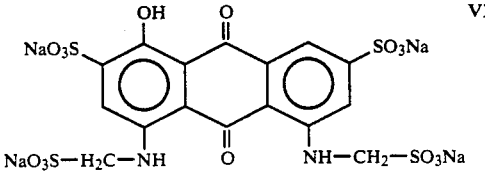

-continued
VI-6
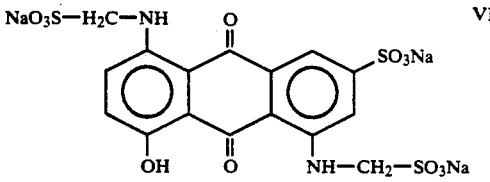
VI-7
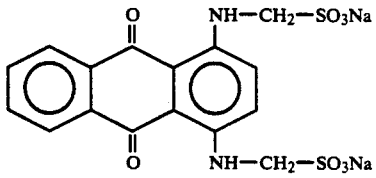
-continued
VI-8
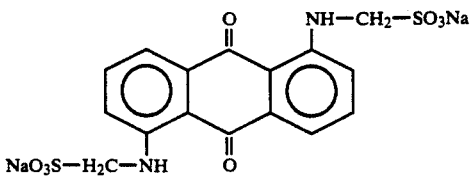
VI-9
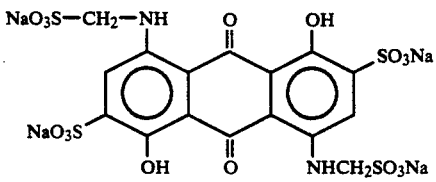
The dyes represented by formula (VI) can be synthesized according to the method disclosed in U.S. Pat. No. 2,865,752.
Specific nonlimiting examples of the dyes represented by formula (VII) include the following compounds.
VII-1
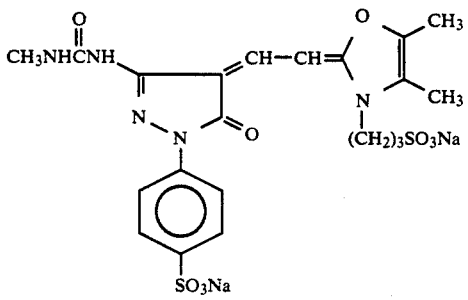
VII-2
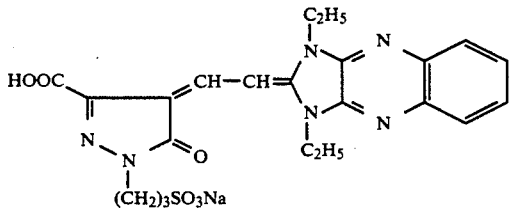
VII-3
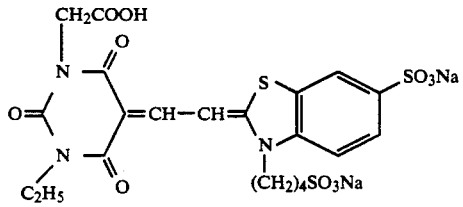
VII-4
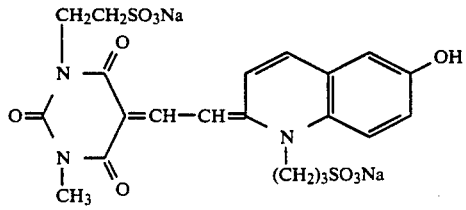

-continued
VII-5
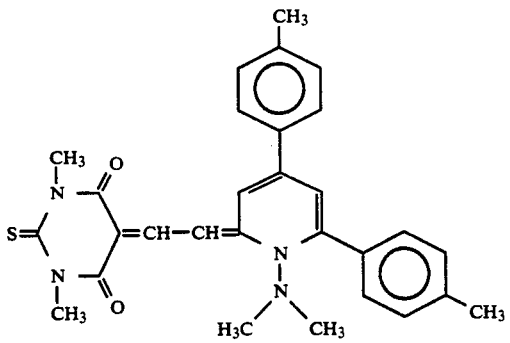
VII-6
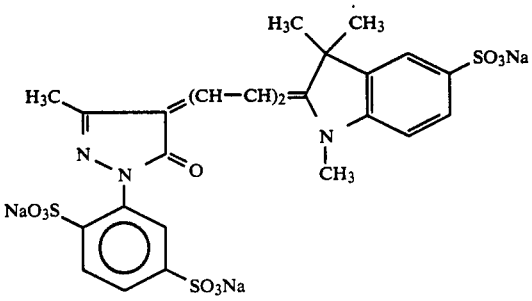
VII-7
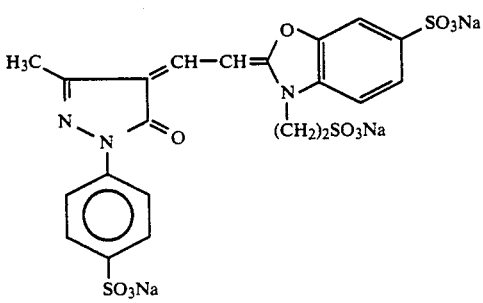
VII-8
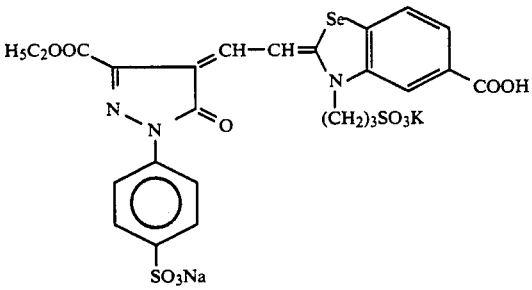
VII-9
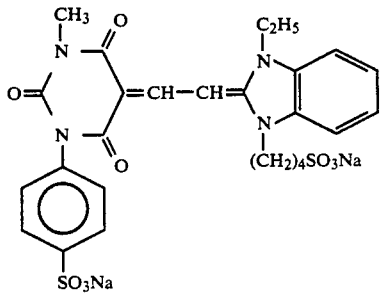

-continued
VII-10
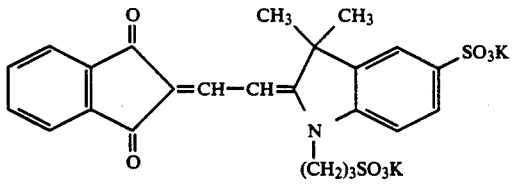
VII-11
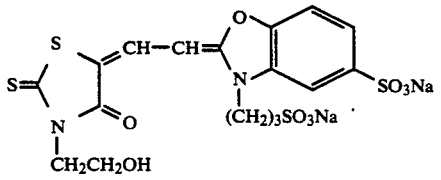
VII-12
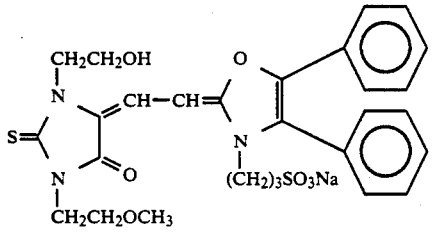
VII-13
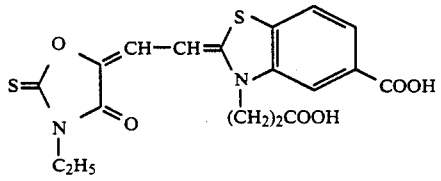
VII-14
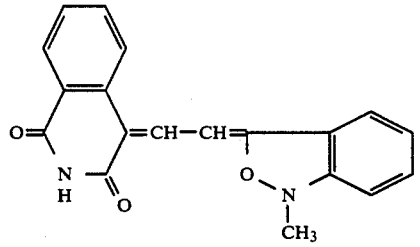
VII-15
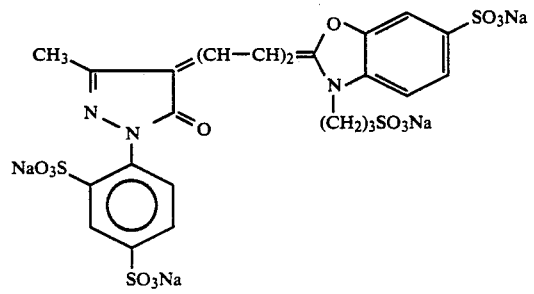

-continued
VII-16
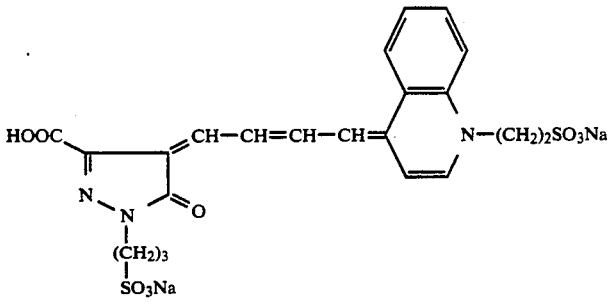
VII-17
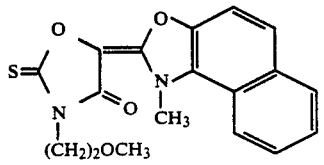
VII-18
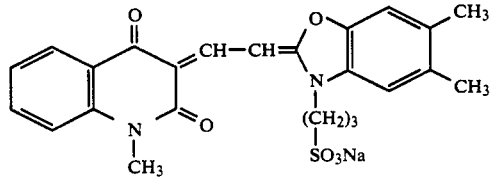
VII-19
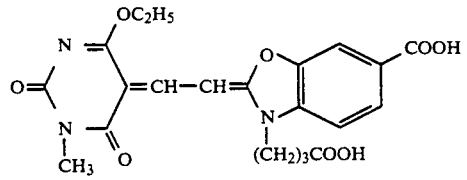
VII-20
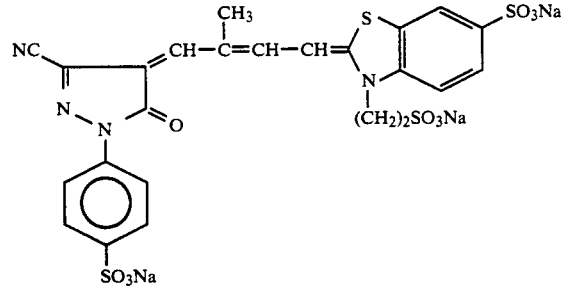
VII-21
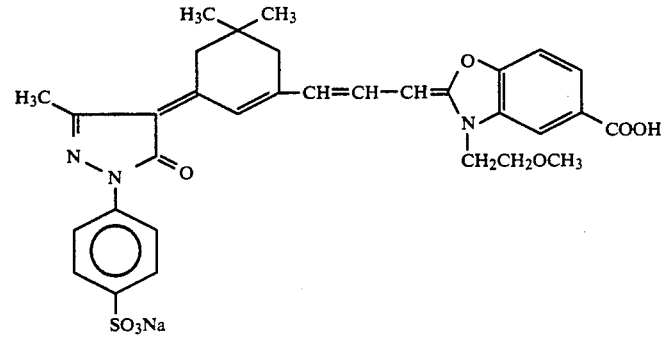

-continued
VII-22
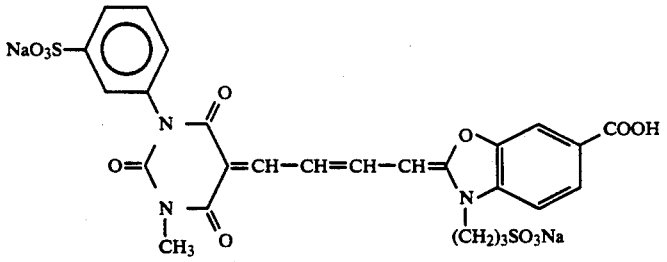
VII-23
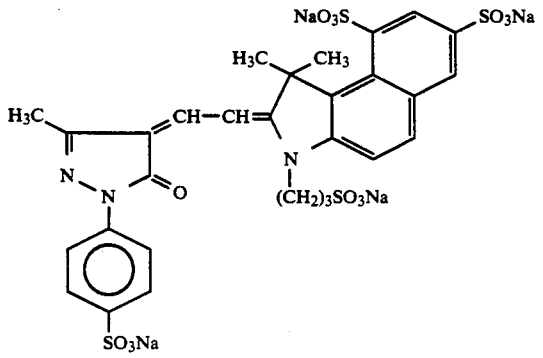
VII-24
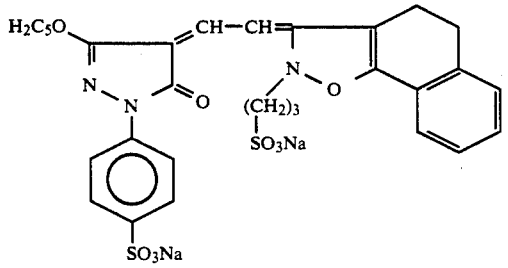
VII-25
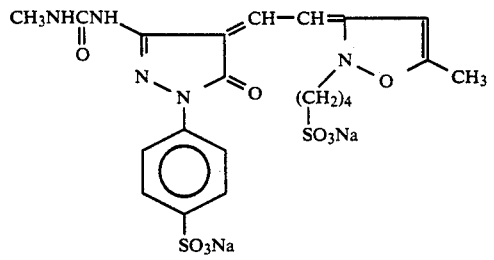
VII-26
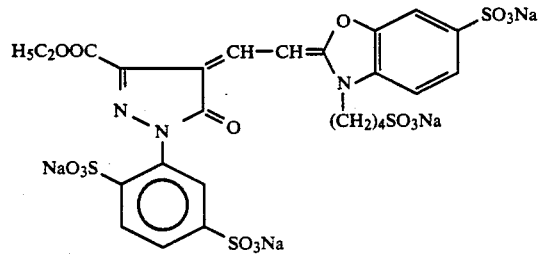
VII-27
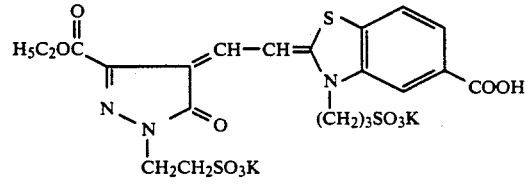

-continued
VII-28
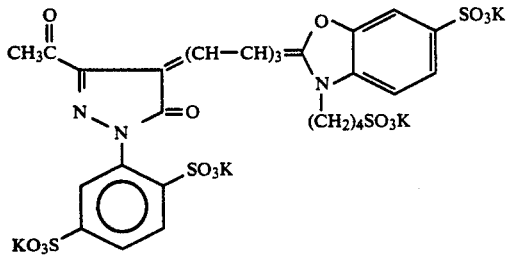
The dyes represented by formula (VIII) include the following nonlimiting compounds.
VIII-1
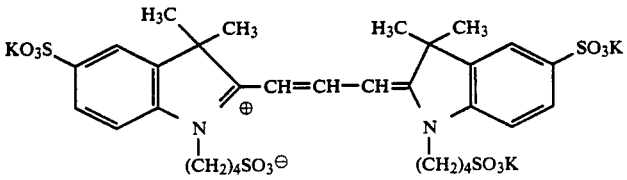
VIII-2
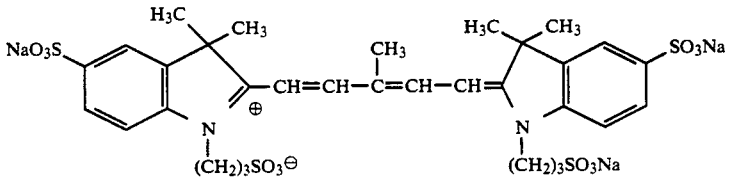
VIII-3
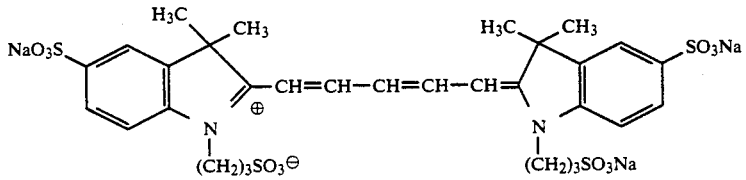
VIII-4
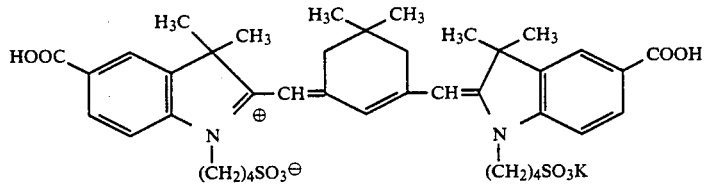
VIII-5
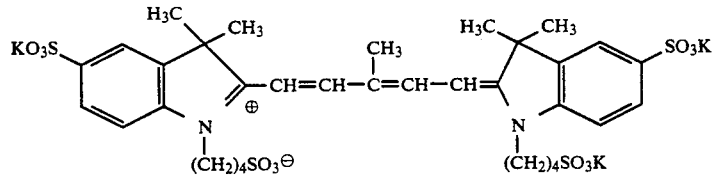
VIII-6
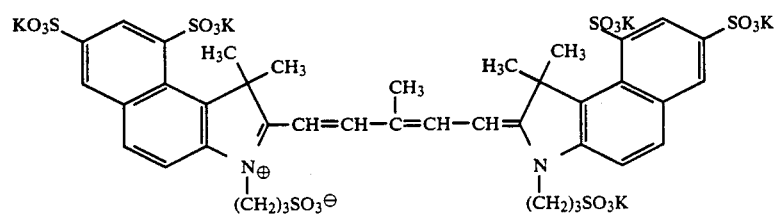

-continued
VIII-7
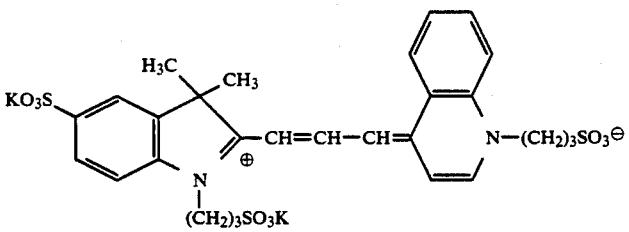
VIII-8
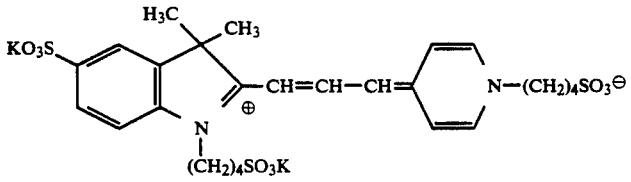
VIII-9
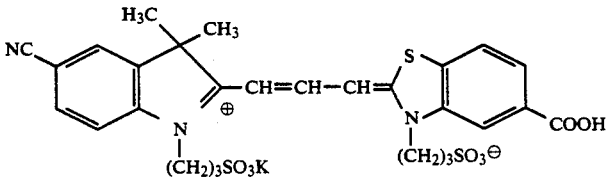
VIII-10
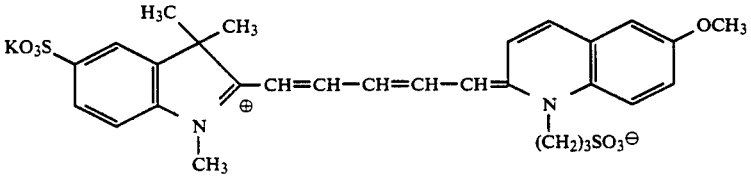
VIII-11
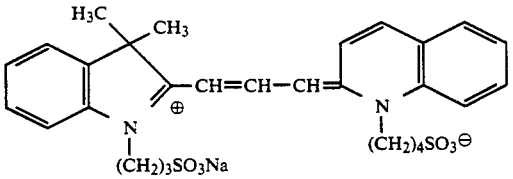
VIII-12
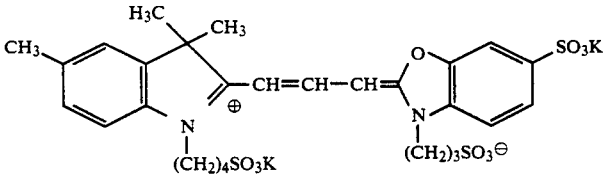
VIII-13
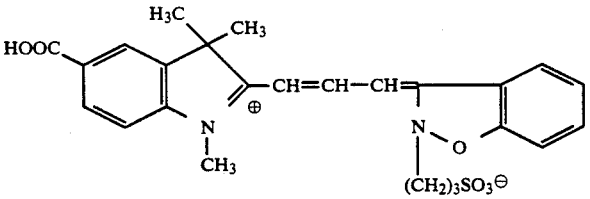
VIII-14
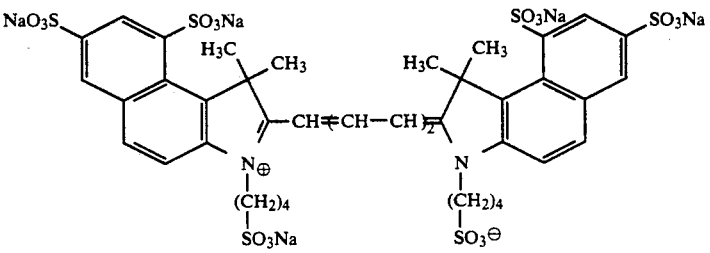

The support of the photographic material of the present invention comprises a base material having provided thereon a water resisting resin layer containing fine particles of titanium dioxide dispersed in a water resisting resin layer in an amount of at least 14% by weight, preferably at least 15% by weight, but not more than 60% by weight of the water resisting resin layer. The water resisting resin layer is on the same side of the support as that having the silver halide emulsion layers.

The surfaces of fine particles of titanium dioxide pigment are treated with a dihydric to tetrahydric alcohol, such as 2,4-dihydroxy-2-methylpentane or trimethylolethane as described in JP-A-58-17151, optionally in combination with an inorganic oxide such as silica or aluminum oxide. The water resisting resin layer containing fine particles of titanium dioxide has a thickness of from 2 to 200 μm, preferably from 5 to 80 μm. The water resisting resin layer containing fine particles of titanium dioxide according to the present invention may be laminated with a plurality of water resisting layers having a composition different from the water resisting resin layer of the present invention, which other water resisting layers may contain another white pigment or do not contain any white pigment.

If the water resisting resin layer of the present invention is laminated with a plurality of other water resisting layers, it is preferred that the water resisting resin layer containing fine particles of titanium dioxide according to the present invention is provided farthest from the support (on the same side of the support having the silver halide emulsion layers and closer to the silver halide emulsion layers than to the base material of the support).

In the present invention, a coefficient of variation in the occupied area ratio (%) of fine particles of titanium dioxide pigment is preferably not greater than 0.20, more preferably not greater than 0.15, particularly not greater than 0.10.

The dispersion uniformity of fine particles of titanium dioxide in the resin layer can be evaluated by scattering an about 0.1 μm (preferably about 500 Å) thick portion of the surface of the resin by means of ion sputtering process with glow discharge, examining fine particles of the exposed pigment with an electron microscope, determining the photographed occupied area and evaluating on the basis of a coefficient of variation of the occupied area ratio (%). Ion sputtering processes are fully described in Yoichi Murayama and Kunihiro Kashiwagi, *Surface Treatment Technique Using Plasma*, Study of Machine, Vol. 33, No. 6 (1981).

A coefficient of variation in the dispersion of the white pigment particles can be controlled to 0.20 or lower by thoroughly kneading the white pigment in the presence of a surfactant or by treating the surfaces of pigment particles with a dihydric to tetrahydric alcohol as described above.

The occupied area ratio (%) of fine particles of white pigment per unit area can be determined by dividing the observed area into adjoining unit areas of (each unit area: 6 μm×6 μm), and measuring the occupied area ratio (%) (Ri) of the fine particles projected on the unit area. A coefficient of variation in the occupied area ratio (%) can be determined from a ratio ($s/\bar{R}$) of standard deviation s of Ri to the mean value ($\bar{R}$) of Ri. The number (n) of divided unit areas is preferably not smaller than 6. Accordingly, a coefficient of variation $s/\bar{R}$ can be determined by the following formula:

$$s/\bar{R} = \frac{\sqrt{\dfrac{\sum_{i=1}^{n} (Ri - \bar{R})^2}{n-1}}}{\dfrac{\sum_{i=1}^{n} Ri}{n}}$$

In addition to titanium dioxide, other white pigments can be contained in the water resisting resin layer. Specific examples of other white pigments include barium sulfate, calcium sulfate, silicon oxide, zinc oxide, titanium phosphate, and aluminum oxide.

The reflective support for use in the silver halide photographic material of the present invention comprises a substrate (base material) coated with a water resisting resin layer. Suitable examples of the substrate for use in the present invention include base papers obtained from natural pulp, synthetic pulp or a mixture thereof, and plastic films such as polyester films (e.g., polyethylene terephthalate film, and a polybutylene terephthalate film), a cellulose triacetate film, a polystyrene film, and polyolefin films (e.g., polypropylene film).

The base paper of the present invention can be selected from materials conventionally used for photographic papers. More specifically, there can be used base paper obtained by using, as a principal ingredient, natural pulp selected from coniferous trees, broad-leaved trees, etc., and optionally adding salts such as clay, talc, calcium carbonate, fine particles of urea resin, etc., a sizing agent such as rosin, an alkyl ketene dimer, a higher fatty acid, paraffin wax, alkenylsuccinic acid, etc., a paper strengthening agent such as polyacrylamide, etc., and a fixing agent such as alumina sulfate, cationic polymer, etc. Neutral paper having a pH of 5 to 7 is particularly preferred (as measured with a pH meter using, as electrode, planar GST-5313F manufactured by Toa Denpa Kogyo K.K.) obtained by using a reactive sizing agent such as an alkyl ketene dimer or an alkenylsuccinic acid. Base paper obtained by using synthetic pulp in place of natural pulp can be used. Furthermore, base paper obtained from a mixture of natural pulp and synthetic pulp in an arbitrary ratio can be used.

The surface of pulp can be subjected to a surface size treatment using a film forming polymer such as gelatin, starch, carboxymethyl cellulose, polyacrylamide, or a modified polyvinyl alcohol. Examples of the modified polyvinyl alcohols include carboxyl-modified products, silanol-modified products and copolymers of polyvinyl alcohol with polyacrylamide.

When the surface size treatment with the film forming polymer is carried out, the coating weight of the film forming polymer is 0.1 to 5.0 g/m$^2$, preferably 0.5 to 2.0 g/m$^2$. If desired, an antistatic agent, a fluorescent brightener, a pigment, an antifoaming agent, etc., may be added to the film forming polymer.

The base paper can be prepared by making paper from a pulp slurry containing the above described pulp and optionally additives such as a salt, a sizing agent, a paper strengthening agent, a fixing agent, etc., using a paper machine, e.g., a Fourdrinier machine, followed by drying and winding. The above described surface size treatment is carried out either before or after the drying, and a calendering treatment is carried out during the period from the conclusion of the drying until the start of the winding. When the surface size treatment is carried out after the drying, the calendering treatment may be performed either before or after the surface size treatment.

Whether a base paper to be used as the support base of the present invention is to be neutralized or not can be determined by a pH measurement using a planar GST-5313F (made by Toa Denpa Kogyo K.K.) as an electrode. The term neutralized paper as used herein is intended to include those papers having a pH value of 5 or above, preferably from 5 to 9.

On the other hand, the water resisting resin layer of the present invention may comprise a vinyl chloride resin which itself forms a support.

The term "water resisting resin" as used herein includes those resins having a water absorption ratio (% by weight) of not higher than 0.5, preferably not higher than 0.1. Examples of useful resins include polyalkylenes (e.g., polyethylene, polypropylene and copolymers thereof), vinyl polymers and copolymers (e.g., polystyrene, polyacrylate, and copolymers thereof), and polyesters and copolymers thereof. Of them, polyalkylene resins including low density polyethylene, high density polyethylene, polypropylene, and a blend of these resins are preferably used. A fluorescent brightener, an antioxidant, an antistatic agent, a release agent, etc., may be added, if desired.

In addition, as disclosed in JP-A-57-27257, JP-A-57-49946 and JP-A-61-262738, unsaturated organic compounds having at least one polymerizable carbon-carbon double bond per molecule, such as methacrylate compounds, and di-, tri- and tetraacrylic esters represented by the general formulae disclosed in JP-A-61-262738 can be used. After coating on a support base, such unsaturated organic compounds are cured by irradiation with an electron beam to form a water resisting resin layer. In this case, titanium dioxide and other white pigments are dispersed into the unsaturated organic compounds prior to coating. Alternatively, the titanium dioxide and other white pigments can be dispersed in the uncured unsaturated organic compounds in the form of mixture with another resin.

The coating of the water resisting resin layer of the present invention can be achieved, for example, by the lamination methods such as dry lamination and solvent-free dry lamination described in *New Laminate Processing Handbook,* compiled by Kakoh Gijutsu Kenkyukai (written in Japanese). Coating is made by appropriate methods selected from among gravure roll coating, wire bar coating, doctor blade coating, reverse roll coating, dip coating, air knife coating, calender coating, kiss coating, squeeze coating, fountain coating, and other coating methods.

The surface of the support is preferably subjected to a corona discharge treatment, glow discharge treatment, or a flame treatment to provide a protective colloid layer for the silver halide light-sensitive material.

The support (including the water resisting resin layer) has the total basis weight of preferably 30 to 350 $g/m^2$ (a total thickness of about 30 to 400 $\mu m$), more preferably about 50 to 200 $g/m^2$.

The sum total of the layer thickness of constituent photographic layers coated on the support of the color photographic material of the present invention upon processing in a color developing solution is at least 1.4 times, preferably at least 1.8 times, but not more than 4.0 times, more preferably at least 2.0 times, not more than 3.5 times the value of dry layer thickness before processing. The term "dry layer thickness" as used herein refers to the layer thickness obtained by storing the photographic material at 25° C. and humidity of 55% for at least 2 hours and then measuring the thickness thereof under that condition. The term "sum total of the layer thicknesses in the color developing solution" as used herein refers to a value of layer thickness obtained by immersing said photographic material in the color developing solution having the same composition as that of the developing solution used for processing at the same temperature as the processing temperature for at least 60 seconds and then measuring the thickness of the swollen material.

The sum total of the coating weight (total silver coverage) of all silver halide emulsions contained in the color photographic material of the present invention is not more than 0.78 $g/m^2$, preferably not more than 0.70 $g/m^2$ in terms of silver. The sum total of the coating weight of the silver halide emulsions contained in the blue-sensitive emulsion layers and red-sensitive emulsion layers is preferably not more than 0.60 $g/m^2$, more preferably not more than 0.55 $g/m^2$ in terms of the coating weight of silver.

The color photographic material of the present invention can be formed by coating at least one blue-sensitive silver halide emulsion layer, at least one green-sensitive silver halide emulsion layer, and at least one red-sensitive silver halide emulsion layer on the support. For preparing a color photographic paper of the present invention, the emulsion layers are generally coated on a support in the above described order. However, the emulsion layers may be coated in a different order from the above order. If desired, an infrared ray-sensitive silver halide emulsion layer may be provided in place of at least one of the above described layers. Color reproduction by subtractive color photography can be achieved by incorporating dyes, namely, color couplers in the light-sensitive emulsion layers, said dyes having a color complementary to the light region which the corresponding silver halide emulsion layer is sensitive to (e.g., yellow coupler to blue, magenta coupler to green and cyan coupler to red). However, the light-sensitive layers need not necessarily correspond to the colored hue of the couplers in the above described manner.

It is preferred that the silver halide emulsions of the present invention comprise silver chloride or silver chlorobromide containing substantially no silver iodide. The term "containing substantially no silver iodide" as used herein means that the content of silver iodide is not higher than 1 mol %, and preferably not higher than 0.2 mol %. The emulsion may comprise grains having the same halogen composition or different halogen composition from one another. When an emulsion comprising grains having the same halogen composition is used, the property of each grain is readily made uniform. With regard to the distribution of the halogen composition in the interior of the grains of silver halide emulsion, grains having a uniform type structure where the halogen composition is uniform throughout the whole of silver halide grain; grains having a laminated layer type structure where a core in the interior of silver halide grain is different in halogen composition from a shell (a single layer or a plurality of layers) which surrounds the core; and grains comprising a part having a different halogen composition in the interior of the grain or on the surface of grain in a non-laminar form (when said part having a different halogen composition exists on the surface of grain, the grain has such a structure that said part having a different composition is joined to the edge, corner or plane of grain), can be used. When high sensitivity is necessary, the latter two types are preferable to the uniform type structure. The latter two types are also preferred for providing pressure resistance. When the silver halide grain has the above described structure, the boundary between areas having a different halogen compositions may be a distinct boundary, a nondistinct boundary where a mixed crystal is formed by the difference in halogen composition, or a zone where a continuous structural change positively occurs.

With regard to the halogen composition of silver chlorobromide emulsions, grains having an arbitrary ratio of silver bromide/silver chloride can be used. The ratio widely varies depending on the application, but grains having a silver chloride ratio of at least 2% are preferred.

High silver chloride emulsions having a high silver chloride content are preferred to provide photographic materials suitable for use in rapid processing. The high silver chloride content emulsions have a silver chloride content of preferably at least 90 mol %, more preferably at least 95 mol %.

It is desirable for the above described high chloride content emulsion to have, as described above, a structure such that a silver bromide-localized phase is present inside and/or at the surface of the grains with or without the existence of a layer form. In the localized phase, the bromide content therein is at least 10 mol %, preferably more than 20 mol %. The localized phase can be present inside the grain, or at the edges, corners or faces of the grain surface. A localized phase formed by epitaxial growth at the corners of each grain is advantageous.

On the other hand, to inhibit with the greatest possible effect the decrease in sensitivity occurring when pressure is applied on the photographic material, it is also advantageous to use grains whose halide composition is substantially uniform throughout, namely, have a uniform structure, even for a high chloride content emulsion having a silver chloride content of 90 mol % or more.

Also, an additional increase in the chloride content of a silver halide emulsion results by reducing the replenishment rate of the development processing solution. In this case, an almost pure silver chloride emulsion having a chloride content of from 98 to 100 mol % is also advantageously used.

The average size of the silver halide grains of the silver halide emulsions for use in the present invention (the grain size herein refers to the diameter of the circle having the same area as the projected area of the grains, and the number average is taken in expressing the grain size) ranges preferably from 0.1 to 2 μm.

With respect to the distribution of sizes among the grains, a monodisperse emulsion having a variation coefficient (the value obtained by dividing the standard deviation of grain size distribution by the average grain size) of 20% or less, desirably 15% or less, is preferred. For the purpose of obtaining a wide latitude, a blend of monodisperse emulsions differing in average grain size in a single layer, or separately in a multiple layer is advantageously employed.

The silver halide grains in the photographic emulsions may have a regular crystal form, such as that of a cube, a tetradecahedron or an octahedron; an irregular crystal form, such as that of a sphere, a tabular form or so on; or a composite form thereof. A mixture of various crystal forms of silver halide grains may be also present. It is desirable in the present invention that the proportion of the silver halide grains having such a regular crystal form as described above to the total of the silver halide grains present in the photographic emulsion be at least 50%, preferably more than 70%, and more preferably more than 90%.

In addition, it is desirable in the present invention to use an emulsion where the proportion of tabular silver halide grains having an average aspect ratio (ratio of a projected area diameter to thickness) of 5 or more, preferably 8 or more, to the total silver halide grains present in the emulsion is more than 50%, based on the projected area.

The silver chlorobromide emulsion for use in the present invention can be prepared according to various methods as described in, for example, P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsion,* The Focal Press (1964); etc. Specifically, processes including an acid process, a neutral process and an ammoniacal process may be employed. Suitable methods for reacting a soluble silver salt with a soluble halide include, e.g., a single jet method, a double jet method, or a combination thereof. Also, a method in which silver halide grains are prepared in the presence of excess silver ion (reverse mixing method) can be employed. On the other hand, the controlled double jet method, in which the pAg of the liquid phase in which the silver halide grains are precipitated is maintained constant, may also be employed. According to this method, a silver halide emulsion having a regular crystal form and a substantially uniform distribution of grain sizes is obtained.

Various polyvalent metal ion impurities can be present during the formation of the silver halide grains or during the physical ripening of the silver halide grains. Examples of useful compounds usable for this purpose include cadmium salts, zinc salts, lead salts, copper salts, thallium salts, and single or complex salts of the Group VIII elements, such as iron, ruthenium, rhodium, palladium, osmium, iridium, platinum, etc. Of these salts, those of the Group VIII elements are used advantageously. The amount of these compounds added to the emulsion varies over a wide range depending on the application, but is preferably within the range of $10^{-9}$ to $10^{-2}$ mol per mol of silver halide.

The silver halide emulsions for use in the present invention are, in general, chemically and spectrally sensitized.

Chemical sensitization can be effected using a sulfur sensitization process comprising the addition of an unstable sulfur compound, a sensitization process utilizing a noble metal compound including a gold compound, and a reduction sensitization process, alone or in combination thereof. Compounds which are preferably used in the present invention for chemical sensitization include those disclosed in JP-A-62-215272, from the right lower column on page 18 to the right upper column on page 22.

Spectral sensitization is carried out for the purpose of spectrally sensitizing the emulsion in a desired wavelength region in each light-sensitive layer in the photographic material of the present invention. This can be achieved by addition of dyes which absorbs light in the wavelength regions corresponding to the desired spectral sensitivities, respectively, namely, spectral sensitizing dyes. Spectral sensitizing dyes for use for the above purpose include those described in, e.g., F. M. Harmer, *Heterocyclic Compound—Cyanine Dyes and Related Compounds*, John Wiley & Sons, New York and London (1964). Specific examples of compounds and spectral sensitization processes which can be employed to advantage in the present invention include those disclosed in JP-A-62-215272, from the right upper column on the page 22 to the page 38.

The silver halide emulsions for use in the present invention can contain a wide variety of compounds or precursors thereof for the purpose of preventing fog or stabilizing the photographic characteristics during production, storage, or photographic processing. Specific examples of compounds preferably used in the present invention include those disclosed in the above cited patent, JP-A-62-215272, from the page 39 to the page 72.

The emulsion of the present invention may be any of a surface latent image type emulsion wherein a latent image is mainly formed on the surface of the grains or an internal latent image type emulsion wherein a latent image is mainly formed in the interior of the grains.

When the present invention is applied to color photographic materials, a yellow coupler, a magenta coupler and a cyan coupler which form yellow, magenta and cyan colors, respectively, upon coupling with the oxidation product of an aromatic amine type color developing agent are generally incorporated into the photographic material.

Cyan, magenta and yellow couple--s which can be advantageously used in the present invention are represented by the following formulae (C-I), (C-II), (M-I), (M-II) and (Y).

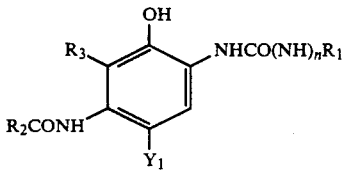
(C-I)

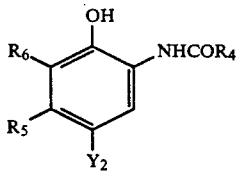
(C-II)

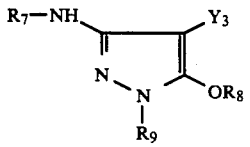
(M-I)

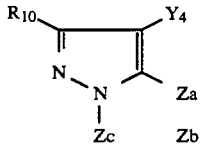
(M-II)

-continued

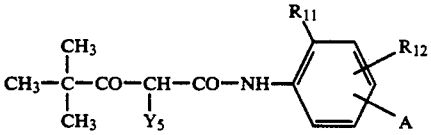
(Y)

In the above formulae (C-I) and (C-II), $R_1$, $R_2$ and $R_4$ each represents a substituted or unsubstituted aliphatic, aromatic or heterocyclic group $R_3$, $R_5$ and $R_6$ each represents a hydrogen atom, a halogen atom, an aliphatic group, an aromatic group, or an acylamino group; and furthermore, $R_3$ represents a nonmetallic atomic groups to complete a nitrogen-containing 5- or 6-membered ring by combining with $R_2$; $Y_1$ and $Y_2$ each represents a hydrogen atom, or a group which is eliminated by a coupling reaction with the oxidation product of a developing agent; and n represents 0 or 1.

$R_5$ in formula (C-II) is preferably an aliphatic group, specific examples thereof including methyl, ethyl, propyl, butyl, pentadecyl, tert-butyl, cycolohexyl, cyclohexylmethyl, phenylthiomethyl, dodecyloxyphenylthiomethyl, butanamidomethyl, or methoxymethyl.

Preferred cyan couplers represented by formulae (C-I) and (C-II) are described in further detail below.

$R_1$ in formula (C-I) is preferably an aryl or heterocyclic group, and more preferably an aryl group substituted by a halogen atom, an alkyl group, an alkoxy group, an aryloxy group, an acylamino group, an acyl group, a carbamoyl group, a sulfonamide group, a sulfamoyl group, a sulfonyl group, a sulfamide group, an oxycarbonyl group, or a cyano group.

When $R_3$ and $R_2$ are not combined with each other for ring formation in formula (C-I), $R_2$ is preferably a substituted or unsubstituted alkyl or aryl group, and more preferably a substituted aryloxy-substituted alkyl group, and $R_3$ is preferably a hydrogen atom.

$R_4$ in formula (C-II) is preferably a substituted or unsubstituted alkyl or aryl group, and particularly preferably a substituted aryloxy-substituted alkyl group.

$R_5$ in formula (C-II) is preferably an alkyl group containing from 2 to 15 carbon atom or a methyl group substituted by a group containing at least one carbon atom, examples of the substituent group including an arylthio group, an alkylthio group, an acylamino group, an aryloxy group and an alkyloxy group.

In formula (C-II), $R_5$ is more preferably an alkyl group containing 2 to 15 carbon atoms, especially 2 to 4 carbon atoms.

$R_6$ in formula (C-II) is preferably a hydrogen atom or a halogen atom, and particularly preferably a chlorine atom or a fluorine atom.

$Y_1$ and $Y_2$ in formulae (C-I) and (C-II) each preferably represents a hydrogen atom, a halogen atom, an alkoxy group, an aryloxy group, an acyloxy group, or a sulfonamide group.

$R_7$ and $R_9$ in formula (M-I) each represents an aryl group, and $R_8$ represents a hydrogen atom, an aliphatic or aromatic acyl group, or an aliphatic or aromatic sulfonyl group. $Y_3$ represents a hydrogen atom or an eliminable group. Substituent groups which can be present on the aryl groups represented by $R_7$ and $R_9$ (which preferably are phenyl groups) include the same substituents described for $R_1$. When the aryl group has two or more substituent groups, the substituent groups may be the same or different. $R_8$ is preferably a hydrogen atom, or an aliphatic acyl or sulfonyl group, and particularly preferably a hydrogen atom. In particular, it is desirable for $Y_3$ to be a group of the type which can be eliminated which contains a sulfur, oxygen or nitrogen atom at the elimination site, especially one which contains a sulfur atom at the elimination site, as disclosed in U.S. Pat. No. 4,351,897 and WO 88/04795.

In formula (M-II), $R_{10}$ represents a hydrogen atom or a substituent group. $Y_4$ represents a hydrogen atom or a group which can be eliminated, and, particularly preferably, a halogen atom or an arylthio group. Za, Zb and Zc each represents an unsubstituted or substituted methine group, =N— or —NH—, provided that either the Za-Zb bond or the Zb-Zc bond is a double bond, and the other is a single bond. When the Zb-Zc bond is a carbon-carbon double bond, it may form a part of an aromatic ring. The compound represented by formula (M-II) may form a dimer or a higher polymer via $R_{10}$ or $Y_4$, or a substituted methine group when Za, Zb or Zc represents such a methine group.

Of the pyrazoloazole type couplers represented by formula (M-II), the imidazo[1,2-b]pyrazoles disclosed in U.S. Pat. No. 4,500,630 are preferred with respect to low yellow side absorption of the developed dyes and light fastness thereof, and the pyrazolo[1,5-b][1,2,4]-triazoles disclosed in U.S. Pat. No. 4,540,654 are especially advantageous.

In addition, pyrazolotriazole type couplers in which the 2-, 3- or 6-position of the pyrazolotriazole ring is substituted by a branched alkyl group, as disclosed in JP-A-61-65245; pyrazoloazole type couplers which contain a sulfonamide group in the molecule, as disclosed in JP-A-61-65246; pyrazoloazole type couplers which contain an alkoxyphenylsulfonamide group as a ballast group, as disclosed in JP-A-61-14-254; and pyrazolotriazole type couplers in which the 6-position is substituted by an alkoxy or aryloxy group, as disclosed in European Patents (Laid Open) 226,849 and 294,785 are preferably employed.

In formula (Y), $R_{11}$ represents a halogen atom, an alkoxy group, a trifluoromethyl group, or an aryl group; $R_{12}$ represents a hydrogen atom, a halogen atom, or an alkoxy group; A represents $—NHCOR_{13}$, $—NHSO_2—R_{13}$, $—SO_2NHR_{13}$, $—COOR_{13}$, or $$—SO_2N(R_{14})—R_{13}$$

(wherein $R_{13}$ and $R_{14}$ each represents an alkyl group, an aryl group, or an acyl group); and $Y_5$ represents a group which can be eliminated. Substituent groups for the groups represented by $R_{12}$, $R_{13}$ and $R_{14}$ include the same substituents described for the groups represented by $R_1$. A group which can be eliminated represented by $Y_5$ is preferable one which contains an oxygen or a nitrogen atom, especially a nitrogen atom, at the elimination site.

Specific nonlimiting examples oz couplers represented by formulae (C-I), (C-II), (M-I), (M-II) and (Y), respectively, for use in the present invention, are illustrated below.

(C-1)

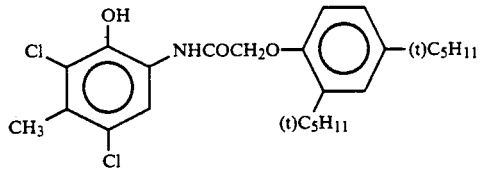

(C-2)

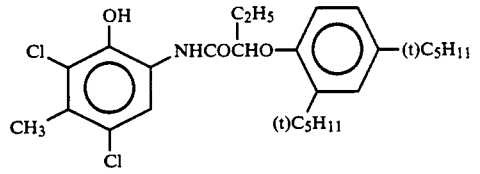

(C-3)

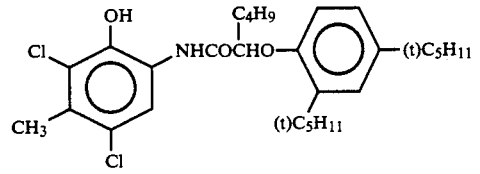

(C-4)

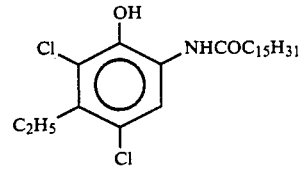

-continued
(C-5)
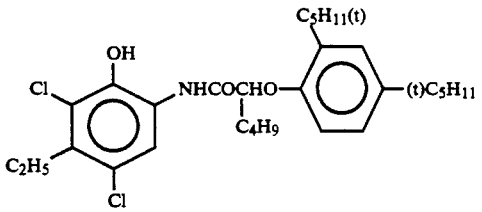
(C-6)
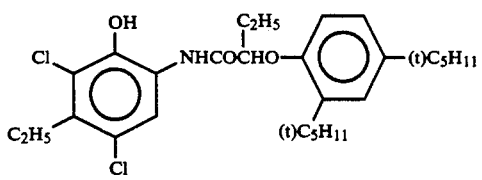
(C-7)
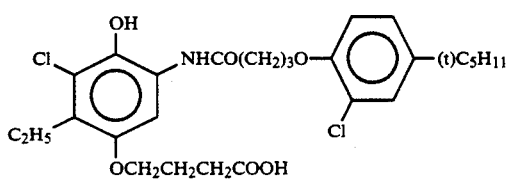
(C-8)
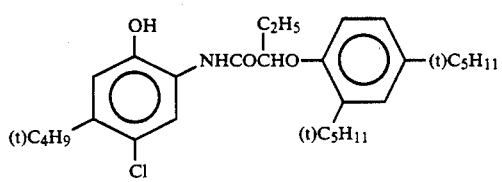
(C-9)
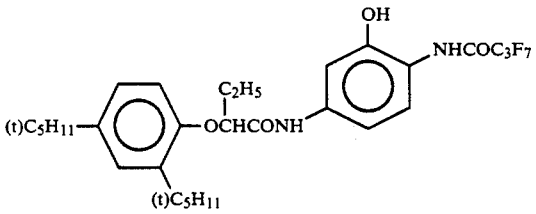
(C-10)
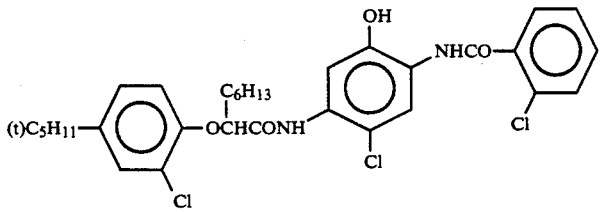
(C-11)
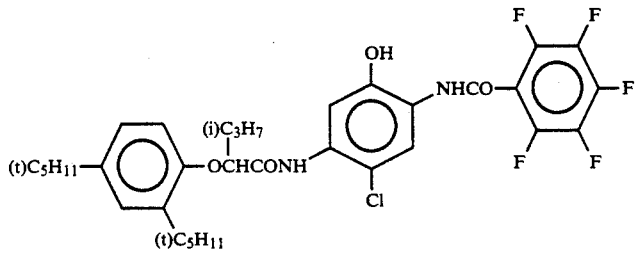

-continued
(C-12)
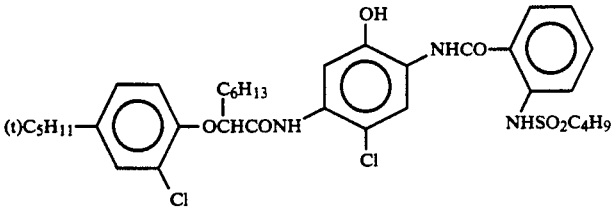
(C-13)
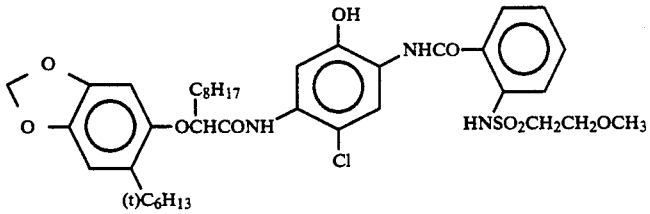
(C-14)
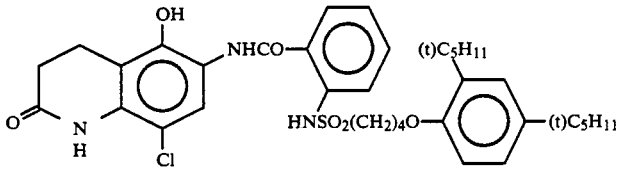
(C-15)
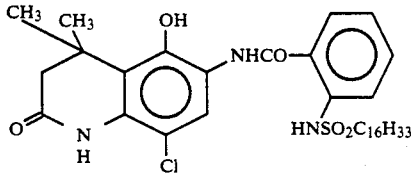
(C-16)
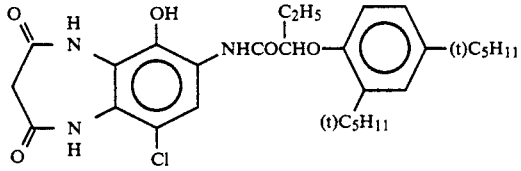
(C-17)
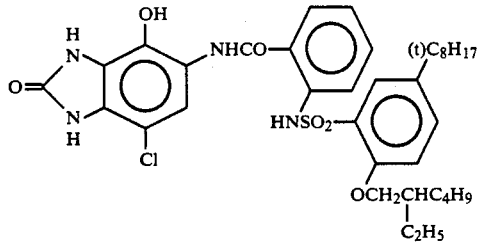
(C-18)
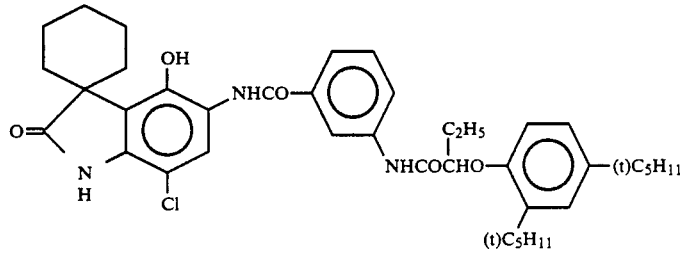

-continued
(C-19)
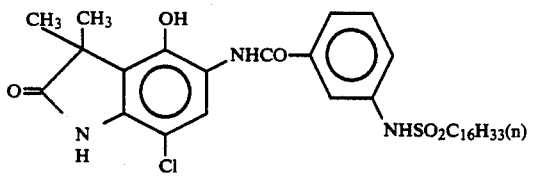
(C-20)
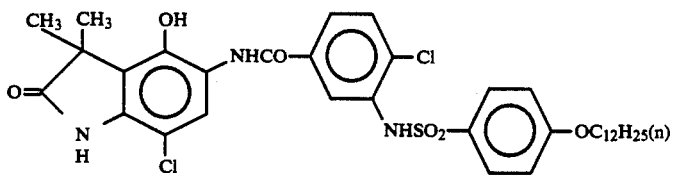
(C-21)
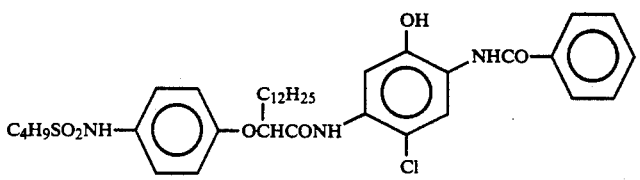
(C-22)
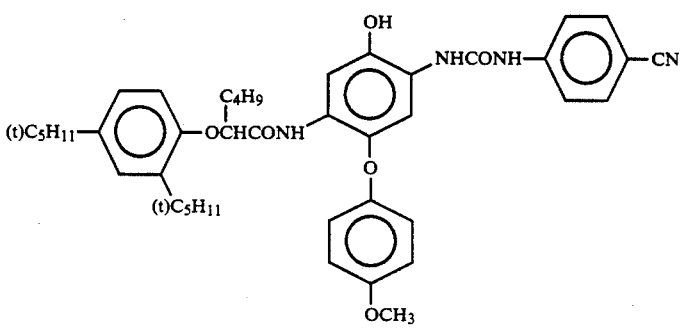
(M-1)
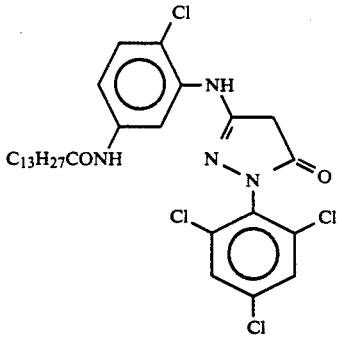
(M-2)
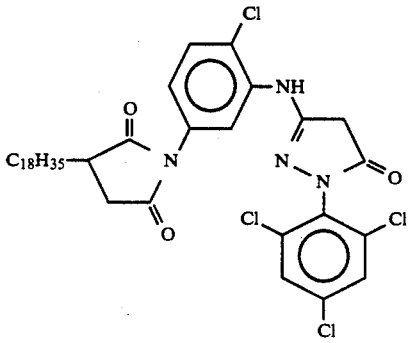

-continued
(M-3)
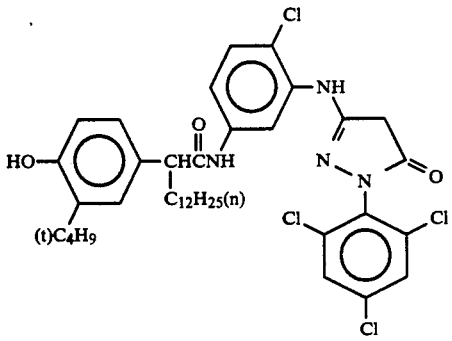
(M-4)
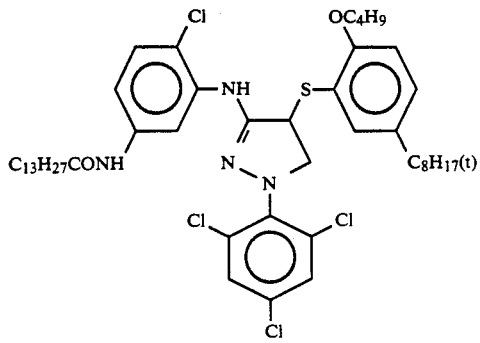
(M-5)
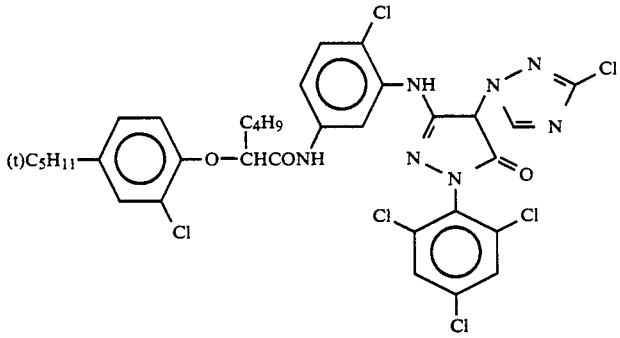
(M-6)
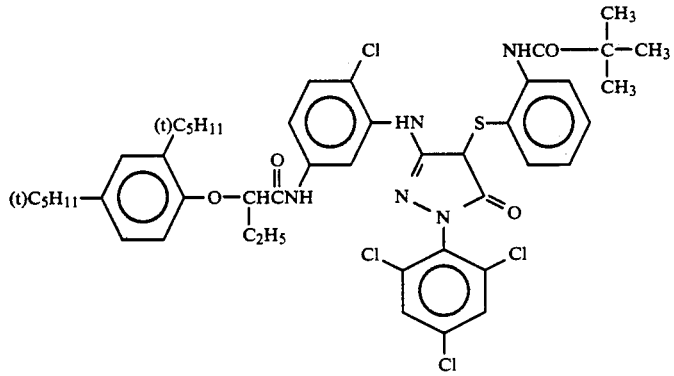

-continued
(M-7)
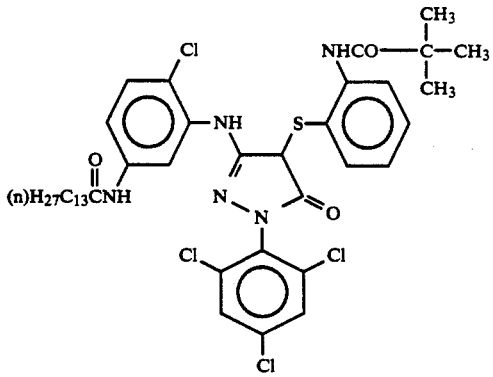
(M-8)
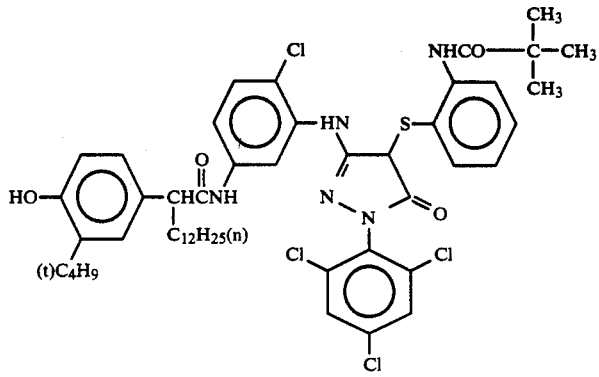
| Compound | $R_{10}$ | $R_{15}$ | $Y_4$ |
|---|---|---|---|
| | | 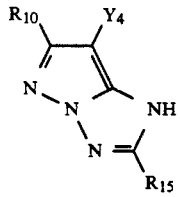 | |
| M-9 | $CH_3$— | 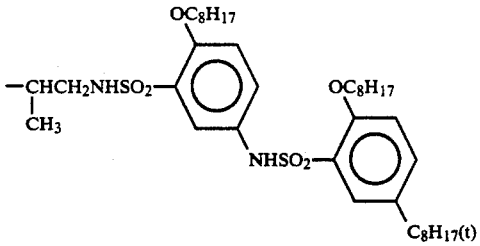 | Cl |
| M-10 | " | 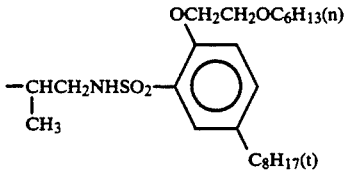 | " |
| M-11 | $(CH_3)_3C$— | 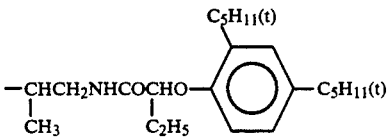 | 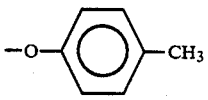 |

-continued
| Compound | $R_{10}$ | $R_{15}$ | $Y_4$ |
|---|---|---|---|
| M-12 | 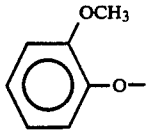 | 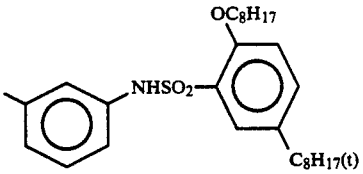 | 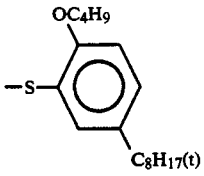 |
| M-13 | $CH_3$— | 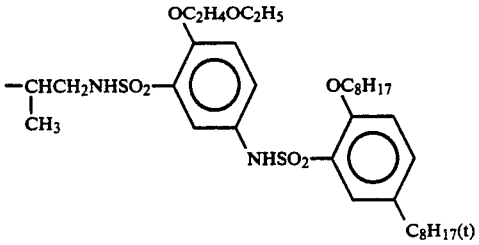 | Cl |
| M-14 | " | 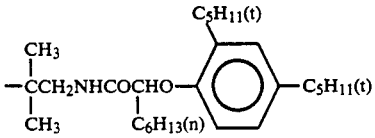 | " |
| M-15 | " | 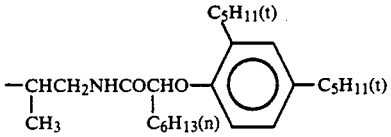 | " |
| M-16 | $CH_3$— | 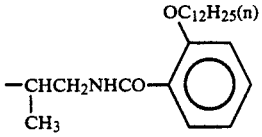 | Cl |
| M-17 | " | 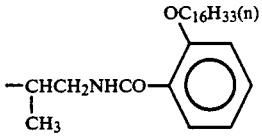 | " |
| M-18 | 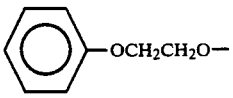 | 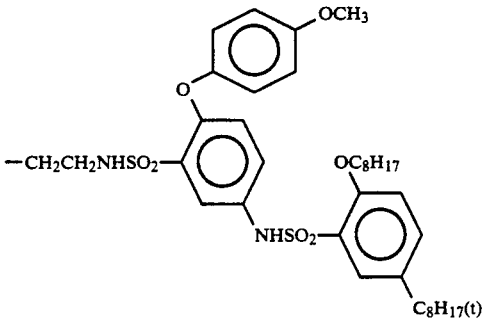 | 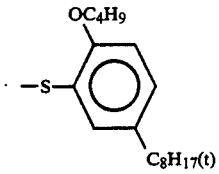 |
| M-19 | $CH_3CH_2O$— | " | " |

-continued
| Compound | $R_{10}$ | $R_{15}$ | $Y_4$ |
|---|---|---|---|
| M-20 | 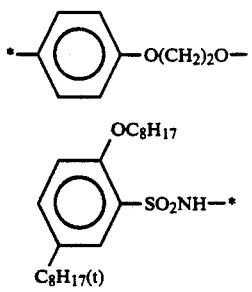 | 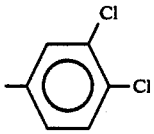 | 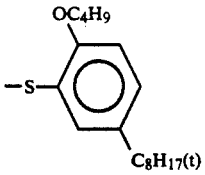 |
| M-21 | 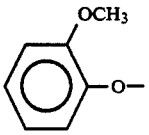 | 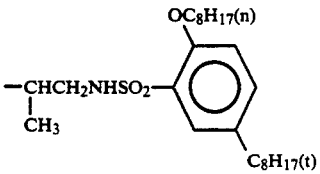 | Cl |
| | | 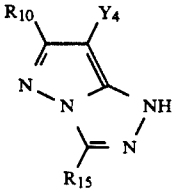 | |
| M-22 | $CH_3$— | 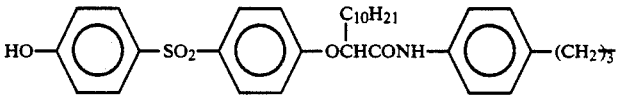 | Cl |
| M-23 | " | 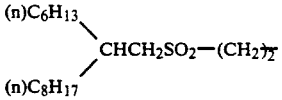 | " |
| M-24 | 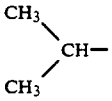 | 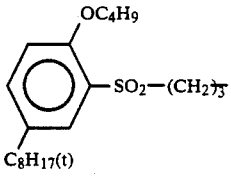 | " |
| M-25 | 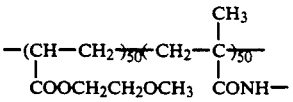 | 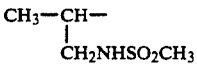 | " |
| M-26 | 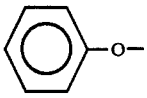 | 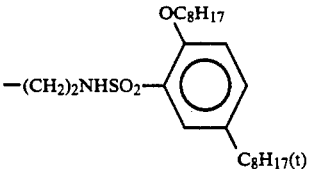 | Cl |
| M-27 | $CH_3$— | 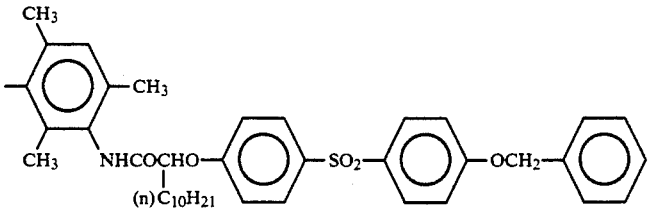 | " |

-continued
| Compound | $R_{10}$ | $R_{15}$ | $Y_4$ |
|---|---|---|---|
| M-28 | $(CH_3)_3C-$ | 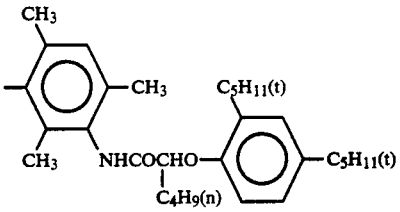 | " |
| M-29 | 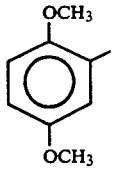 | 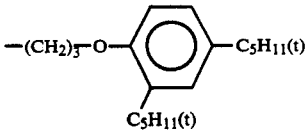 | Cl |
| M-30 | $CH_3-$ | 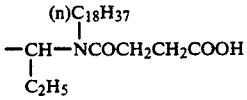 | " |
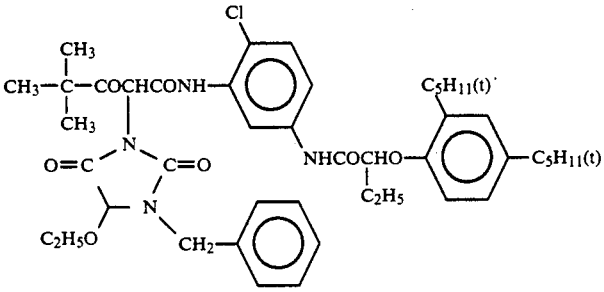
(Y-1)
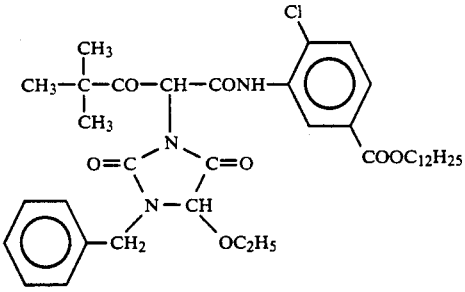
(Y-2)
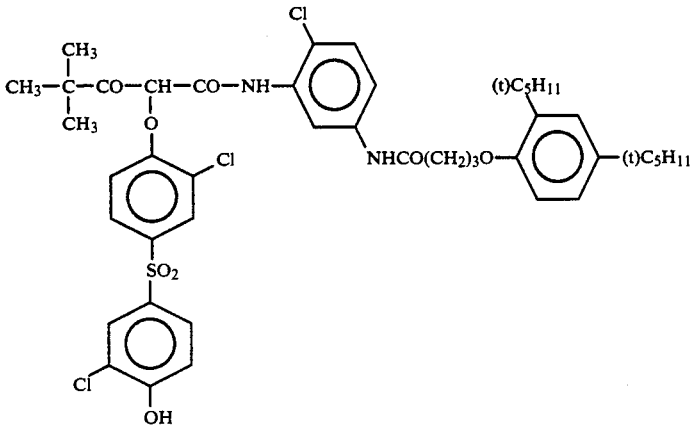
(Y-3)

-continued
(Y-4)
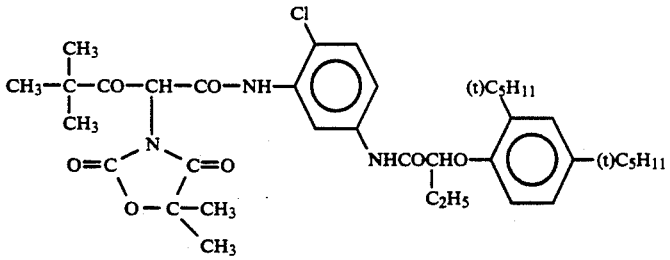
(Y-5)
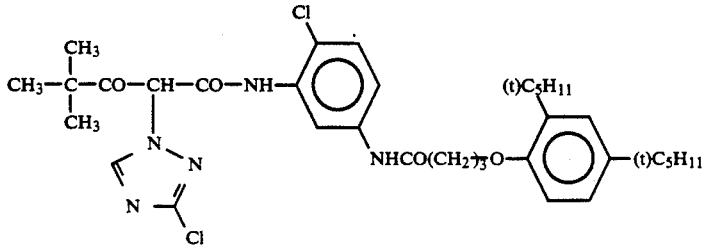
(Y-6)
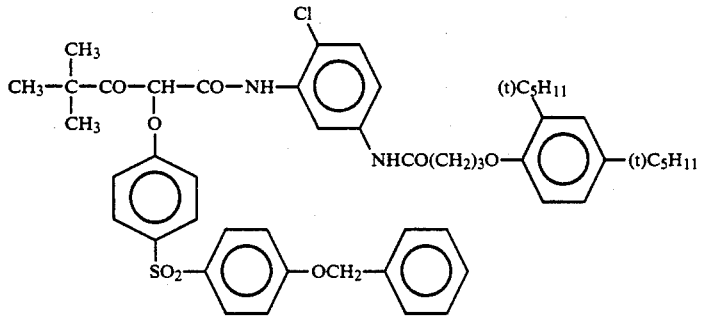
(Y-7)
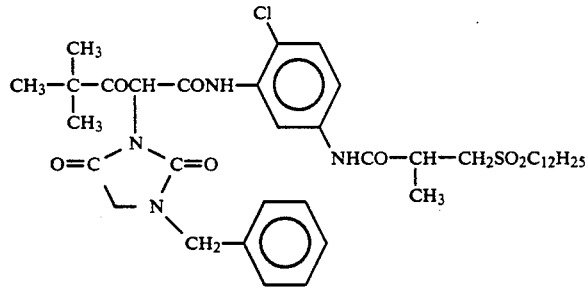
(Y-8)
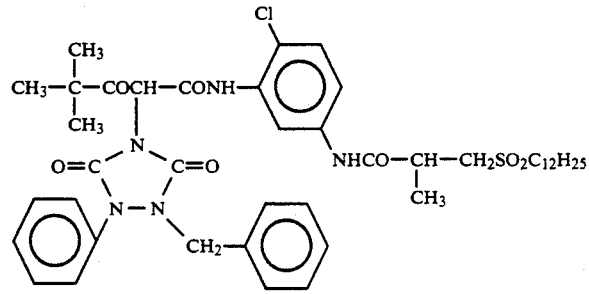

-continued

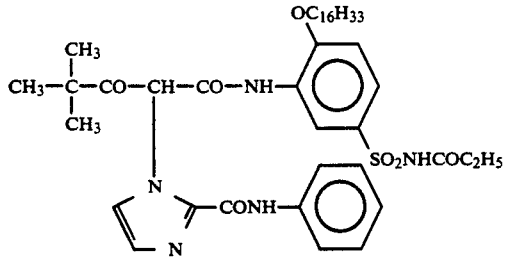

(Y-9)

The couplers represented by the formulae (C-I), (C-II), (M-I), (M-II) and (Y) are each incorporated into a silver halide emulsion layer of the light-sensitive material of the present invention in an amount of generally from 0.1 to 1.0 mol, preferably from 0.1 to 0.5 mol, per mol of silver halide contained in the same layer.

Various known techniques can be employed to incorporate the above described couplers into the light-sensitive layer. In general, the coupler-s can be incorporated by using an oil-in-water dispersion method known as the oil-protected method. This method comprises dissolving a coupler in a solvent, and dispersing the dissolved coupler into a surfactant-containing aqueous gelatin solution in the form of an emulsion; or adding water or an aqueous gelatin solution to a surfactant-containing coupler solution to thereby cause a phase inversion to occur forming an oil-in-water dispersion. In case of alkali-soluble couplers, on the other hand, Fischer's dispersion method can be used. After a low boiling organic solvent is removed from a coupler dispersion by distillation, noodle washing, ultrafiltration, etc., the resulting dispersion may be mixed with a photographic emulsion.

The dispersion medium for couplers as described above can advantageously include a high boiling point organic solvent having a dielectric constant of 2 to 20 (at 25° C.) and a refractive index of 1.5 to 1.7 (at 25° C.) and/or a water-insoluble high molecular weight compound.

High boiling point organic solvents which are preferably used include those represented by the following formulae (A), (B), (C), (D) and (E), respectively.

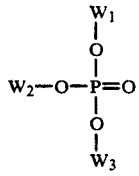

(A)

$W_1—COOW_2$ (B)

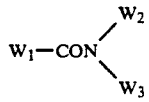

(C)

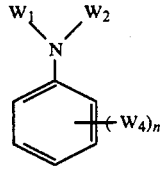

(D)

-continued $W_1—O—W_2$ (E)

In the above formulae, $W_1$, $W_2$ and $W_3$ each represents a substituted or unsubstituted alkyl, cycloalkyl, alkenyl, aryl or heterocyclic group; $W_4$ represents $W_1$, $—OW_1$ or $—SW_1$; n represents an integer of from 1 to 5, and when n is 2 or above, the $W_4$ groups may be the same or different; and furthermore, $W_1$ and $W_2$ in formula (E) may combine to form a condensed ring.

In addition to those represented by formulae (A) to (E), compounds which have a melting point of 100° C. or below and a boiling point of 140° C. or above, and are immiscible with water and are good solvents for the couplers can be also employed as the high boiling point organic solvent for use in the present invention. It is desirable that the high boiling point organic solvent for use in the present invention has a melting point of 80° C. or below, and a boiling point of 160° C. or above, particularly 170° C. or above.

Details of useful high boiling point organic solvents are described in JP-A-62-215272, from the right lower column on page 137 to the right upper column on page 144.

Another technique for incorporating the above described couplers into emulsion layers comprises impregnating a loadable latex polymer (as disclosed, e.g., in U.S. Pat. No. 4,203,716) with a coupler in the presence or the absence of a high boiling point organic solvent as described above, or dissolving the coupler in a polymer insoluble in water but soluble in an organic solvent, and then dispersing the resulting polymer into a hydrophilic colloid solution in an emulsified condition.

Polymers which are preferably used in the above described techniques include the homo- or copolymers disclosed in WO 88/00723, from page 12 to page 30. In particular, acrylamide type polymers are preferred over others for stabilization of the color images.

The photographic material prepared in accordance with the present invention may contain hydroquinone derivatives, aminophenol derivatives, gallic acid derivatives, ascorbic acid derivatives and the like as color fog inhibitors.

Various kinds of discoloration inhibitors can be used in the photographic material of the present invention. Typical examples of organic discoloration inhibitors suitable for cyan, magenta and/or yellow images include hindered phenols represented by hydroquinones, 6-hydroxychromans, 5-hydroxycoumarans, spirochromans, p-alkoxyphenols and bisphenols; gallic acid derivatives; methylenedioxybenzenes; aminophenols; hindered amines; and ether or ester derivatives obtained by silylating or alkylating the phenolic hydroxyl groups contained in the above described compounds, respectively. In addition, metal complexes represented by (bissalicylaldoxamato)nickel complex and (bis-N,N-dialkyldithiocarbamato)nickel complex can be also used for the above described purpose.

Specific examples of organic discoloration inhibitors are described in the following patent specifications.

Namely, hydroquinones are described, e.g., in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromans, 5-hydroxycoumarans and spirochromans are described, e.g., in U.S. Pat. Nos. 3,432,300, 3,573,050, 3,574,627, 3,698,909 and 3,764,337, and JP-A-52-152225; spiroindanes are described, e.g., in U.S. Pat. Nos. 4,360,589; p-alkoxyphenols are described, e.g., in U.S. Pat. Nos. 2,735,765, British Patent 2,066,975, JP-A-59-10539 and JP-B-57-19765; hindered phenols are described, e.g., in U.S. Pat. No. 3,700,455 JP-A-52-72224, U.S. Pat. No. 4,228,235 and JP-B-52-6623; gallic acid derivatives, methylenedioxybenzenes and aminophenols are described, e.g., in U.S. Pat. Nos. 3,457,079 and 4,332,886 and JP-B-56-21144, respectively; hindered amines are described, e.g., in U.S. Pat. Nos. 3,336,135 and 4,268,593, British Patents 1,326,889, 1,354,313 and 1,410,846, JP-B-52-1420, JP-A-58-114036, JP-A-59-53846 and JP-A-59-78344; and metal complexes are described, e.g., in U.S. Pat. Nos. 4,050,938 and 4,241,155, and British Patent 2,027,731(A). These compounds are generally each used in an amount of from 5 to 100 wt % based on the color couplers corresponding thereto, and emulsified together therewith, followed by incorporation into the respective light-sensitive layers. Introduction of an ultraviolet absorbent into a cyan color forming layer and both layers adjacent thereto is more effective for preventing cyan dye images from deteriorating due to heat, and light, in particular.

Examples of ultraviolet adsorbents useful for the above described purpose include aryl-substituted benzotriazole compounds (as disclosed, e.g., in U.S. Pat. No. 3,533,794), 4-thiazolidone compounds (as disclosed, e.g., in U.S. Pat. Nos. 3,314,794 and 3,352,681), benzophenone compounds (as disclosed, e.g., in JP-A-46-2784), cinnamate compounds (as disclosed, e.g., in U.S. Pat. Nos. 3,705,805 and 3,707,395), butadiene compounds (as disclosed, e.g., in U.S. Pat. No. 4,045,229), and benzoxidol compounds (as disclosed, e.g., in U.S. Pat. Nos. 3,406,070, 3,677,672 and 4,271,30{). Also, ultraviolet absorbing couplers (e.g., α-naphthol type cyan dye forming couplers) and ultraviolet absorbing polymers may be employed. These ultraviolet absorbents may be mordanted and thereby fixed in a particular layer.

Of these ultraviolet absorbents, the above described aryl-substituted benzotriazole compounds are preferred over other compounds.

The color developing solution for use in processing the photographic material of the present invention is preferably an aqueous alkaline solution mainly composed of aromatic primary amine color developing agents. Aminophenol compounds are useful as the color developing agent and p-phenylenediamine compounds are preferred as the color developing agent. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and salts thereof such as sulfate, hydrochloride and p-toluenesulfonate.

The developing agents may be used either alone or in a combination of two or more.

Generally, the color developing solution contains pH buffering agents such as alkali metal carbonates and phosphates, restrainers such as bromides, iodides, benzimidazoles, benzothiazoles and mercapto compounds and antifogging agents. If desired, the color developing solution may contain preservatives such as hydroxylamine, diethylhydroxylamine, sulfites, hydrazines such as N,N-biscarboxymethylhydrazine, phenylsemicarbacides, triethanolamine and catecholsulfonic acids; organic solvents such as ethylene glycol and diethylene glycol; development accelerators such as benzyl alcohol, polyethylene glycol, quaternary ammonium salts and amines; color forming couplers; competitive couplers; auxiliary developing agents such as 1-phenyl-3-pyrazolidone; tackifiers; and chelating agents such as polyaminocarboxylic acids, polyaminophosphonic acids, alkylphosphonic acids and phosphonocarboxzzzic acids, for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid) and salts thereof.

Generally, when reversal processing is to be conducted, black-and-white development and reversal processing are first carried out and color development is then carried out. The black-and-white developing solution may contain conventional developing agents such as dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in a combination of two or more.

The pH of the color developing solution and the black-and-white developing solution is generally in the range of 9 to 12. The replenishment rate of these developing solutions varies depending on the type of color photographic material being processed, but is usually not more than 3 liters per $m^2$ of the photographic material. The replenishment rate can be reduced to 500 ml or less when the concentration of bromide ion in the replenisher is reduced. When the replenishment is to be reduced, it is desirable that the contact area of the processing solution with air is reduced to prevent the solution from being evaporated or oxidized by air. The contact area of the processing solution in a processing tank with air can be represented by the opening ratio defined below.

$$\text{Opening Ratio} = \frac{\text{Contact Area (cm}^2\text{) of Processing Solution with Air}}{\text{Capacity (cm}^3\text{) of Processing Solution}}$$

The opening ratio is preferably not higher than 0.1, more preferably 0.001 to 0.05.

The opening ratio can be reduced by a method wherein a covering material such as a floating cover is provided on the surface of a photographic processing solution in a processing tank, a method using a movable cover as described in Japanese Patent Application No. 62-241342 or a slit development method as described in JP-A-63-216050.

It is preferred that the reduction of the opening ratio is applied to both the color development stage and the black-and-white development stage as well as subsequent stages such as all stages oz bleaching, bleaching-fixing, fixing, rinsing, stabilization, etc.

The replenishment rate can be reduced by using a means for inhibiting the accumulation of bromide ion in the developing solution.

The color development time is generally from 2 to 5 minutes. The processing time can be shortened by using the color developing agent at a higher concentration under higher temperature and higher pH conditions.

After color development, the photographic emulsion layers are generally bleached. bleaching may be carried out simultaneously with fixing (bleaching-fixing treatment) or separately carried out. After bleaching, a bleaching-fixing treatment may be conducted to expedite processing. Processing may be conducted in a bleaching-fixing bath composed of two consecutive baths. Fixing may be conducted before the bleaching-fixing treatment. After the bleaching-fixing treatment, bleaching may be conducted in accordance with the intended application. Examples of the bleaching agent include compounds of polyvalent metals such as iron(III). Typical examples of the bleaching agent include organic complex salts of iron(III) such as complex salts of polyaminocarboxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc.), citric acid, tartaric acid, malic acid, etc. Of them, iron(III) complex salts of polyaminocarboxylic acids such as (ethylenediaminetetraacetonato)iron(III) complex are preferred for rapid processing and prevention of environmental pollution. Furthermore, iron(III) complex salts of polyaminocarboxylic acids are useful for bleaching solutions and bleaching-fixing solutions. The pH of the bleaching solution containing the iron(III) complex salts of the polyaminocarboxylic acids and the bleaching-fixing solution containing said iron(III) complex salts is generally in the range of 5.5 to 8. A lower pH may be used to expedite processing.

If desired, the bleaching solution, the bleaching-fixing solution and the prebath thereof may contain bleaching accelerators. Examples of the bleaching accelerators include compounds having a mercapto group or a disulfide bond as described in U.S. Pat. No. 3,893,858, German Patent 1,290,812, JP-A-53-95630 and *Research Disclosure,* No. 17129 (July, 1978), thiazolidine derivatives as described in JP-A-50-140129, thiourea derivatives as described in U.S. Pat. No. 3 706,561, iodides as described in JP-A-58-16235, polyoxyethylene compounds as described in West German Patent 2,748,430, polyamine compounds as described in JP-B-45-8836, and bromide ion. Of these, the compounds having a mercapto group or a disulfide group are preferred for their high accelerating effect. Particularly, the compounds described in U.S. Pat. No. 3,893,858, West German Patent 1,290,812 and JP-A-53-95630 are preferred Furthermore, the compounds described in U.S. Pat. No. 4,552,834 are preferred. These bleaching accelerators may also be incorporated into the photographic material. The bleaching accelerators are particularly effective in conducting the bleaching-fixing of the color photographic material for photographing.

Examples of fixing agents include thiosulfates, thiocyanates, thioether compounds, thiourea, and various iodides. The thiosulfates are widely used as the fixing agent. Particularly, ammonium thiosulfate is most widely used. Sulfites, bisulfites, sulfinic acids such as p-toluenesulfinic acid and carbonyl bisulfite adducts are preferred as preservatives for the bleaching-fixing solution.

Usually, the silver halide color photographic material of the present invention is subjected to washing and/or a stabilization stage after desilverization. The amount of rinsing water in the washing stage widely varies depending on the characteristics (e.g., depending on materials used such as couplers) of the photographic material, application, the temperature of the rinsing water, the number of rinsing tanks (the number of stages), the replenishing system (countercurrent, direct flow) and other conditions. The relationship between the amount of water and the number of rinsing tanks in the multistage countercurrent system can be determined by the method described in *Journal of the Society of Motion Picture and Television Engineers,* Vol. 64, pages 248 to 253 (May, 1955).

According to the multistage countercurrent system described in the above literature, the amount of rinsing water can be greatly reduced. However, the residence time of water in the tanks is prolonged and, as a result, bacteria proliferate, and the resulting suspended matter is deposited on the photographic material. A method for reducing calcium ion and magnesium ion described in JP-A-62-288838 can be effectively used for processing the color photographic material of the present invention to solve the above described problem. Furthermore, isothiazolone compounds, thiabendazole compounds, chlorine-containing germicides such as sodium chlorinated isocyanate and benzotriazole described in JP-A-57-8542 and germicides described in Hiroshi Horiguchi, *Chemistry of Germicidal Antifungal Agent,* Sankyo Shuppan (1986); *Sterilization, Disinfection, Antifungal Technique,* edited by Sanitary Technique Society (1982); and *Antibacterial and Antifungal Encyclopedia,* edited by Nippon Antibacterial Antifungal Society (1986); can be used.

The pH of rinsing water in the treatment of the photographic material of the present invention is in the range of 4 to 9, preferably 5 to 8. The temperature of rinsing water and washing time vary depending on the characteristics of the photographic material, application, etc., but the temperature and time of washing are generally 15° C. to 45° C. for 20 seconds to 10 minutes, preferably 25° C. to 40° C. for 30 seconds to 5 minutes. The photographic material of the present invention may be processed directly with a stabilizing solution in place of rinsing water. Such stabilizing treatment can be carried out by conventional methods described in JP-A-57-8543, JP-A-58-14834 and JP-A-60-220345.

A stabilizing treatment subsequent to the rinsing may be conducted. The stabilizing treatment may be used as the final bath for a color photographic material for photographing. An example thereof includes a stabilizing bath containing formalin and a surfactant. The stabilizing bath may contain various chelating agents and antifungal agents.

Overflow solution from the replenishment of rinsing water and/or stabilizing can be reused in other stages such as the desilverization stage.

A color developing agents may be incorporated into the silver halide color photographic material of the present invention for the purpose of simplifying and expediting processing. It is preferred that a precursor for the color developing agent is incorporated into the photographic material for this purpose. Examples of the precursors include the indoaniline compounds described in U.S. Pat. No. 3,342,597; Schiff base silver compounds described in U.S. Pat. No. 3,342,599, *Research Disclosure*, No. 14850 and ibid., No. 15159; aldol compounds described in *Research Disclosure*, No. 13924; metal complex salts described in U.S. Pat. No. 3,719,492; and urethane compounds described in JP-A-53-135628.

If desired, 1-phenyl-3-pyrazolidones may be incorporated into the silver halide color photographic material of the present invention for the purpose of accelerating color development. Typical examples of the compounds include those described in JP-A-56-64339, JP-A-57-144547 and JP-A-58-115438.

In the present invention, various processing solutions are used at a temperature of 10° C. to 50° C. Generally, a temperature of 33° C. to 38° C. is used. However, higher processing temperatures can be used to accelerate processing and to shorten processing time, while lower temperatures can be used to improve image quality and to improve the stability of the processing solutions. If desired, treatments using cobalt intensification or hydrogen peroxide intensification as described in West German Patent 2,226,770 and U.S. Pat. No. 3,674,499 can be used to conserve silver.

The present invention is illustrated in greater detail by reference to the following examples which, however, are not to be construed as limiting the present invention in any way.

EXAMPLE 1

A water resistant resin layer of 30 μm was formed on the surface of white base paper composed of 100% LBKP (hardwood bleached sulfate pulp) for photographic paper by coating in the following manner. Titanium dioxide powder was immersed in an ethanol solution of 2,4-dihydroxy-2-methylpentane and the solution was heated to evaporate ethanol, thus treating the surface of the powder. 89 parts by weight of a polyethylene composition (density: 0.920 g/cc, melt index (MI): 5.0 g/10 min) and 14% by weight based on the weight of the polyethylene composition of the resulting surface-treated anatase type titanium dioxide pigment were mixed, and the mixture was kneaded and then melt-extruded to thereby form a water resistant resin layer on the surface of white base paper. Further, a water resistant resin layer comprising a polyethylene composition was provided on the back of white base paper to obtain a support.

The thus obtained paper support (both sides being laminated as described above) was then coated with the following layers to prepare a multilayer color photographic material having the following layer structure as Sample (0). Coating solutions were prepared in the following manner.

Preparation of Coating Solution for First Layer 19.1 g of a yellow coupler (ExY), 4.4 g of a dye image stabilizer (Cpd-1) and 0.7 g of a dye image stabilizer (Cpd-7) were dissolved in 27.2 ml of ethyl acetate and 8.2 g of a solvent (Solv-1), and then dispersed in an emulsified condition into 185 ml of a 10 wt % aqueous gelatin solution containing 8 ml of a 10 wt % solution of sodium dodecylbenzenesulfonate. On the other hand, the following blue-sensitive sensitizing dyes were added to a silver chlorobromide emulsion (a cubic 3/7 (by mol Ag) mixture of a large size emulsion having a mean grain size of 0.88 μm and a small size emulsion having a mean grain size of 0.70 μm, a coefficient of variation in grain size distribution: 0.08 and 0.10, respectively, 0.2 mol % of silver bromide being localized on the surface of the grains in each of the two component emulsions). The spectral sensitizing dyes below were used in an amount such that $2.0\times10^{-4}$ mol of each of the blue-sensitive sensitizing dyes was added to the larger size emulsion and $2.5\times10^{-4}$ mol of each of the dyes was added to the smaller size emulsion, each amount being per mol of silver The mixture was then subjected to sulfur sensitization.

The above emulsified dispersion and the silver chlorobromide emulsion were mixed and dissolved. A coating solution for the first layer was prepared having the composition set forth below.

The coating solutions for the second layer to the seventh layer were prepared, respectively, in the same manner as the coating solution for the first layer In each layer, the sodium salt of 1-oxy-3,5-dichloro-s-triazine was used as hardener for gelatin in a total amount of 0.097 g/m$^2$.

The following spectral sensitizing dyes for the silver chlorobromide emulsion of each layer were used.

Blue-Sensitive Emulsion Layer

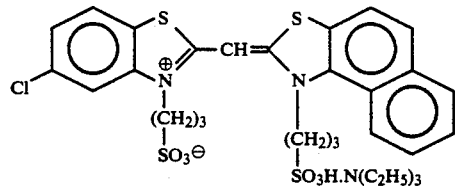

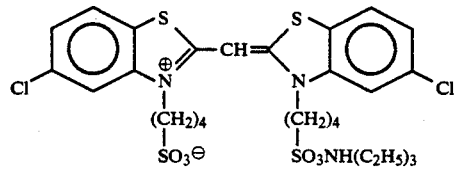

(both were added to the larger grain size emulsion in an amount of $2.0\times10^{-4}$ mol/mol of silver halide, and to the smaller grain size emulsion in an amount of $2.5\times10^{-4}$ mol/mol of silver halide)

Green-Sensitive Emulsion Layer

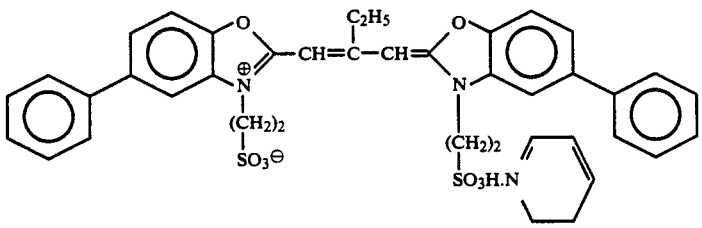

added to the larger grain size emulsion in an amount of $4.0\times10^{-4}$ mol/mol of silver halide, and to the smaller grain size emulsion in an amount of $5.6\times10^{-4}$ mol/mol of silver halide) and

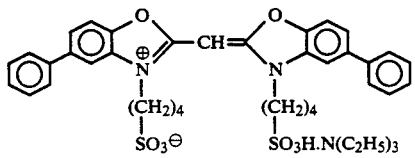

(added to the larger grain size emulsion in an amount of $7.0\times10^{-5}$ mol/mol of silver halide, and to the smaller grain size emulsion in an amount of $1.0\times10^{-5}$ mol/mol of silver halide)

Red-Sensitive Emulsion Layer

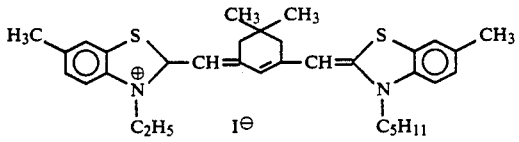

(added to the larger grain size emulsion in an amount of $0.9\times10^{-4}$ mol/mol of silver halide, and to the smaller grain size emulsion in an amount of $1.1\times10^{-4}$ mol/mol of silver halide)

The following compound was added to the red-sensitive emulsion layer in an amount of $2.6\times10^{-3}$ mol per mol of silver halide:

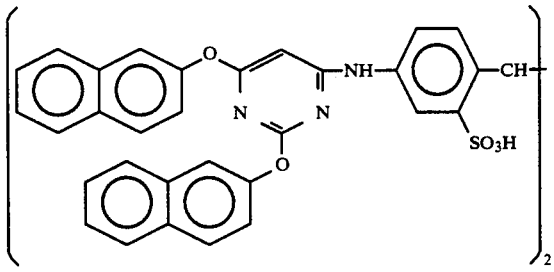

Moreover, 4-hydroxy-6-methyl-1,3,3a,7-tetraazaindene was added to the blue-sensitive emulsion layer and the green-sensitive emulsion layer in amounts of $1\times10^{-4}$ mol and $2\times10^{-4}$ mol, respectively, per mol of silver halide.

Layer Structure

The composition of each layer is described below. Each figure on the right side represents the coverage ($g/m^2$) of the ingredient indicated. The figure shown for the silver halide emulsion represents the coverage based on silver.

| | |
|---|---|
| Support: | |
| Polyethylene-Laminated Paper (polyethylene on the side of the first layer contains white pigment ($TiO_2$) and bluish dye (ultramarine)) | |
| First Layer (blue-sensitive layer): | |
| Silver Chlorobromide Emulsion Described Above | 0.32 |
| Gelatin | 1.86 |
| Yellow Coupler (ExY) | 0.82 |
| Dye Image Stabilizer (Cpd-1) | 0.19 |
| Solvent (Solv-1) | 0.35 |
| Dye Image Stabilizer (Cpd-7) | 0.06 |
| Second Layer (color mixing inhibiting layer): | |
| Gelatin | 0.99 |
| Color Mixing Inhibitor (Cpd-5) | 0.08 |
| Solvent (Solv-1) | 0.16 |
| Solvent (Solv-4) | 0.08 |
| Third Layer (green-sensitive layer): | |
| Silver Chlorobromide Emulsion (having a cubic form, and being a ⅓ (by mol Ag) mixture of an emulsion having an average grain size of 0.55 μm and a variation coefficient of 0.10 with respect to grain size distribution with an emulsion having an average grain size of 0.39 μm and a variation coefficient of 0.08 with respect to grain size distribution, each of which contained 0.8 mol % of AgBr localized at the grain surface) | 0.18 |
| Gelatin | 1.24 |
| Magenta Coupler (ExM) | 0.20 |
| Dye Image Stabilizer (Cpd-3) | 0.15 |
| Dye Image Stabilizer (Cpd-9) | 0.02 |
| Solvent (Solv-2) | 0.40 |
| Fourth Layer (ultraviolet absorbing layer): | |
| Gelatin | 1.58 |
| Ultraviolet Absorbent (UV-1) | 0.47 |
| Color Mixing Inhibitor (Cpd-5) | 0.05 |
| Solvent (Solv-5) | 0.24 |
| Fifth Layer (red-sensitive layer): | |
| Silver Chlorobromide Emulsion (having a cubic form, and being a ¼ (by mol Ag) mixture of an emulsion having an average grain size of 0.58 μm and a variation coefficient of 0.09 with respect to grain size distribution with an emulsion having an average grain size of 0.45 μm and a variation coefficient of 0.11 with respect to grain size distribution, each of which contained 0.6 mol % of AgBr localized at the grain surface) | 0.28 |
| Gelatin | 1.34 |
| Cyan Coupler (ExC) | 0.32 |
| Dye Image Stabilizer (Cpd-6) | 0.17 |
| Dye Image Stabilizer (Cpd-7) | 0.40 |
| Dye Image Stabilizer (Cpd-8) | 0.04 |
| Solvent (Solv-6) | 0.15 |
| Sixth Layer (ultraviolet absorbing layer): | |
| Gelatin | 0.53 |
| Ultraviolet Absorbent (UV-1) | 0.16 |
| Color Mixing Inhibitor (Cpd-5) | 0.02 |
| Solvent (Solv-5) | 0.08 |
| Seventh Layer (protective layer): | |
| Gelatin | 1.33 |
| Acryl-Modified Polyvinyl Alcohol Copolymer (modification degree: 17%) | 0.17 |
| Liquid Paraffin | 0.03 |

(ExY) Yellow Coupler

-continued

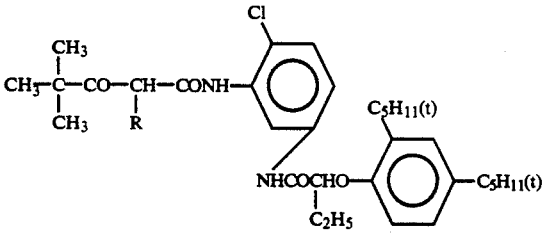

1/1 (by mol)
mixture where R =

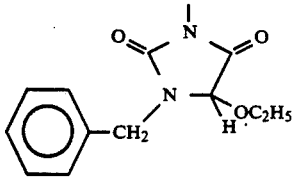

and where R =

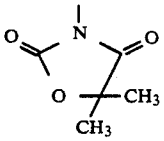

(ExM) Magenta Coupler
1/1 (by mol) mixture of

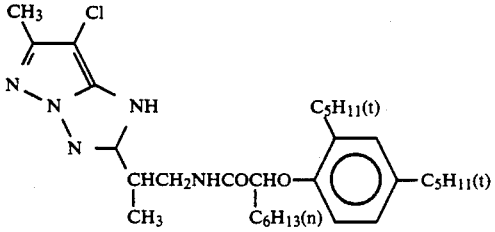

with

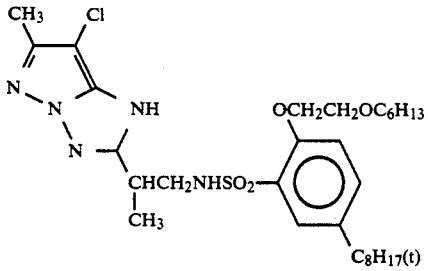

(ExC) Cyan Coupler

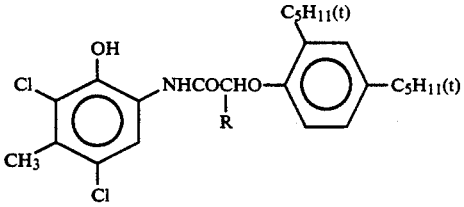

2/4/4 (by weight) mixture of that of R = $C_2H_5$,
to that of R = $C_4H_9$,

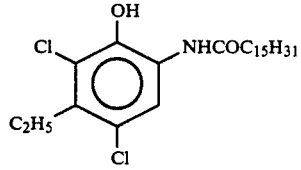

to

-continued (Cpd-1) Dye Image Stabilizer

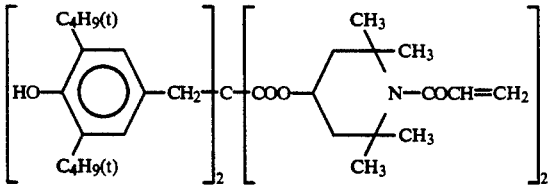

(Cpd-3) Dye Image Stabilizer

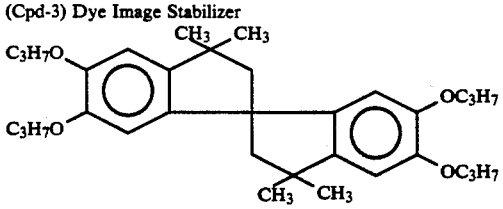

(Cpd-5) Color Mixing Inhibitor

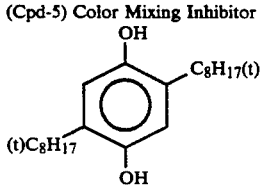

(Cpd-6) Dye Image Stabilizer
2/4/4 (by weight) mixture of

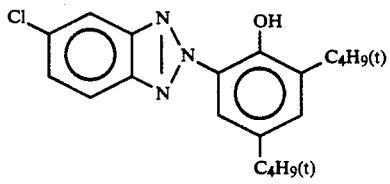

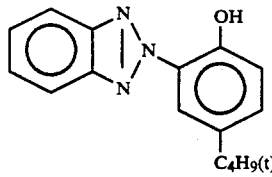

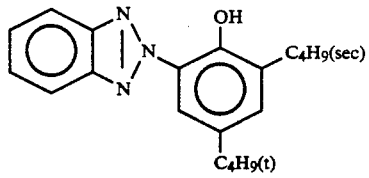

(Cpd-7) Dye Image Stabilizer $-(CH_2-CH)_n-$
$\quad\quad\quad |$
$\quad\quad CONHC_4H_9(t)$ Average molecular weight: 60,000

(Cpd-8) Dye Image Stabilizer
1/1 (by weight) mixture of

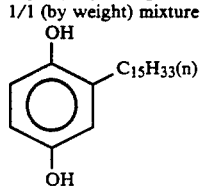

and

-continued

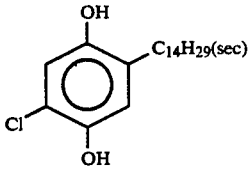

(Cpd-9) Dye Image Stabilizer

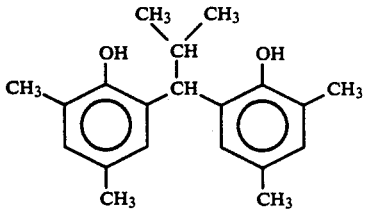

(UV-1) Ultraviolet Absorbent
4/2/4 (by weight) mixture of

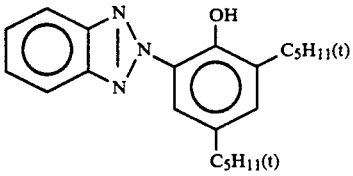

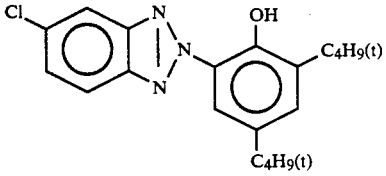

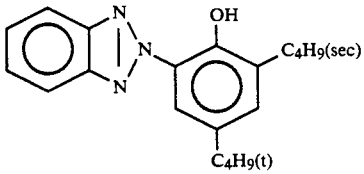

(Solv-1) Solvent

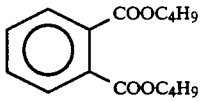

(Solv-2) Solvent
2/1 (by volume) mixture of

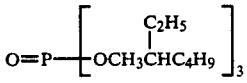

and

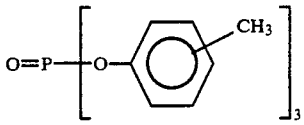

(Solv-4) Solvent

-continued

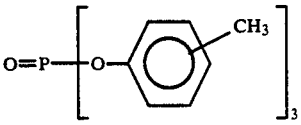

(Solv-5) Solvent

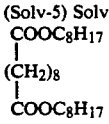

(Solv-6) Solvent
95/5 (by volume) mixture of

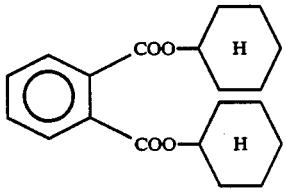

and

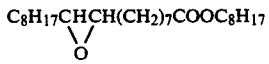

Samples (1) to (25) were prepared in the same manner as sample (0), except that the amount of titanium dioxide in the polyethylene on the first layer side was changed as indicated in Table 1; the dye (added to the Sixth Layer) for controlling the optical reflection density was changed in kind and amount as indicated in Table 1; and the amount and kind of the compounds represented by formulae (I) to (III) (added to the emulsified dispersion during the preparation of the Third Layer) were changed as indicated in Table 1.

The dry thickness of the photographic layers of each of Samples (0) to (25) was 10.5 μm before processing after the samples were stored at 25° C and humidity of 55% for 3 hours, and the swollen thickness thereof was 16.0 μm after the samples were immersed in the color developing solution described below for 60 seconds. In Samples (7) and (8), the amounts of the emulsions in the First layers and the Fifth Layers were changed by an equal amount so that the coating weights of the emulsions in these samples were 0.85 g/m$^2$ and 0.70 g/m$^2$ in terms of silver, respectively.

Each of the samples shown in Table 1 above was subjected to gradation exposure for sensitometry through color filters, i.e., a blue, green or red filter, by means of a sensitometer (Model FWH, produced by Fuji Photo Film Co., Ltd., equipped with a light source having a color temperature of 3,200° K.). The exposure time was set to 0.1 sec, and the exposure was controlled to 250 CMS.

After exposure, each sample was subjected to photographic processing including color development, bleaching-fixing and stabilization steps. The processing was carried out by a continuous processing (running test) until an amount of the replenisher used was twice the volume of the color developing tank. A change in photographic characteristics before and after the continuous processing (running test) was evaluated.

| Processing Step | Temperature (°C.) | Time (sec) | Amount of* Replenisher (ml) | Tank Volume (l) |
|---|---|---|---|---|
| Color Development | 35 | 45 | 161 | 17 |
| Bleaching-Fixing | 30–36 | 45 | 215 | 17 |
| Rinse I | 30–37 | 20 | — | 10 |
| Rinse J | 30–37 | 20 | — | 10 |
| Rinse K | 30–37 | 20 | — | 10 |
| Rinse L | 30–37 | 30 | 248 | 10 |
| Drying | 70–80 | 60 | | |

*per $m^2$ of photographic material (Four tank countercurrent system from Rinse L to Rinse I was used)

The composition of each processing solution used is described below:

| Color Developing Solution: | Tank Solution | Replenisher |
|---|---|---|
| Water | 800 ml | 800 ml |
| Ethylenediaminetetraacetic Acid | 2.0 g | 2.0 g |
| 5,6-Dihydroxybenzene-1,2,4-trisulfonic Acid | 0.3 g | 0.3 g |
| Triethanolamine | 8.0 g | 8.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| Diethylhydroxylamine | 4.2 g | 6.0 g |
| Fluorescent Brightener (4,4'-diaminostilbene type) | 2.0 g | 2.5 g |
| Water to make | 1,000 ml | 1,000 ml |
| pH (25° C.) adjusted to | 10.05 | 10.45 |

| Bleach-Fix Bath (Tank solution and Replenisher is the same): | |
|---|---|
| Water | 400 ml |
| Ammonium Thiosulfate (70 wt % aq. soln.) | 100 ml |
| Sodium Sulfite | 17 g |
| Ammonium Ethylenediaminetetraacetato-ferrate(III) | 55 g |
| Disodium Ethylenediaminetetraacetate | 5 g |
| Glacial Acetic Acid | 9 g |
| Water to make | 1,000 ml |
| pH (25° C.) adjusted to | 5.40 |

-continued

| Stabilizing Bath (Tank solution and Replenisher is the same): | |
|---|---|
| Formaldehyde (37 wt % aq. soln.) | 0.1 g |
| Formaldehye-Sulfite Adduct | 0.7 g |
| 5-Chloro-2-methyl-4-isothiazoline-3-one | 0.02 g |
| 2-Methyl-4-isothiazoline-3-one | 0.01 g |
| Copper Sulfate | 0.005 g |
| Water to make | 1,000 ml |
| pH (25° C.) adjusted to | 4.0 |

The sharpness was evaluated using the CTF value where CTF represents an attenuation degree of the amplitude against the spatial frequency assuming the shape of the waves is a square. The sharpness at a spatial frequency of 15 lines/mm is shown. The sharpness is higher the greater the CTF value.

The change of photographic characteristics before and after continuous processing is represented by a change in terms of sensitivity and gradation. The change of sensitivity is represented by a change (ΔS) in exposure amount giving a density of 0.5 before and after continuous processing. The change of gradation is represented by a change (Δ(ΔlogE)) in a difference (ΔlogE) between the exposure amount providing a density of 1.5 and exposure amount providing a density of 0.5 before and after continuous processing.

Stain was evaluated by measuring a change in the white unexposed areas with the density of white light after the continuously processed samples were stored at 60° C. and humidity of 70% for 7 days.

Typical results are shown in Table 2. With regard to CTF, the results are those obtained by exposing to red light. With regard to the change in photographic characteristics upon continuous processing, the results are those obtained by exposing to green light.

TABLE 1

| Sample No. | Titanium Dixide Content (wt %) | Kind and Coating Weight of Dye (mg/$m^2$) | Optical Reflection Density at 680 nm | Kind and Coating Weight of Compound of Formula (I) (g/$m^2$) | Kind and Coating Weight of Compound of Formula (II) (g/$m^2$) | Kind and Coating Weight of Compound of Formula (III) (g/$m^2$) |
|---|---|---|---|---|---|---|
| 1 | 10 | a-27 (11.0) | 0.50 | — | — | — |
| 2 | " | a-27 (20.5) | 0.70 | — | — | — |
| 3 | " | " | " | Ia-31 (0.20) | — | IIIa-3 (0.20) |
| 4 | " | a-27 (39.0) | 1.00 | " | — | " |
| 5 | " | " | " | — | — | — |
| 6 | 14 | a-27 (20.5) | 0.70 | Ia-31 (0.20) | — | IIIa-3 (0.20) |
| 7 | " | " | " | " | — | " |
| 8 | " | " | " | " | — | " |
| 9 | " | " | " | Ia-31 (0.10) | — | " |
| 10 | " | " | " | Ia-31 (0.30) | — | " |
| 11 | " | " | " | Ia-31 (0.20) | — | IIIa-3 (0.10) |
| 12 | " | " | " | " | — | IIIa-3 (0.30) |
| 13 | " | a-27 (14.4)<br>a-18 (6.3) | " | " | — | IIIa-3 (0.20) |
| 14 | 14 | a-18 (21.0) | 0.70 | Ia-31 (0.20) | — | IIIa-3 (0.20) |
| 15 | " | a-27 (20.5) | " | Ia-36 (0.20) | — | " |
| 16 | " | " | " | Ia-38 (0.20) | — | " |
| 17 | " | " | " | Ia-43 (0.20) | — | " |
| 18 | " | " | " | Ia-31 (0.20) | — | IIIa-6 (0.20) |
| 19 | " | " | " | — | IIa-3 (0.20) | " |
| 20 | " | " | " | — | — | " |
| 21 | " | " | " | — | — | IIIa-6 (0.40) |
| 22 | " | " | " | Ia-31 (0.20) | — | — |
| 23 | " | " | " | Ia-31 (0.40) | — | — |
| 24 | 20 | " | " | Ia-31 (0.20) | — | IIIa-6 (0.20) |
| 25 | " | a-27 (11.0) | 0.50 | " | | " |

TABLE 2

| Sample No. | CTF (R) | Stain (G) | Change by Processing: Change in Sensitivity | Change by Processing: Change in Gradation | Note |
|---|---|---|---|---|---|
| 1 | 0.01 | 0.26 | −0.02 | 0.05 | Comparison |
| 2 | 0.10 | 0.27 | −0.04 | 0.06 | " |
| 3 | 0.10 | 0.10 | −0.06 | 0.08 | " |
| 4 | 0.13 | 0.10 | −0.06 | 0.09 | " |
| 5 | 0.13 | 0.25 | −0.04 | 0.06 | " |
| 6 | 0.27 | 0.08 | −0.04 | 0.06 | Invention |
| 7 | 0.27 | 0.08 | −0.10 | 0.20 | Comparison |
| 8 | 0.28 | 0.06 | −0.03 | 0.05 | Invention |
| 9 | 0.27 | 0.08 | −0.04 | 0.06 | " |
| 10 | 0.28 | 0.07 | −0.04 | 0.06 | " |
| 11 | 0.27 | 0.07 | −0.04 | 0.06 | " |
| 12 | 0.27 | 0.07 | −0.04 | 0.06 | " |
| 13 | 0.25 | 0.06 | −0.05 | 0.07 | " |
| 14 | 0.24 | 0.06 | −0.04 | 0.06 | " |
| 15 | 0.27 | 0.08 | −0.04 | 0.06 | " |
| 16 | 0.27 | 0.08 | −0.05 | 0.08 | " |
| 17 | 0.27 | 0.07 | −0.04 | 0.08 | " |
| 18 | 0.27 | 0.06 | −0.04 | 0.08 | " |
| 19 | 0.27 | 0.08 | −0.04 | 0.08 | " |
| 20 | 0.27 | 0.15 | −0.04 | 0.08 | Comparison |
| 21 | 0.27 | 0.17 | −0.04 | 0.08 | " |
| 22 | 0.28 | 0.15 | −0.04 | 0.07 | Comparison |
| 23 | 0.27 | 0.16 | −0.05 | 0.09 | " |
| 24 | 0.32 | 0.06 | −0.04 | 0.08 | Invention |
| 25 | 0.13 | 0.06 | −0.04 | 0.08 | Comparison |

It is clearly seen that the effects of the present invention are only obtained using the silver halide color photographic material of the present invention. The photographic material of the present invention provides excellent sharpness and substantially does not exhibit an increase in stain even when stored over a long period of time after processing. Moreover, the silver halide color photographic material of the present invention substantially does not exhibit a change in sensitivity and gradation even when continuously processed.

EXAMPLE 2

Samples (26) to (36) were prepared in the same manner as Sample (6) of Example 1, except that the layer thickness, the coating weight (in terms of silver) and the amounts of gelatin and hardening agent of each layer were changed to those indicated in Table 3. These samples were evaluated using the same methods as employed in Example 1. The results obtained are shown in Table 4.

It is apparent from the above results that only a silver halide photographic material of the present invention having a total silver coverage (coating weights in terms of silver) of not more than 0.78 g/m$^2$ and a swollen layer thickness immersed in the color developing solution of at least 1.4 times the dry layer thickness, exhibits excellent sharpness and substantially does not exhibit an increase in stain even when stored over a long period of time after processing. Moreover, the photographic material of the present invention substantially does not exhibit a change in sensitivity and gradation before and after continuous processing.

TABLE 3

| Sample No. | Amount of Coated Gelatin (g/m$^2$): First Layer | Amount of Coated Gelatin (g/m$^2$): Third Layer | Amount of Coated Gelatin (g/m$^2$): Fifth Layer | Coating Weight of Silver (g/m$^2$): First Layer | Coating Weight of Silver (g/m$^2$): Third Layer | Coating Weight of Silver (g/m$^2$): Fifth Layer | Coating Weight of Total Hardening Agent Based on That of Sample (6) | Dry Layer Thickness (μm) | Swollen Layer Thickness (μm) | Swelling Ratio |
|---|---|---|---|---|---|---|---|---|---|---|
| 26 | 1.86 | 1.24 | 1.34 | 0.32 | 0.18 | 0.28 | × 1.0 | 10.5 | 16.0 | 1.52 |
| 27 | " | " | " | " | " | " | × 1.1 | 10.3 | 14.5 | 1.41 |
| 28 | " | " | " | " | " | " | × 1.2 | 10.4 | 12.8 | 1.23 |
| 29 | " | " | " | " | " | " | × 0.8 | 10.6 | 23.2 | 2.19 |
| 30 | " | " | " | " | " | " | × 0.6 | 10.6 | 28.6 | 2.70 |
| 31 | " | " | " | 0.35 | " | 0.32 | " | 10.6 | 29.0 | 2.73 |
| 32 | " | " | " | 0.35 | " | 0.38 | " | 10.8 | 29.5 | 2.73 |
| 33 | " | " | " | 0.29 | " | 0.23 | " | 10.8 | 30.2 | 2.80 |
| 34 | 2.16 | 1.49 | 1.55 | 0.32 | 0.18 | 0.28 | × 1.1 | 11.5 | 17.3 | 1.50 |
| 35 | 2.60 | 1.74 | 1.87 | " | " | " | × 1.2 | 13.0 | 19.0 | 1.46 |
| 36 | " | " | " | " | " | " | × 1.5 | 12.9 | 16.8 | 1.30 |

TABLE 4

| Sample No. | CTF (R) | Stain (G) | Change by Processing: Change in Sensitivity | Change by Processing: Change in Gradation | Note |
|---|---|---|---|---|---|
| 26 | 0.27 | 0.08 | −0.03 | 0.05 | Invention |
| 27 | 0.28 | 0.08 | −0.04 | 0.06 | " |
| 28 | 0.27 | 0.08 | −0.13 | 0.23 | Comparison |
| 29 | 0.27 | 0.09 | −0.03 | 0.05 | Invention |
| 30 | 0.27 | 0.27 | −0.03 | 0.06 | " |
| 31 | 0.27 | 0.08 | −0.14 | 0.25 | Comparison |
| 32 | 0.27 | 0.08 | −0.14 | 0.26 | " |
| 33 | 0.26 | 0.07 | −0.02 | 0.04 | Invention |
| 34 | 0.27 | 0.08 | −0.04 | 0.06 | " |
| 35 | 0.28 | 0.08 | −0.04 | 0.06 | " |
| 36 | 0.27 | 0.08 | −0.13 | 0.26 | Comparison |

EXAMPLE 3

Samples (37) to (41) were prepared in the same manner as Sample (6) of Example 1, except that the amounts of dyes of formulae (V-1), (a-12), and (a-27) were changed to those shown in Table 5. These samples were evaluated using the same methods as employed in Examples 1 and 2. The results of CTF are shown in Table 6. The degrees of stain and change in sensitivity and gradation were substantially equal to those of Sample 6.

TABLE 5

| Sample No. | Amount of Dye Added (mg/m$^2$): V-1 | a-12 | a-27 | Optical Reflection Density: 470 nm | 550 nm | 680 nm |
|---|---|---|---|---|---|---|
| (37) | — | 28.0 | 19.5 | 0.15 | 0.91 | 0.71 |
| (38) | — | 23.0 | 38.0 | 0.16 | 0.91 | 1.02 |
| (39) | 1.0 | 13.0 | " | 0.15 | 0.72 | 1.03 |
| (40) | 2.0 | " | " | 0.21 | 0.72 | 1.02 |
| (41) | 5.0 | " | " | 0.32 | 0.73 | 1.02 |

TABLE 6

| Sample No. | B | G | R | Remarks | Note |
|---|---|---|---|---|---|
| (37) | 0.28 | 0.37 | 0.27 | In the sample for CTF, the blur of cyan color is noticeable | Invention |
| (38) | 0.28 | 0.37 | 0.32 | In the sample for CTF, the blur of cyan color is noticeable | " |
| (39) | 0.27 | 0.32 | 0.33 | In the sample for CTF, | " |

TABLE 6-continued

| Sample No. | B | G | R | Remarks | Note |
|---|---|---|---|---|---|
| | | | | the blur of yellow color is slightly noticeable | |
| (40) | 0.30 | 0.32 | 0.33 | Blue is not noticeable | " |
| (41) | 0.33 | 0.32 | 0.33 | Blue is not noticeable at all | " |

As can be seen from the results of Table 6, the samples having a reflection density at 550 nm below that at 680 nm, especially the samples having a reflection density at 470 nm of at least 0.2, of the samples prepared in accordance with the present invention, were superior in sharpness to B, G and R light and acquired color balance with respect to blur.

In accordance with the present invention, therefore, a silver halide color photographic material is provided having excellent sharpness and which substantially does not exhibit an increase in stain even when stored over a long period of time after processing. Moreover, the silver halide photographic material of the present invention substantially does not exhibit a change in sensitivity and gradation before and after continuous processing.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support comprising a base material and a water resistant resin layer containing titanium dioxide particles in an amount of at least 14% by weight of the water resistant resin layer, said support having thereon at least one blue-sensitive silver halide emulsion layer comprising a silver halide emulsion having a silver chloride content of at least 95 mol %, at least one green-sensitive silver halide emulsion layer comprising a silver halide emulsion having a silver chloride content of at least 95 mol %, and at least one red-sensitive silver halide emulsion layer comprising a silver halide emulsion having a silver chloride content of at least 95 mol % on the same side of the support as the water resistant resin layer, said photographic material having an optical reflection density of at least 0.70 but not greater than 2.0 at 680 nm, said photographic material containing at least one compound represented by formula (I) or (II) and at least one compound represented by formula (III), the total layer thickness of the constituent photographic layers provided on the support after immersing in a color developing solution for at least 60 seconds is at least 1.4 times that of the dry thickness before processing, and the total silver coverage of all of the silver halide emulsions contained in the silver halide color photographic material is not more than 0.78 g/m$^2$ in terms of the coating weight of silver:

$$R_{21}\text{—}(A)_n\text{—}X \qquad \text{(I)}$$

$$R_{22}\text{—}\underset{\underset{B}{|}}{C}\text{=}Y_1 \qquad \text{(II)}$$

wherein $R_{21}$ and $R_{22}$ each represents an aliphatic group, an aromatic group or a heterocyclic group; X represents a group which is eliminated by reaction with an aromatic amide developing agent and when X is a halogen atom, n=0; A represents a group which forms a chemical bond by reaction with an aromatic amine developing agent; n represents 0 or 1; B represents a hydrogen atom, an aliphatic group, an aromatic group, a heterocyclic group, an acyl group or a sulfonyl group; $Y_1$ represents a group which accelerates the addition of an aromatic amine developing agent to the compound represented by formula (II); and $R_{21}$ and X, or $Y_1$ and $R_{22}$ or B may be combined together to form a ring structure:

$$R_{30}\text{—}Z \qquad \text{(III)}$$

wherein $R_{30}$ represents an aliphatic group, an aromatic group or a heterocyclic group; and Z represents a nucleophilic group or a group which releases a nucleophilic group upon decomposition in the photographic material.

2. A silver halide color photographic material as in claim 1, wherein the total silver coverage of all of the silver halide emulsions contained in the silver halide color photographic material is not more than 0.70 g/m$^2$ in terms of the coating weight of silver.

3. A silver halide color photographic material as in claim 1, wherein the sum total of the silver coverage of the silver halide emulsions contained in all of the blue-sensitive emulsion layers and all of the red-sensitive emulsion layers is not more than 0.60 g/m$^2$.

4. A silver halide color photographic material as in claim 1, wherein the compounds represented by formulae (I) and (II) have a second order reaction constant $k_2$ (80° C.), when reacted with p-anisidine, of from 1.0 to $1\times10^{-5}$ liter/mol·sec.

5. A silver halide color photographic material as in claim 1, wherein the group Z is derived from a nucleophilic functional group having a Pearson's nucleophilic $^nCH_3I$ value of 5 or above.

6. A silver halide color photographic material as in claim 1, wherein the aliphatic group represented by $R_{21}$, $R_{22}$, B and $R_{30}$ is a straight chain, branched or cyclic alkyl, alkenyl or alkynyl group; the aromatic group represented by $R_{21}$, $R_{22}$, B and $R_{30}$ is a carbon ring type aromatic group selected from phenyl and naphthyl; and the heterocyclic group represented by $R_{21}$, $R_{22}$, B and $R_{30}$ is selected from chromanyl, pyrrolidyl, pyrrolinyl, furyl, thienyl, pyrazolyl, pyridyl, indolyl, benzofuryl and phenanthridinyl.

7. A silver halide color photographic material as in claim 1, wherein the group represented by X is selected from 2-pyridyloxy, 2-pyrimidyloxy, 4-pyrimidyloxy, 2-(1,2,3-triazine)oxy, 2-benzimidazolyl, 2-imidazolyl, 2-thiazolyl, 2-benzothiazolyl, 2-furyloxy, 2-thiophenyloxy, 4-pyridyloxy, 3-isooxazolyloxy, 3-pyrazolidinyloxy, 3-oxo-2-pyrazolonyl, 2-oxo-1-pyridinyl, 4-oxo-1-pyridinyl, 1-benzimidazolyl, 3-pyrazolyloxy, 3H-1,2,4-oxadiazolin-5-oxy, aryloxy, alkoxy, alkylthio, arylthio and a halogen atom.

8. A silver halide color photographic material as in claim 1, wherein the compound represented by formula (I) is represented by the formula (I-a), (I-b), (I-c) or (I-d):

$$R_{21}\text{—Link—}\overset{\overset{O}{\|}}{C}\text{—O—Ar} \qquad \text{(I-a)}$$

-continued

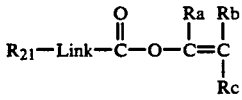

(I-b)

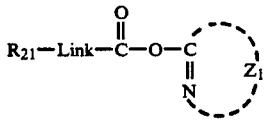

(I-c)

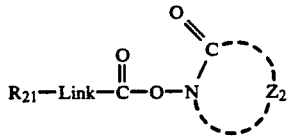

(I-d)

wherein $R_{21}$ has the same meaning as $R_{21}$ in formula (I); Link represents a single bond or —O—; Ar represents an aromatic group; Ra, Rb and Rc, which may be the same or different, each represents a hydrogen atom, an aliphatic group, an aromatic group or a heterocyclic group, an alkoxy group, an aryloxy group, a heterocyclic oxy group, an alkylthio group, an arylthio group, a heterocyclic thio group, an amino group, an alkylamino group, an acyl group, an amido group, a sulfonamido group, a sulfonyl group, an alkoxycarbonyl group, a sulfo group, a carboxyl group, a hydroxy group, an acyloxy group, a ureido group, a urethane group, a carbamoyl group or a sulfamoyl group; Ra and Rb or Rb and Rc may be combined together to form a 5-membered to 7-membered heterocyclic ring; $Z_1$ and $Z_2$ each represents a nonmetallic atomic group required for forming a 5-membered to 7-membered heterocyclic ring.

9. A silver halide color photographic material as in claim 8, wherein the compound represented by formula (I) is represented by the formula (I-a) or (I-c).

10. A silver halide color photographic material as in claim 8, wherein the compound represented by formula (I) is represented by the formula (I-a).

11. A silver halide color photographic material as in claim 1, wherein said at least one green-sensitive silver halide emulsion layer contains a magenta color coupler, said at least one red-sensitive silver halide emulsion layer contains a cyan color coupler and said at least one blue-sensitive silver halide emulsion layer contains a yellow color coupler.

12. A silver halide color photographic material as in claim 1, wherein the at least one green-sensitive silver halide emulsion layer contains a compound represented by formula (I) or (II) and a compound represented by formula (III) coemulsified with a magenta coupler in an amount of from $1\times10^{-2}$ to 10 mol per mol of the magenta coupler.

13. A silver halide color photographic material as in claim 1, wherein the optical reflection density is at least 0.8 but not greater than 1.9 at 680 nm.

14. A silver halide color photographic material as in claim 1, wherein the optical reflection density is at least 1.0 but not greater than 1.8 at 680 nm.

15. A silver halide color photographic material as in claim 1, wherein the optical reflection density at 550 nm is the same or less than the optical reflection density at 680 nm.

16. A silver halide color photographic material as in claim 16, wherein the optical reflection density at 470 nm is at least 0.20.

17. A silver halide color photographic material as in claim 1, wherein the ratio of the optical reflection density at 550 nm to that at 680 nm is at least 0.2, but not greater than 1.

18. A silver halide color photographic material as in claim 1, wherein the ratio of the optical reflection density at 550 nm to that at 680 nm is at least 0.2, but not greater than 0.8.

19. A silver halide color photographic material as in claim 1, wherein the ratio of the optical reflection density at 550 nm to that at 680 nm is at least 0.2, but not greater than 0.5.

20. A silver halide color photographic material as in claim 1, wherein the titanium dioxide particles are contained in the water resisting resin layer in an amount of at least 15% by weight, but not more than 60% by weight of the water resisting resin layer.

21. A silver halide color photographic material as in claim 1, wherein the water resisting resin layer has a thickness of from 2 to 200 μm.

22. A silver halide color photographic material as in claim 1, wherein the occupied area ratio (%) of the titanium dioxide particles is not greater than 0.20.

23. A silver halide color photographic material as in claim 1, wherein the total layer thickness of the constituent photographic layers provided on the support after immersing in a color developing solution for at least 60 seconds is at least 1.8 times but not more than 4.0 times that of the dry thickness before processing.

24. A silver halide color photographic material as in claim 1, wherein the base material of the support comprises a neutral paper having a pH of 5 to 7.

25. A silver halide color photographic material as in claim 1, wherein the compound represented by formula (I) or (II) and at least one compound represented by formula (III) are contained in a green-sensitive silver halide emulsion layer containing a magenta coupler.

* * * * *